US011337498B2

(12) United States Patent
Tran et al.

(10) Patent No.: US 11,337,498 B2
(45) **Date of Patent: *May 24, 2022**

(54) WALLET WITH CARD HOLDING MECHANISMS

(71) Applicant: Dango Products, LLC, Portola Valley, CA (US)

(72) Inventors: Thuan Tran, Santa Clara, CA (US); Charlie Carroll, Palo Alto, CA (US); Binh Tran, Santa Clara, CA (US)

(73) Assignee: Dango Products, LLC, Portola Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/470,825

(22) Filed: Sep. 9, 2021

(65) Prior Publication Data

US 2022/0117365 A1 Apr. 21, 2022

Related U.S. Application Data

(63) Continuation of application No. 17/227,204, filed on Apr. 9, 2021, now Pat. No. 11,178,947, which is a (Continued)

(51) Int. Cl.
*A45C 1/06* (2006.01)

(52) U.S. Cl.
CPC ..... *A45C 1/06* (2013.01); *A45C 2001/065* (2013.01); *A45C 2001/067* (2013.01)

(58) Field of Classification Search
CPC ..... A45C 2001/062; A45C 2001/065; A45C 7/0086; A45C 1/06; A45C 2001/067; A34C 1/06

(Continued)

(56) References Cited

U.S. PATENT DOCUMENTS

D187,240 S 2/1960 Harkins
3,461,469 A 8/1969 Morrision (Continued)

FOREIGN PATENT DOCUMENTS

CA 2471793 6/2003
KR 101356236 1/2014
KR 20140003803 U 6/2014

OTHER PUBLICATIONS

Dango Products—"Wallet Collections"—Available from Internet <URL: www.dangoproducts.com/collections/wallets>—Available at least as of Oct. 19, 2017—Retrieved from Internet Archive Wayback Machine <URL: https://web.archive.org/web/20171019082039/www.dangoproducts.com/collections/wallets> on Oct. 23, 2020.

(Continued)

*Primary Examiner* — Sue A Weaver
(74) *Attorney, Agent, or Firm* — Gallium Law; Wesley Schwie, Esq.; Isabel Fox

(57) ABSTRACT

The disclosure includes a wallet comprising an open-sided shell, a flexible member coupled to the open-sided shell, and an elastic band coupled to the flexible member. The flexible member may comprise an internal surface and an external surface located opposite the internal surface. In some embodiments, the open-sided shell is coupled to the internal surface. The wallet may be configured to move between open, closed, and clamshell positions. In the clamshell position, the elastic band may be configured to wrap around an external surface of the flexible member, thereby holding the wallet shut.

20 Claims, 42 Drawing Sheets

Related U.S. Application Data continuation-in-part of application No. 16/659,627, filed on Oct. 22, 2019, and a continuation-in-part of application No. 16/250,310, filed on Jan. 17, 2019.

(58) Field of Classification Search
USPC ..... 150/145, 147
See application file for complete search history.

(56) References Cited

U.S. PATENT DOCUMENTS

D266,479 S 10/1982 Hayakawa
4,705,086 A * 11/1987 O'Neill ..... A45C 1/04 150/134
4,763,821 A 8/1988 Powell
4,932,520 A 6/1990 Ciarcia
D314,865 S 2/1991 Tuisku
D322,039 S 12/1991 Chien
5,077,869 A 1/1992 Haase
D337,656 S 7/1993 Hostert
5,279,019 A 1/1994 Knickle
5,328,026 A 7/1994 Newman
D360,815 S 8/1995 Padden
D366,146 S 1/1996 Bertrand
D374,388 S 10/1996 Padden
D384,499 S 10/1997 Gaestel
D404,567 S 1/1999 Akutsu
5,944,080 A 8/1999 Podwika
D416,581 S 11/1999 Cheng
6,009,584 A 1/2000 Padden
6,044,967 A 4/2000 Painsith
6,076,665 A 6/2000 Chuang
D431,105 S 9/2000 Ling
6,145,994 A 11/2000 Ng
D434,624 S 12/2000 Padden
6,276,414 B1 5/2001 Bibb
D444,060 S 6/2001 Elsener
D447,438 S 9/2001 Dilibero
6,347,875 B1 2/2002 Painsith
D462,000 S 8/2002 Hightower
6,427,837 B1 8/2002 Shields
6,460,698 B1 10/2002 Wang
6,823,910 B1 11/2004 Elnekaveh
6,851,147 B2 2/2005 Abrahall
D517,390 S 3/2006 Cheng
D525,162 S 7/2006 Suman
7,334,616 B2 2/2008 Kaminski
7,556,073 B2 * 7/2009 Lyons ..... A45C 1/06 150/131
7,604,028 B2 10/2009 Bridgefarmer
7,918,335 B1 * 4/2011 Kitchen ..... A45C 11/18 206/38
7,971,324 B2 7/2011 Preston-Hall
8,251,210 B2 8/2012 Schmidt
D685,990 S 7/2013 Zhang
D690,931 S 10/2013 Minn
8,567,459 B2 10/2013 Kitchen
D695,013 S 12/2013 Minn
D701,043 S 3/2014 Minn
8,726,952 B2 5/2014 Jambunathan
D707,091 S 6/2014 Barr
8,763,795 B1 7/2014 Oten
8,776,846 B1 7/2014 Thompson
D716,043 S 10/2014 Wilk
8,863,793 B2 10/2014 Black
D718,525 S 12/2014 Kim
9,125,464 B2 9/2015 Minn
9,125,465 B2 * 9/2015 Beckley ..... A45C 13/185
D743,760 S 11/2015 Barr
D745,274 S 12/2015 Minn
D751,877 S 3/2016 Shlaferman
D755,764 S 5/2016 Dong
9,339,094 B2 5/2016 Tucker-Skow
D765,487 S 9/2016 Barr
D768,382 S 10/2016 Wu
D768,383 S 10/2016 Wu
D770,775 S 11/2016 Robertson
D772,678 S 11/2016 Haarburger
D775,824 S 1/2017 King
D780,449 S 3/2017 King
9,648,931 B2 5/2017 Sha
9,661,908 B2 5/2017 Mayer
D792,749 S 7/2017 Faro
D798,591 S 10/2017 King
D799,301 S 10/2017 Cetera
9,775,328 B1 10/2017 Fidrych
9,815,212 B2 11/2017 Barr
D805,770 S 12/2017 Justiss
D805,873 S 12/2017 Cetera
D806,386 S 1/2018 King
D808,158 S 1/2018 King
D808,765 S 1/2018 Kisling
D809,792 S 2/2018 Moon
9,907,375 B1 * 3/2018 Kitchen ..... A45C 13/005
D814,182 S 4/2018 Haarburger
D814,183 S 4/2018 Haarburger
D815,932 S 4/2018 Lee
D815,935 S 4/2018 Barak
D817,196 S 5/2018 Haarburger
D817,316 S 5/2018 Srour
D827,408 S 9/2018 Stefanczyk-Lacor
10,080,409 B2 9/2018 King
D831,349 S 10/2018 Deng
10,123,596 B2 11/2018 King
D835,408 S 12/2018 Justiss
D835,409 S 12/2018 Justiss
D835,410 S 12/2018 Chan
10,206,473 B2 2/2019 Haarburger
D842,070 S 3/2019 Kisling
D845,623 S 4/2019 Sullivan
D856,956 S 8/2019 Liu
10,368,618 B2 8/2019 Richards
D860,645 S 9/2019 Wu
D861,339 S 10/2019 Moon
D866,177 S 11/2019 Leh
D866,178 S 11/2019 Jin
D866,276 S 11/2019 Shlaferman
D866,964 S 11/2019 Tran
D868,463 S 12/2019 Tran
10,512,316 B2 12/2019 Haarburger
D875,490 S 2/2020 Barr
D877,513 S 3/2020 Duncan
D877,594 S 3/2020 Liang
D878,891 S 3/2020 Polczynski
D878,893 S 3/2020 Kao
D879,580 S 3/2020 Spater
10,595,611 B2 3/2020 Berkley
D881,671 S 4/2020 Kao
D884,339 S 5/2020 Li
D884,792 S 5/2020 Swallow
D887,708 S 6/2020 Tran
D887,709 S 6/2020 Fenton
D890,525 S 7/2020 Leh
D891,767 S 8/2020 Lamb
D893,975 S 8/2020 Tran
D895,276 S 9/2020 Leh
D895,961 S 9/2020 Swan
D895,963 S 9/2020 Anderson
D896,506 S 9/2020 Anderson
10,791,808 B2 10/2020 Kane
D904,016 S 12/2020 Jacobsen
D908,351 S 1/2021 Hoffman
D908,352 S 1/2021 Pirker
D909,059 S 2/2021 Leh
D915,765 S 4/2021 Quittner
D917,879 S 5/2021 Chui
D930,981 S 9/2021 Ghazzaoui
D932,182 S 10/2021 Foy
D933,360 S 10/2021 Qing
D934,560 S 11/2021 Tran
11,178,947 B2 11/2021 Tran
2002/0179463 A1 12/2002 Newman
2004/0148837 A1 8/2004 Lewis
2005/0035006 A1 * 2/2005 Dohner ..... A45C 1/06 206/39

(56) References Cited

U.S. PATENT DOCUMENTS

| | | | | |
|---|---|---|---|---|
| 2008/0314483 | A1 | 12/2008 | Armstrong | |
| 2009/0199940 | A1 | 8/2009 | Toner | |
| 2012/0228168 | A1* | 9/2012 | Kitchen | A45C 11/182 206/307 |
| 2013/0056119 | A1 | 3/2013 | Henriette | |
| 2013/0276943 | A1 | 10/2013 | Minn et al. | |
| 2014/0143958 | A1 | 5/2014 | Barr | |
| 2015/0240524 | A1 | 8/2015 | Olroyd | |
| 2015/0257499 | A1 | 9/2015 | Muir | |
| 2015/0282579 | A1 | 10/2015 | Piro | |
| 2016/0324283 | A1 | 11/2016 | Kane | |
| 2016/0374443 | A1 | 12/2016 | Kim | |
| 2017/0035169 | A1 | 2/2017 | Haarburger | |
| 2017/0055654 | A1 | 3/2017 | King | |
| 2017/0119115 | A1 | 5/2017 | King | |
| 2017/0135452 | A1 | 5/2017 | Kane | |
| 2017/0224077 | A1 | 8/2017 | Mayer | |
| 2017/0265610 | A1 | 9/2017 | Smith | |
| 2018/0027935 | A1 | 2/2018 | Laatz | |
| 2018/0064223 | A1 | 3/2018 | Singer | |
| 2018/0325228 | A1 | 11/2018 | Leimer | |
| 2019/0008253 | A1* | 1/2019 | Deng | A45F 5/021 |
| 2019/0318667 | A1 | 10/2019 | Freeman | |
| 2019/0365066 | A1 | 12/2019 | Hill | |
| 2020/0077758 | A1 | 3/2020 | Hoffman | |
| 2020/0229557 | A1 | 7/2020 | Tran | |
| 2020/0305564 | A1 | 10/2020 | Myers | |
| 2020/0379509 | A1 | 12/2020 | Coward | |
| 2021/0112935 | A1 | 4/2021 | Tran | |
| 2021/0330045 | A1* | 10/2021 | Tran | A45C 1/06 |
| 2021/0337945 | A1 | 11/2021 | Popoff | |

OTHER PUBLICATIONS

Onward Innovation—"RFID Carbon Fiber Cash Strap Wallet"—Downloaded Apr. 9, 2021—Available from Internet <URL: https://onwardinnovation.com/products/rfid-carbon-fiber-cash-strap-wallet?variant=31920056205360&currency=USD>.

Ridge—"Aluminum—Black"—Downloaded Apr. 9, 2021—Available from Internet <URL: https://ridge.com/products/aluminum-black?>.

Titan X—"Titan X | Pro Edition"—Downloaded Apr. 9, 2021—Available from Internet <URL: https://titanxwallet.com/products/edition?currency=USD&variant=33003264409643>.

Alpine Swiss—"Alpine Swiss Genuine Leather Super Thing Slim Cash Strap Front Pocket Wallet"—Downloaded Apr. 9, 2021—Available from Internet <URL: https://www.alpineswiss.com/alpine-swiss-genuine-leather-super-thin-slim-cash-strap-front-pocket-wallet/>.

Simple Zone—"Carbon Fiber Wallet for Men, Simple Zone RFID Blocking Slim Minimalist Card Holder Wallet with Money Clip and Cash Strap"—First available Jun. 18, 2020—Downloaded Apr. 9, 2021—Available from Internet <URL: https://www.amazon.com/Carbon-Simple-Zone-Blocking-Minimalist/dp/B08BG4G8GJ>.

Dango Products—"T01 Tactical Bifold Wallet—Spec-Ops—Blueline"—Downloaded Apr. 9, 2021—Available from Internet <URL: https://www.dangoproducts.com/products/t01-tactical-bifold-wallet-blueline-spec-ops?variant=21433891881044>.

Dango Products—"Dango M1 Maverick Wallet—CNC—Machined Aluminum, RFID Blocking, Made in USA"—First available Jan. 12, 2019—Downloaded May 24, 2021—Available from Internet <URL: https://www.amazon.com/dp/B07MMDRGCV/ref=as_li_ss_tl?ie-UTF8&linkCode-sl1&tag-k1a209-20&linkld-8c261f44b8217cb2913188b624fa5e66&language-en_US>.

Dango Products—"Dango Products—M1 Maverick Bifold Wallet"—Video by user Dango Products—First available Nov. 29, 2018—Downloaded May 24, 2021—Available from Internet <URL: https://www.youtube.com/watch?v=kqF_xCWWLOU>.

Muradin—"Muradin Dapper Leather Bifold Wallet—Genuine Tactical Wallet—Card Wallet for Men—RFID-Blocking Aluminum Metal Wallet"—First available Nov. 22, 2020—Downloaded May 24, 2021—Available from Internet <URL: https://www.amazon.com/MURADIN-Dapper-Leather-Bifold-Wallet/dp/B07ZPXH81N?th=1 >.

Dango Products—"A10 Adapt Wallet"—Downloaded May 25, 2021—Available from Internet <URL: https://www.dangoproducts.com/collections/a-series-wallets/products/a10-adapt-wallet>.

Hanker—"Carbon Fiber Aluminum Metal Minimalist Wallet RFID Blocking Credit Card Holder Money Clip"—First available Feb. 7, 2019—Downloaded May 25, 20219—Available from Internet <URL: https://www.amazon.com/Carbon-Aluminum-Minimalist-Wallet-Blocking/dp/B07NHK6P55>.

Elephant Wallet—"N Wallet Carbon Fiber—Fabric Rubber"—Downloaded Mar. 17, 2021—Available from Internet <URL: https://elephantwallet.com/products/n-wallet-carbon-fiber>.

Elephant Wallet—"How Does It Work (X Wallet)"—Downloaded Mar. 17, 2021—Available from Internet <URL https://elephantwallet.com/pages/how-does-it-work>.

Wallet Gear—"Bifold Leather Wallet with Elastic Band"—Downloaded Mar. 17, 2021—Available from Internet <URL: https://www.walletgear.com/bifold-leather-wallet-with-elastic-band.html>.

Curated Basics—"Elastic Band Minimalist Wallet"—Downloaded Mar. 17, 2021—Available from Internet <URL https://www.curatedbasics.com/products/elastic-band>.

Dango Products—"Dango D03 Dapper Bifold EDC Wallet—Made in USA—Genuine Leather, Slim, Minimalist, Metal, RFID Blocking"—Downloaded Nov. 24, 2021—Available at least as of Apr. 22, 2021 (first review)—Available from Internet <URL: https://www.amazon.com/Dango-D03-Dapper-Bifold-Wallet/dp/B0925CV8CK?ref_=ast_sto_dp&th=1>.

Dango Products—"D03 Dapper Bifold Wallet"—Downloaded Nov. 24, 2021—Available from Internet <URL: https://www.dangoproducts.com/products/d03-dapper-wallet?_pos=6&_sid=87be8627b&_ss=r>.

Dango Products—"Dango Products: D03 Dapper Bifold Wallet"—Video by user Dango Products—First available Apr. 20, 2021—Downloaded Nov. 24, 2021—Available from Internet <URL: https://www.youtube.com/watch?v=QSLs3ABQcoY>.

Dango Products—"A10 Bifold Pen Adapter"—Video by user Dango Products—First available Jul. 15, 2020—Downloaded Nov. 24, 2021—Available from Internet <URL: https://www.youtube.com/watch?v=7y6fXT8Y0SI>.

Dango Products—"A10 Adapt Bifold Pen Wallet"—Available from Internet <URL: https://www.dangoproducts.com/products/a10-adapt-bifold-pen-wallet?_pos=6&_sid=5cec358d2&_ss=r>.

Dango Products—"Dango M1 Maverick Rail EDC Wallet—Made in USA—All-Metal, Minimalist, Slim, RFID Blocking"—First Available Oct. 9, 2019—Downloaded Nov. 24, 2021—Available from Internet <URL: https://www.amazon.com/Dango-M1-Maverick-Rail-Wallet/dp/B07YWJWK9Z>.

Dango Products—"Dango M1 Maverick Rail Wallet"—First Available Oct. 7, 2019—Downloaded Nov. 24, 2021—Available from Internet <URL: https://www.youtube.com/watch?v=5xTPdgAZkL8>.

Dango Products—"M1 Maverick Rail Wallet"—Downloaded Nov. 24, 2021—Available from Internet <URL https://www.dangoproducts.com/products/m1-maverick-rail-wallet.

Anvi Original—"MiniCap 1.0/2.0 Mens RFID Blocking Front Pocket Minimalist Slim Wallet With Pull Tab Money Clip"—Date first available: Sep. 14, 2018; Downloaded Nov. 11, 2021 from https://www.amazon.com/Minicap1-0-Blocking-Pocket-Minimalist-Wallet/dp/B07HCD1BRR.

Leatheram—"Handmade pull up card holder, leather credit card case with pull tab, minimalist wallet, thin minimal wallet"—Available at least as of Dec. 14, 2019; Downloaded Nov. 11, 2021 from https://www.etsy.com/listing/235786494/handmade-pull-up-card-holder-leather?gpla=1&gao=1&.

(56) References Cited

OTHER PUBLICATIONS

Nite Ize—"Nite Ize Financial Tool, Multi Tool Money Clip, Minimalist Wallet, Money Clip, Multi Tool, and Credit Card Holder Combo, Stainless Steel"—First available Mar. 1, 2018—Downloaded Jul. 29, 2021—Available from Internet <URL: https://www.amazon.com/gp/product/B078KZSGKR/ref=as_li_tl?ie=UTF8&camp=1789&creative=9325&creativeASIN=B078KZSGKR&linkCode=as2&tag=gearmoose-20&linkId=ea188cd142e324326581d5cf27a7eb60>.

Safe Price—"Stainless Steel Men Money Clip Elastic Band Slim Credit Card Holder Wallet Purse (Silver)"—First available Sep. 20, 2017—Downloaded Jul. 29, 2021—Available from Internet <URL: https://www.amazon.com/Stainless-Elastic-Credit-Holder-Wallet/dp/B075S95PQ7?th=1>.

TI-EDC—"TI-EDC Titanium Slim Cash Money Clip Wallet Credit Card Holder and Bottle Opener"—First Available Dec. 10, 2013—Downloaded Jul. 29, 2021—Available from Internet <URL: https://www.amazon.com/TI-EDC-Titanium-Wallet-Credit-Holder/dp/B00H7UHZZY/ref=asc_df_B00H7UHZZY/?tag=hyprod-20&linkCode=df0&hvadid=167122580135&hvpos=&hvnetw=g&hvrand=3990154944988812308&hvpone=&hvptwo=&hvqmt=&hvdev=c&hvdvcmdl=&hvlocint=&hvlocphy=9019667&hvtargid=pla-311720176311&psc=1 >.

Cheers All—Beer Opener Money Clip—Downloaded Jul. 29, 2021—Available from Internet <URL: https://cheersall.com/products/beer-opener-money-clip?variant=14100368031805&currency=USD&utm_medium=product_sync&utm_source=google&utm_content=sag_organic&utm_campaign=sag_organic&gclid=CjwKCAjwuvmHBhAxEiwAWAYj-I6xbGH0L1OthGghbE0Q4wTje17ifU45SOT7qX9YbVV-fwCDBFz2tRoC_w0QAvD_BwE>.

* cited by examiner

WALLET WITH CARD HOLDING MECHANISMS

CROSS-REFERENCE TO RELATED APPLICATIONS

The entire contents of the following application are incorporated by reference herein: U.S. application Ser. No. 17/227,204; filed Apr. 9, 2021; issued as U.S. Pat. No. 11,178,947 on Nov. 23, 2021; and entitled WALLET WITH CARD HOLDING MECHANISMS.

The entire contents of the following application are incorporated by reference herein: U.S. application Ser. No. 16/250,310; filed Jan. 17, 2019; published Jul. 23, 2020 as US 2020/0229557; and entitled WALLET.

The entire contents of the following application are incorporated by reference herein: U.S. application Ser. No. 16/659,627; filed Oct. 22, 2019; published Apr. 22, 2021 as US 2021/0112935; and entitled WALLET.

BACKGROUND

Field

Various embodiments disclosed herein generally relate to wallets. More specifically, the present disclosure relates to wallets with a rail system, an elastic band, and at least one pocket.

Description of Related Art

Wallets are designed to carry articles such as credit cards, currency, business cards, pictures, identification cards (such as a driver's license or work ID), plus assorted other paper items. The most common type of wallet has a bifold design including one or more compartments and is made to be carried in a pocket or bag. Wallets are, in general, made from fabric and/or leather goods and sewn to form storage pockets. They may also utilize a metal clip of sorts intended to hold paper currency. These storage pockets are typically sewn to hold one, or a few, cards, Each pocket adds a layer of material, increasing the overall thickness of the wallet and limiting the number of cards a wallet can carry. As a result, typical wallets often become bulky in size and more difficult and uncomfortable to carry, especially in a pocket. Traditional wallets may also stretch and loosen over time, leaving the credit and/or identification cards, currency, etc. vulnerable to being lost. There is therefore a need for an improved type of wallet to hold a high capacity of cards and currency while maintaining a slim profile.

SUMMARY

The disclosure includes a wallet comprising an open-sided shell having a personal card receiving surface and a back surface facing opposite the personal card receiving surface, the open-sided shell configured to securably couple at least one personal card along the personal card receiving surface within an internal portion of the open-sided shell. In many embodiments, the wallet further comprises a flexible member including an internal surface and an external surface facing opposite the internal surface, the flexible member defining a bottom half and a top half located opposite the bottom half, wherein the internal surface of the bottom half is coupled to the back surface of the open-sided shell. The wallet may include an elastic band having a first end coupled to a first side surface of the top half of the flexible member, and a second end located opposite the first end whereby the second end is coupled to a second side surface of the top half of the flexible member, the second side surface located opposite the first side surface. The elastic band may be configured to move between a first position whereby the elastic band wraps around the internal surface of the top half of the flexible member, and a second position whereby the elastic band wraps around the external surface of the top half of the flexible member.

In some embodiments, the wallet defines an open position, a closed position, and a clamshell position. When the wallet is in the open position, the flexible member may be configured to lay substantially flat such that the top half of the internal surface of the flexible member and the personal card receiving surface of the open-sided shell both substantially face a same direction, and the elastic band may be configured to be in at least one of the first position and the second position. When the wallet is in the closed position, the top half of the internal surface of the flexible member may be folded over the personal card receiving surface of the open-sided shell such that the top half of the internal surface of the flexible member faces the personal card receiving surface of the open-sided shell, and the elastic band may be configured to be in at least one of the first position and the second position. When the wallet is in the clamshell position, the top half of the internal surface of the flexible member may be folded over the personal card receiving surface of the open-sided shell such that the top half of the internal surface of the flexible member faces the personal card receiving surface of the open-sided shell, and when the wallet is in the clamshell position the elastic band may be configured to move to a third position whereby the elastic band wraps around the open-sided shell and the bottom half of the flexible member.

In many embodiments, the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface. The first side wall may comprise a first retention tab configured to move away from the second side wall to thereby receive the at least one personal card, the first side wall defining a first top portion and a first bottom portion located adjacent the bottom side wall, the first retention tab located adjacent the first top portion. The second side wall may comprise a second retention tab configured to move away from the first side wall to thereby receive the personal card, the second side wall defining a second top portion and a second bottom portion located adjacent the bottom side wall, the second retention tab located adjacent the second top portion. In some embodiments, the first retention tab comprises a first protruding portion configured to secure the at least one personal card in place with respect to the personal card receiving surface, the first protruding portion located adjacent the first top portion, and the second retention tab comprises a second protruding portion configured to secure the at least one personal card in place with respect to the personal card receiving surface, the second protruding portion located adjacent the second top portion.

The first retention tab and the second retention tab may be configured to move between a locked position and a receiving position, wherein when the first retention tab and the second retention tab are in the locked position the first retention tab and the second retention tab may be located a first distance from each other, wherein when the first retention tab and second retention tab are in the receiving position the first retention tab and the second retention tab may be located a second distance from each other, and wherein the first distance may be less than the second distance. In many embodiments, when the open-sided shell receives the at least one personal card, the first retention tab moves away from the second side wall and the second retention tab moves away from the first side wall to thereby receive the at least one personal card. When the open-sided shell securably couples the at least one personal card within the internal portion, the first retention tab may move towards the second side wall and the second retention tab may move towards the first side wall to thereby securably lock the at least one personal card within the internal portion of the open-sided shell. In many embodiments, the first retention tab defines a first cantilever arm physically spaced from a remaining portion of the first side wall, and the second retention tab defines a second cantilever arm physically spaced from a remaining portion of the second side wall.

In some embodiments, the bottom side wall comprises a first bottom side wall portion, a second bottom side wall portion, and an open clearance area located between the first bottom side wall portion and the second bottom side wall portion, whereby the open clearance area is configured to receive a user's finger to thereby push the at least one personal card away from the bottom side wall. The first bottom side wall portion may define a first width and the second bottom side wall portion may define a second width, wherein the second width may be greater than the first width.

The first side wall and the second side wall may be elongate along a first direction, and the bottom side wall may be elongate along a second direction perpendicular to the first direction. In some embodiments, the first side wall defines a first back portion located adjacent to the personal card receiving surface, and a first front portion located opposite the first back portion. The second side wall may define a second back portion located adjacent to the personal card receiving surface, and a second front portion located opposite the second back portion. In some embodiments, the bottom side wall defines a third back portion located adjacent to the personal card receiving surface, and a third front portion located opposite the third back portion. The open-sided shell may comprise a front retaining surface protruding along the second direction from the first front portion of the first side wall, along the second direction from the second front portion of the second side wall, and along the first direction from the third front portion of the bottom side wall. The front retaining surface may be spaced from the personal card receiving surface.

In many embodiments, the front retaining surface extends around at least a portion of a perimeter of the personal card receiving surface, wherein the front retaining surface comprises a left side retaining surface and a right side retaining surface. The left side retaining surface may extend from a first location located below the first retention tab down along the first side wall to the first bottom portion of the first side wall and along the bottom side wall to a second location adjacent an open clearance area. The right side retaining surface may extend from a third location adjacent the open clearance area along the bottom side wall to the second bottom portion of the second side wall and up along the second side wall to a fourth location located below the second retention tab. In some embodiments, the second location of the left side retaining surface defines a first angle, and the third location of the right side retaining surface defines a second angle. The second angle may be greater than the first angle. In some embodiments, the left side retaining surface defines a left side height and a left side width, and the right side retaining surface defines a right side height and a right side width. The left side height and the right side height may be substantially equal, and the left side width may be less than the right side width.

In some embodiments, the at least one personal card comprises a front surface, a back surface located opposite the front surface, a first side edge, a second side edge located opposite the first side edge, a top edge, and a bottom edge located opposite the top edge. When the at least one personal card is securably coupled to the open-sided shell with the back surface facing the personal card receiving surface, the front retaining surface may be configured to cover at least a portion of the front surface along the first side edge, at least a portion of the front surface along the second side edge, and at least a portion of the front surface along the bottom edge.

The wallet may further comprise a first aperture located along a first side portion of the open-sided shell and a second aperture located along a second side portion of the open-sided shell, the first aperture located opposite the second aperture. When the wallet is in the clamshell position, the elastic band may wrap around the first aperture and the second aperture. In some embodiments, the first side wall and the second side wall are elongate along a first direction, and the bottom side wall is elongate along a second direction perpendicular to the first direction, and the elastic band wraps around at least one of the flexible member and the open-sided shell along the second direction.

The wallet may also include an identification window coupled to the top half of the flexible member and located along the internal surface of the flexible member, and the identification window may be configured to receive an identification card. When the elastic band is in the first position the elastic band may at least partially cover the identification window, and when the elastic band is in the second position the elastic band may not cover the identification window. In many embodiments, the identification window includes an aperture configured to allow a user to view and directly contact the internal surface of the flexible member located beneath the identification window.

In some embodiments, the internal portion of the open-sided shell defines an internal width measuring at least 3.375", and an internal height measuring at least 2.125". The open-sided shell may define a first width, and the flexible member may define a second width that is less than the first width.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1A:
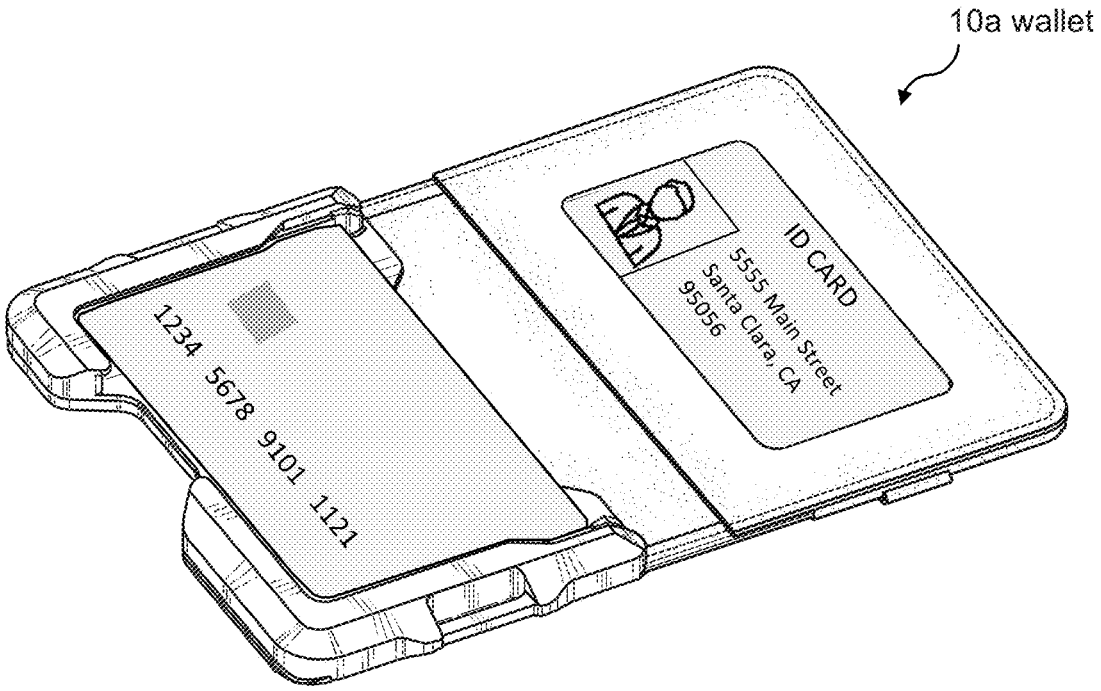
FIG. 1A illustrates a perspective view of a wallet in open position, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

REFERENCE NUMERALS

10—wallet
12—open-sided shell
13—open-sided shell
14—personal card receiving surface
15—personal card receiving surface
16—back surface
17—back surface
18—at least one personal card
20—internal portion (of open-sided shell)
21—internal portion (of open-sided shell)
22—flexible member
24—internal surface (of flexible member)
26—external surface (of flexible member)
28—bottom half (of flexible member)
30—top half (of flexible member)
32—elastic band
34*a*—first end (of elastic band)
34*b*—second end (of elastic band)
36*a*—first side surface (top half of flexible member)
36*b*—second side surface (top half of flexible member)
38—first position (of elastic band)
40—second position (of elastic band)
42—third position (of elastic band)
44—open position (wallet)
46—closed position (wallet)
48—clamshell position (wallet)
50*a*—first side wall
50*b*—second side wall
50*c*—bottom side wall
51*a*—first side wall
51*b*—second side wall
51*c*—bottom side wall
52*a*—first retention tab
52*b*—second retention tab
53*a*—first retention tab
53*b*—second retention tab
54*a*—first top portion (first side wall)
54*b*—second top portion (second side wall)
56*a*—first bottom portion (first side wall)
56*b*—second bottom portion (second side wall)
58*a*—first protruding portion
58*b*—second protruding portion
60—locked position
62—receiving position
64*a*—first distance
64*b*—second distance
66*a*—first cantilever arm
66*b*—second cantilever arm
68*a*—first bottom side wall portion
68*b*—second bottom side wall portion
70—open clearance area
71—open clearance area

72*a*—first back portion (first side wall)
72*b*—second back portion (second side wall)
72*c*—third back portion (bottom side wall)
73—second back portion (second side wall)
74*a*—first front portion (first side wall)
74*b*—second front portion (second side wall)
74*c*—third front portion (bottom side wall)
75—second front portion (second side wall)
76—front retaining surface
77—front retaining surface
78*a*—left side retaining surface
78*b*—right side retaining surface
80*a*—first location
80*b*—second location
80*c*—third location
80*d*—fourth location
82*a*—first angle
82*b*—second angle
84*a*—left side height
84*b*—right side height
86*a*—left side width
86*b*—right side width
88—front surface (personal card)
92*a*—first side edge (personal card)
92*b*—second side edge (personal card)
92*c*—top edge (personal card)
92*d*—bottom edge (personal card)
94*a*—first aperture
94*b*—second aperture
96*a*—first side portion (open-sided shell)
96*b*—second side portion (open-sided shell)
98—identification window
100—aperture (of identification window)
102*a*—internal width (open-sided shell)
102*b*—internal height (open-sided shell)
104—first width (open-sided shell)
106—second width (flexible member)
108—first external pocket
110—second external pocket
112—rivets
113—rivets
114—pocket
116—stitching

INTRODUCTION

The disclosure includes multiple embodiments of a wallet. In some embodiments, the wallet comprises a bifold-style wallet with an elastic band configured to wrap around the wallet. In other embodiments, the wallet comprises a single pocket wallet. Multiple embodiments may include a rail system configured to hold multiple personal cards, such as credit cards, identification cards, business cards, membership cards (e.g., grocery store rewards card, gym membership, library card), gift cards, and the like. Multiple embodiments may also be configured to hold paper currency, coupons, photographs, and other paper items.

Figure 1B:
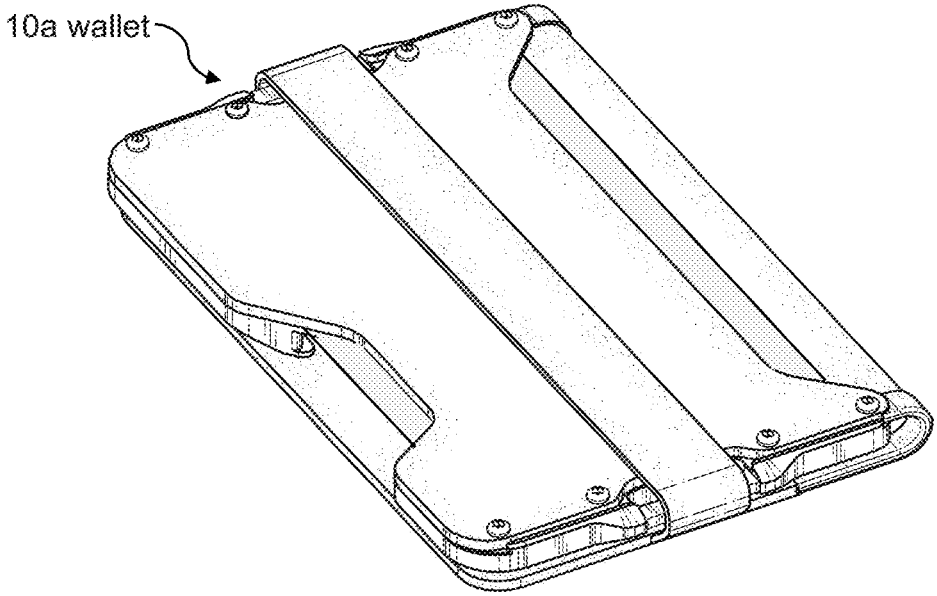
FIG. 1B illustrates a perspective view of a wallet in a clamshell position, according to some embodiments.
Figure 1C:
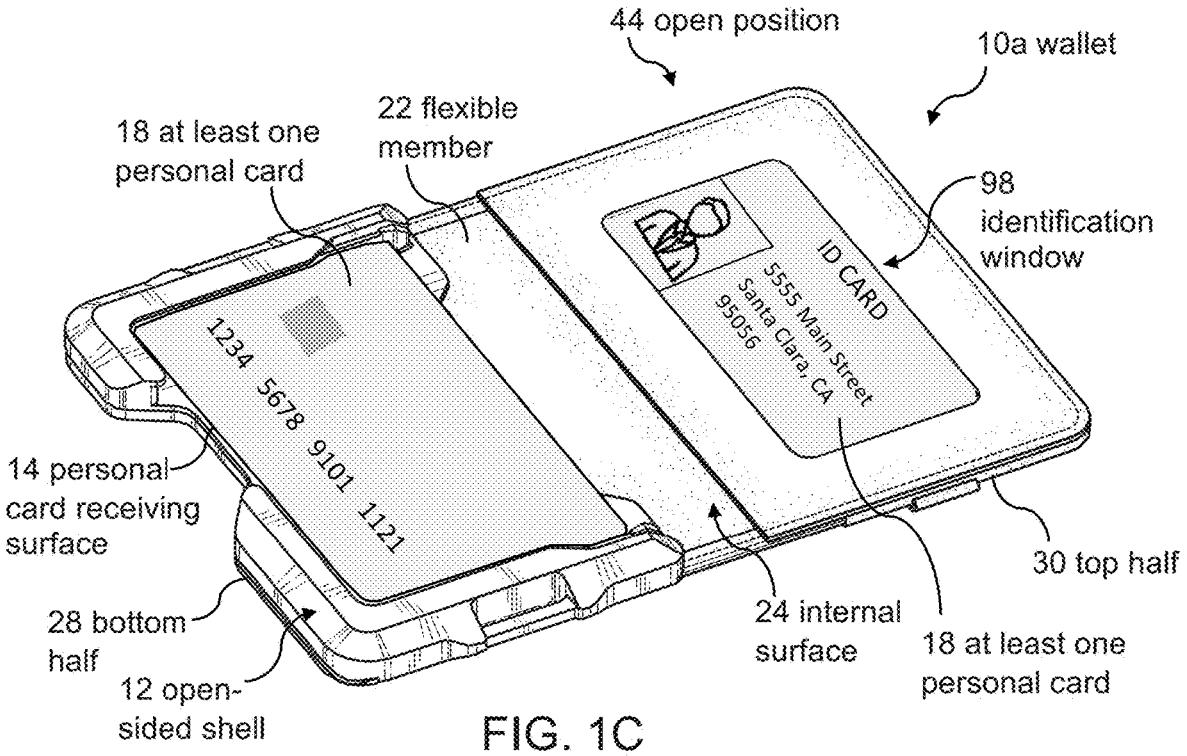
FIG. 1C illustrates a perspective view of a wallet in open position, according to some embodiments.

FIGS. 1A and 1B show different perspective views of a wallet 10*a*, according to some embodiments. FIG. 1C corresponds to FIG. 1A, and shows a bifold-style wallet 10*a* in an open position 44. As illustrated, the wallet 10*a* may include a flexible member 22 comprising a bottom half 28 and a top half 30, as well as an open-sided shell 12 coupled to the bottom half 28 of the flexible member 22. In many embodiments, the open-sided shell 12 includes a personal card receiving surface 14 configured to receive at least one personal card 18, as shown in FIG. 1C. As such, the personal card receiving surface 14 may not be visible beneath the at least one personal card 18. In some embodiments, the open-sided shell 12 is configured to hold up to five personal cards. Depending on the type of card, the open-sided shell 12 may be configured to hold more than five personal cards. FIG. 1C also shows that the top half 30 of the flexible member 22 may include an identification window 98 configured to hold at least one personal card 18. In many embodiments, the identification window 98 is configured to hold a single personal card. The identification window 98 may be configured to hold more than one personal card. As demonstrated, both the identification window 98 and the open-sided shell 12 may be located on an internal surface 24 of the flexible member 22.

Figure 1D:
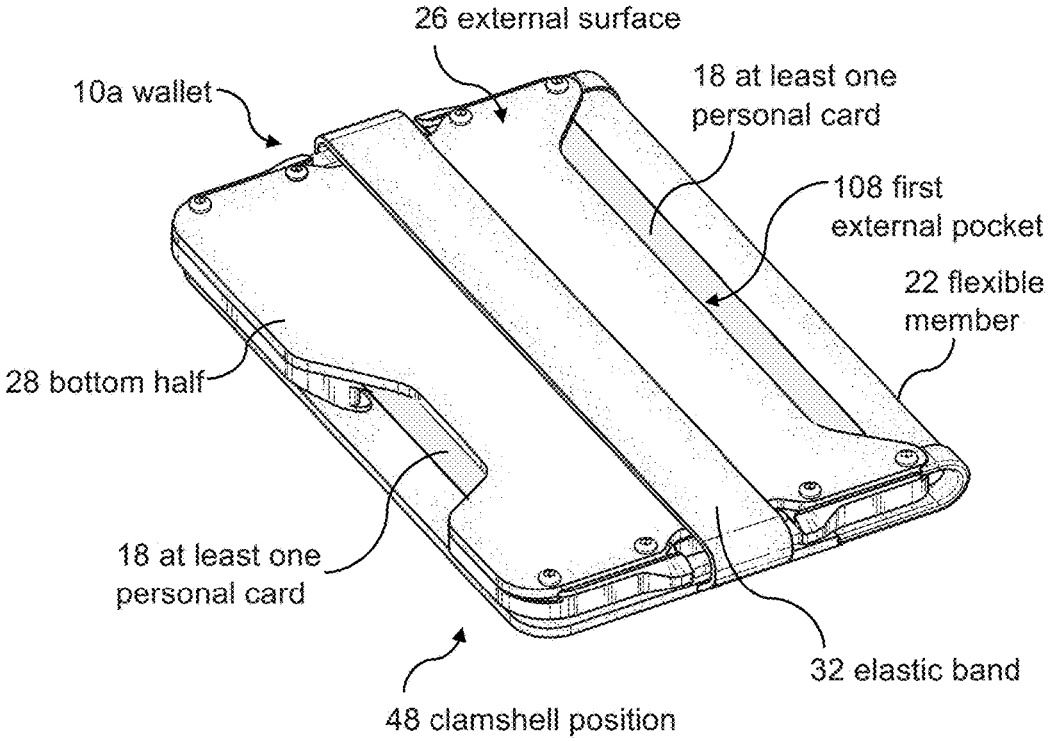
FIG. 1D illustrates a perspective view of a wallet in a clamshell position, according to some embodiments.

FIG. 1D corresponds to FIG. 1B, and shows the wallet 10*a* in a clamshell position 48. In many embodiments, the clamshell position 48 is defined as the wallet 10*a* in a closed position with an elastic band 32 wrapped around the wallet 10*a*, thereby keeping the wallet 10*a* closed. It should be noted that the elastic band 32 may comprise any flexible material, including rubber, elastic, or any suitable stretchable material. In many embodiments, the elastic band 32 comprises a single continuous piece. FIG. 1D also shows that, in many embodiments, the wallet 10*a* includes a first external pocket 108. Similar to the identification window 98 and the open-sided shell 12, the first external pocket 108 may be configured to hold at least one personal card 18. The first external pocket 108 may be located on the external surface 26 of the bottom half 28 of the flexible member 22, opposite the open-sided shell 12, which may be located on the internal surface 24, as indicated in FIG. 1C.

Figure 2:
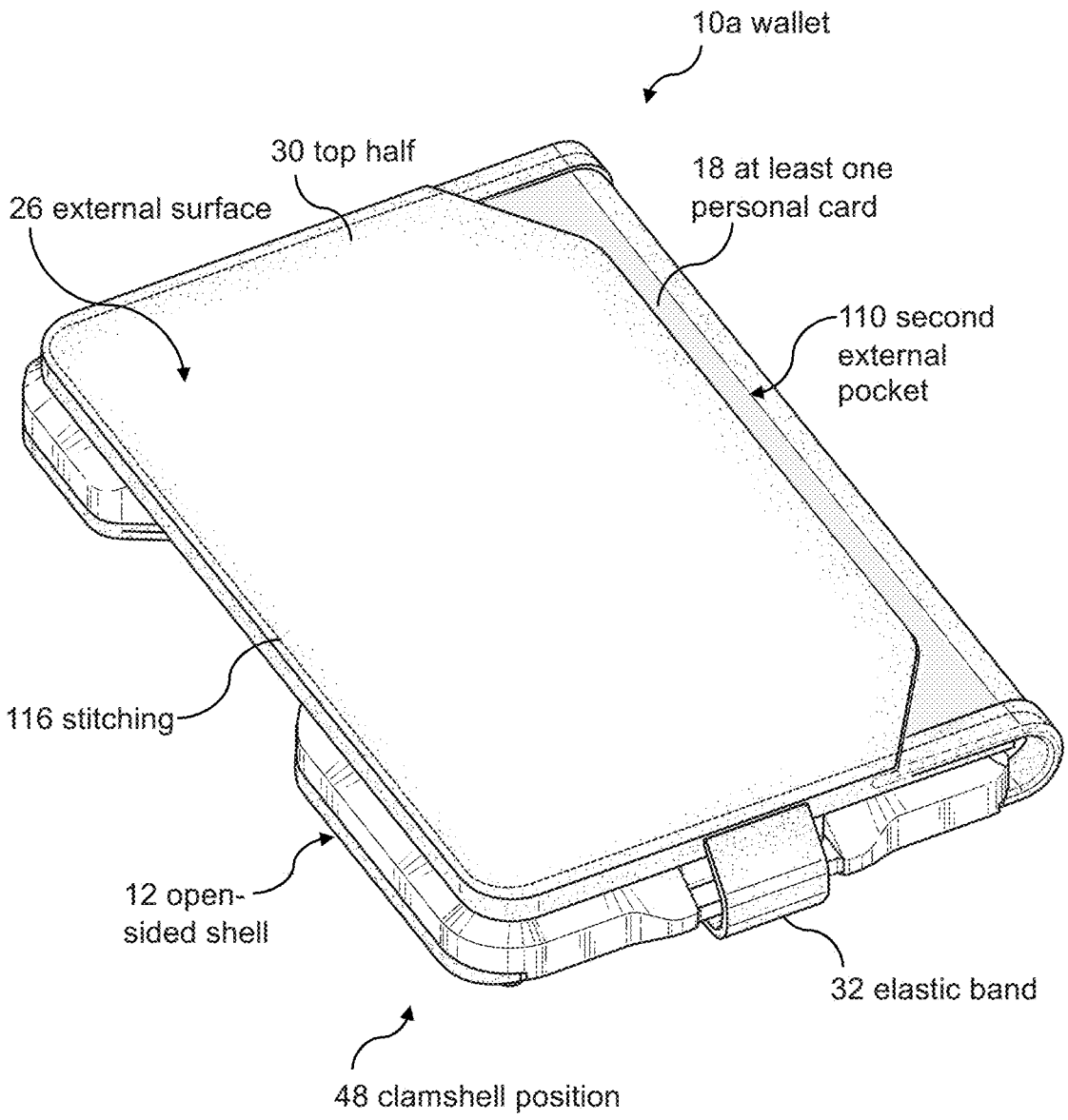
FIG. 2 illustrates a perspective view of a wallet in a clamshell position, according to some embodiments.

FIG. 2 also shows the wallet 10*a* in the clamshell position 48, but includes a perspective view of the top half 30 rather than the bottom half 28, as in FIG. 1D. As shown, the top half 30 may include a second external pocket 110 configured to hold at least one personal card 18. In many embodiments, the second external pocket 110 is located on the external surface 26 of the wallet 10*a*, opposite the identification window 98, which is located on the internal surface 24 of the wallet 10*a*. FIG. 2 also includes the elastic band 32, which may be coupled to the top half 30 and configured to wrap around the bottom half 28 of the wallet 10*a*, thereby holding the top half 30 against the bottom half 28 in the clamshell position 48. It should be noted that "top half 30" and "bottom half 28" indicate opposite portions of the wallet 10*a*. A "dividing line" may be imagined as extending through the flexible member 22 between the open-sided shell 12 and identification window 98 and/or between the first external pocket 108 and the second external pocket 110. As such, the "dividing line" may comprise the portion of the flexible member 22 configured to fold when the wallet 10*a* is in the clamshell position 48 and/or the closed position 46 (shown in FIG. 10). It should also be noted that the wallet 10*a* may be configured to "backbend," or bend in an opposite direction as compared to what is illustrated in the Figures. For example, the first and second external pockets 108, 110 may comprise internal pockets, and the open-sided shell 12 and the identification window 98 may be located on an external portion, when the wallet 10*a* is in a backbended position. In some embodiments, the elastic band 32 is configured to wrap around the wallet 10*a* to keep it closed in a backbended position.

Figure 7:
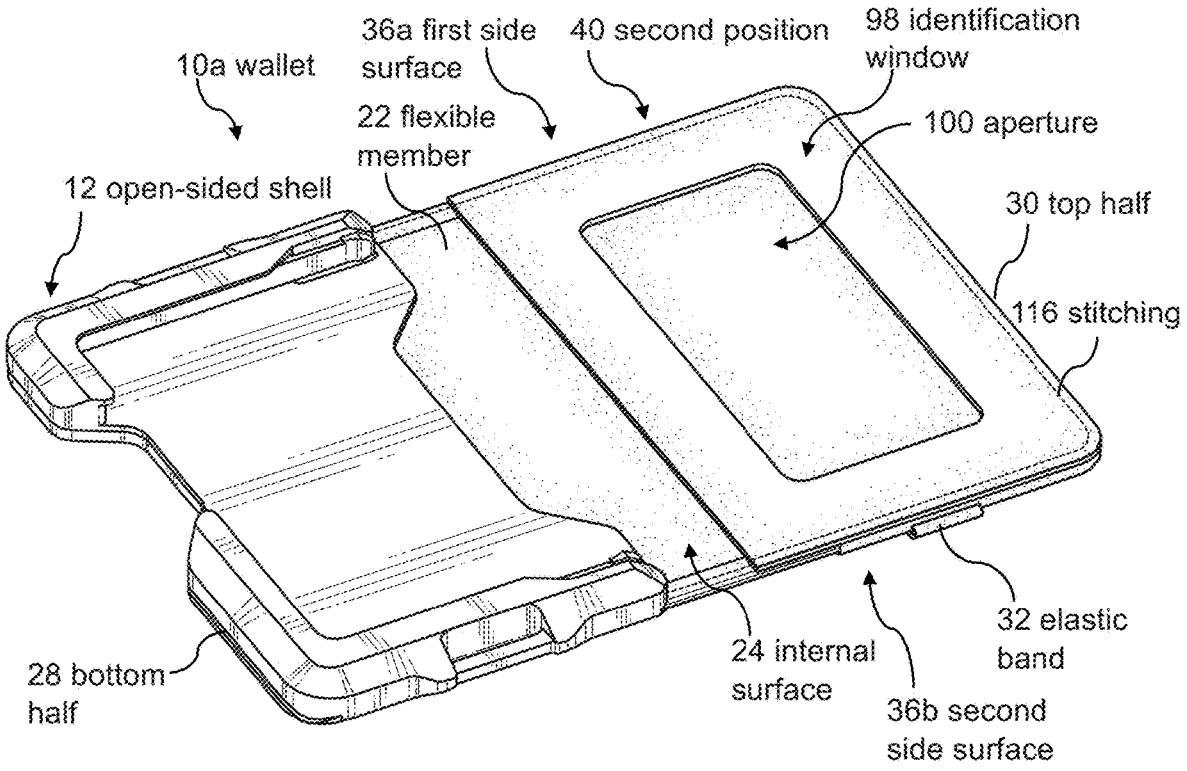

FIG. 2 also shows the stitching 116 of the wallet 10*a*. In many embodiments, substantially an entire perimeter of the flexible member 22 is stitched. The stitching 116 may be used to couple the second external pocket 110 to the top half 30 of the flexible member 22, as well as to couple the identification window 98 to the top half 30 of the flexible member 22. Stitching 116 may also be used to couple the first external pocket 108 to the bottom half 28 of the flexible member 22. In some embodiments, the stitching 116 is used to form a finished edge of the flexible member 22, such as in a center portion of the internal surface 24 between the open-sided shell 12 and the identification window 98. The stitching 116 may comprise hand-stitching or machine-stitching. Though not labeled in every Figure, the stitching 116 may be present in many embodiments of the wallet 10*a*, both on the external surface 26 (as shown in FIG. 2), and on the internal surface 24 (as shown in FIG. 7).

Figure 3:
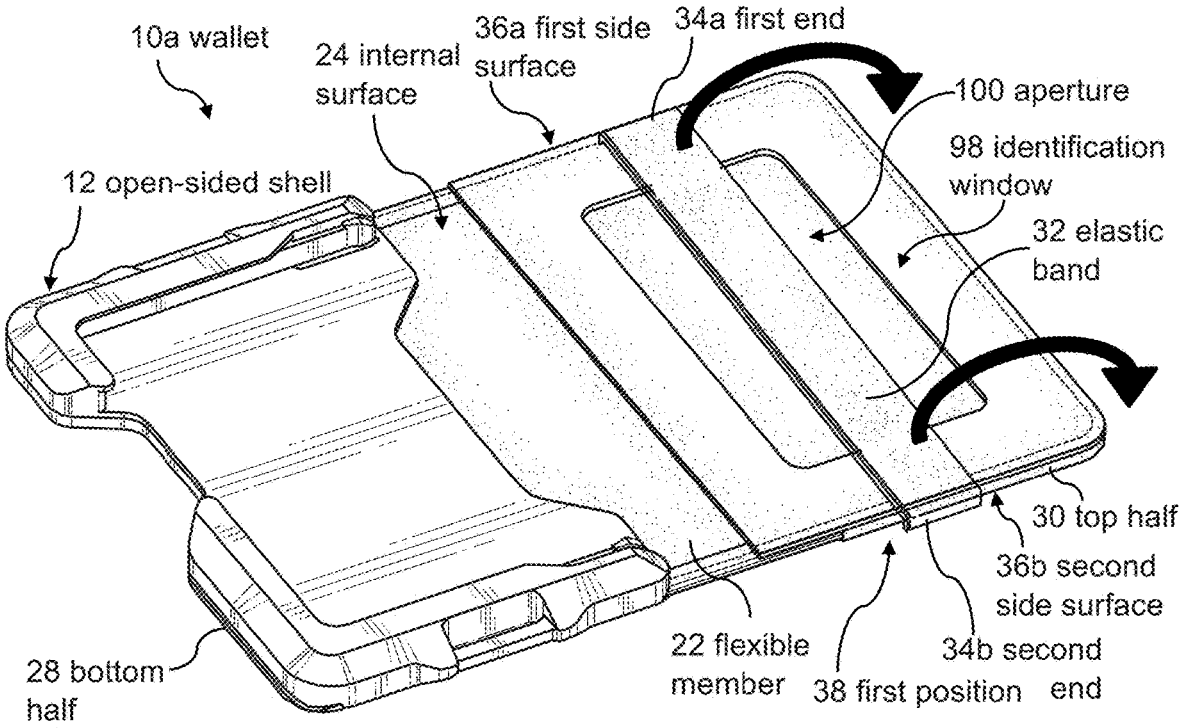
FIGS. 3, 4, 5, 6, 7, and 8 illustrate perspective views of a wallet in an open position, according to some embodiments.
Figure 4:
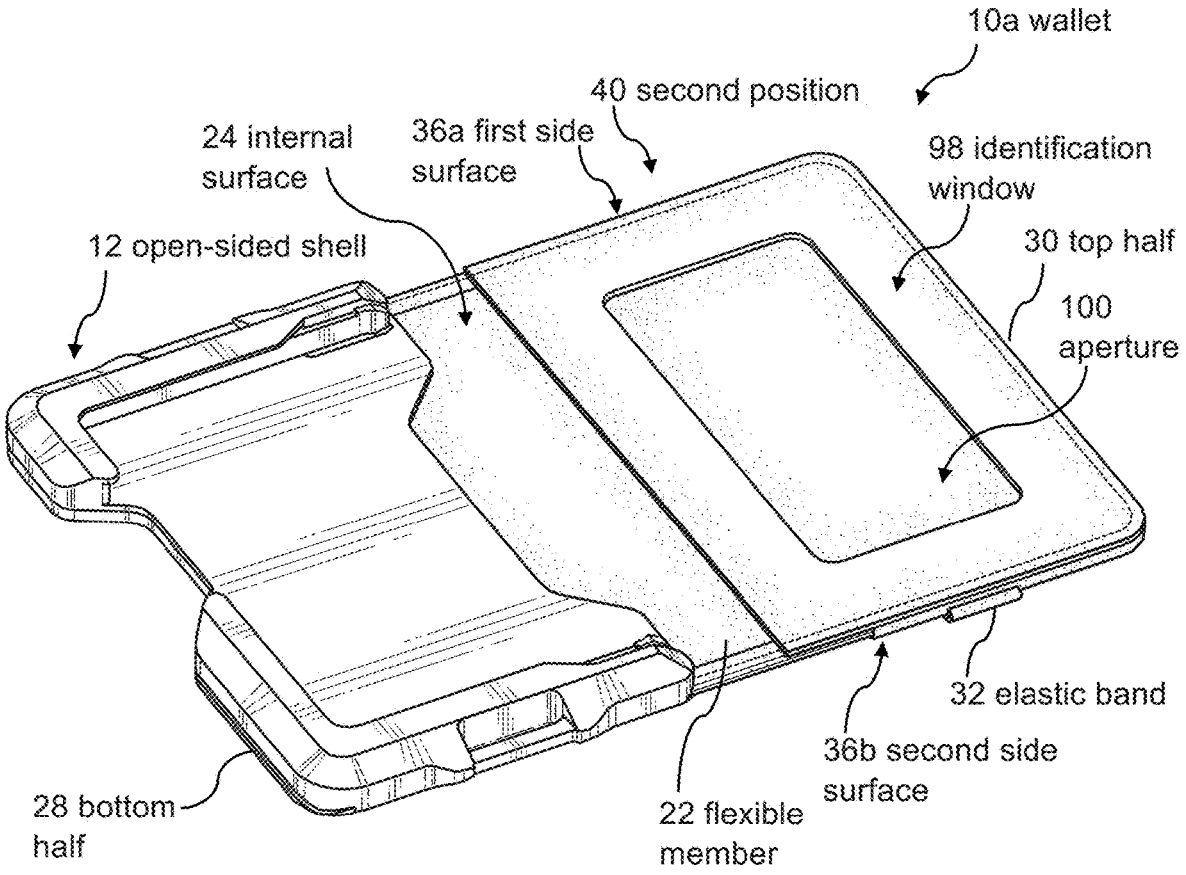

FIGS. 3 and 4 show the wallet 10*a* with the elastic band 32 in the first position 38 and second position 40, respectively. As illustrated, in the first position 38, the elastic band 32 may be configured to wrap around an internal surface 24 of the top half 30 of the flexible member 22, such that the elastic band 32 at least partially covers an aperture 100 of the identification window 98. The arrows in FIG. 3 indicate that the elastic band 32 may be configured to change to a second position 40 such that the band 32 wraps around an external surface 26 of the top half 30 so that it no longer extends across the identification window 98, as demonstrated by FIG. 4. FIG. 3 also shows that, in many embodiments, the elastic band 32 comprises a first end 34*a* coupled to the first side surface 36*a* of the top half 30, and a second end 34*b* coupled to the second side surface 36*b* of the top half 30, where the first side surface 36*a* is located opposite the second side surface 36*b*. The first end 34*a* and second end 34*b* may be defined as respective halves of the elastic band 32. In some embodiments, the first end 34*a* and second end 34*b* define only the small end portions coupled to the first side surface 36*a* and second side surface 36*b*, respectively. Each "end" 34*a*, 34*b* may be defined as any length of the elastic band 32, between 0.1% and 50% of the total length.

Each end 34*a*, 34*b* may be coupled to the respective side surface 36*a*, 36*b* via stitching, adhesive, or any other suitable method and/or combination of methods. Each end 34*a*, 34*b* may be coupled between layers of material of the top half 30. For example, each end 34*a*, 34*b* may be coupled between the identification window 98 and the flexible member 22, or between the flexible member 22 and the second external pocket 110. Alternatively, each end 34*a*, 34*b* may be coupled to the internal surface 24 (e.g. to the identification window 98) or to the external surface 26 (e.g. to the second external pocket 110). In some embodiments, the first end 34*a* is coupled via a different method and/or to a different location than the second end 34*b*. The first and second ends 34*a*, 34*b* may be coupled via substantially the same method and to corresponding locations; for example, both ends 34*a*, 34*b* coupled between layers, both ends 34*a*, 34*b* coupled to the internal surface 24, and/or both ends 34*a*, 34*b* coupled to the external surface 26.

In some embodiments, the elastic band 32 may be configured to hold at least one personal card 18 and/or paper currency (or other similar items). For example, in the first position 38 illustrated in FIG. 3, the elastic band 32 may be used to hold additional cards, currency, etc. against the identification window 98. In the second position illustrated in FIG. 4, the elastic band 32 may be used to hold additional cards, currency, etc. against the external surface 26 of the flexible member 22 (e.g., against the second external pocket 110). The elastic band 32 may also be used to hold additional cards, currency, etc. when the wallet 10*a* is in the clamshell position 48, as will be discussed further with reference to FIG. 9.

FIGS. 3 and 4 also show the aperture 100 of the identification window 98. In many embodiments, the aperture 100 comprises an open aperture, such that a user is able to view and directly contact the internal surface 24 of the flexible member 22 below the identification window 98 through the aperture 100. Stated differently, the aperture 100 may not include a covering (e.g. clear plastic), as is common in many traditional wallet designs. An open aperture 100 may provide easy access to the at least one personal card 18 located in the identification window 98, thereby making it easier for a user to remove the at least one personal card 18. The open aperture 100 may also contribute to reducing the overall size (weight, bulk, etc.) of the wallet 10*a*.

Figure 5:
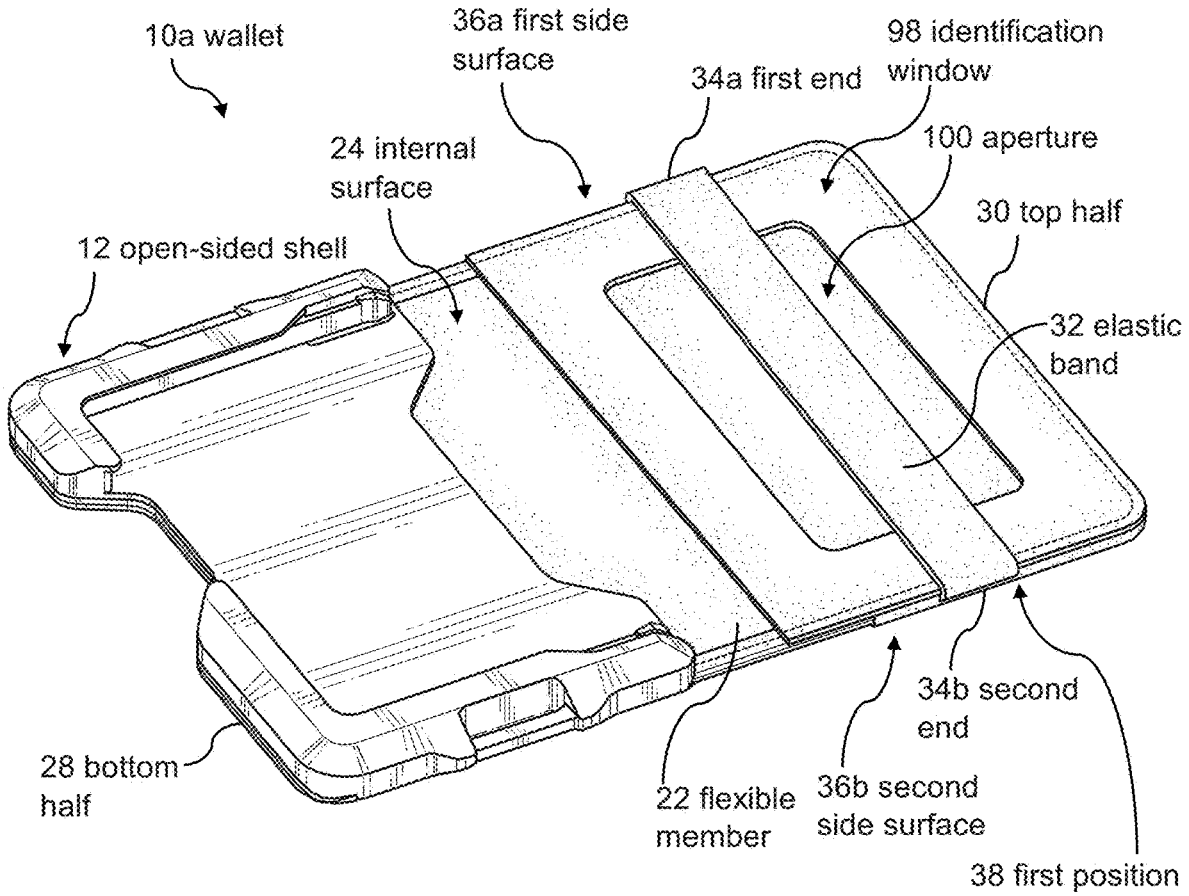
Figure 6:
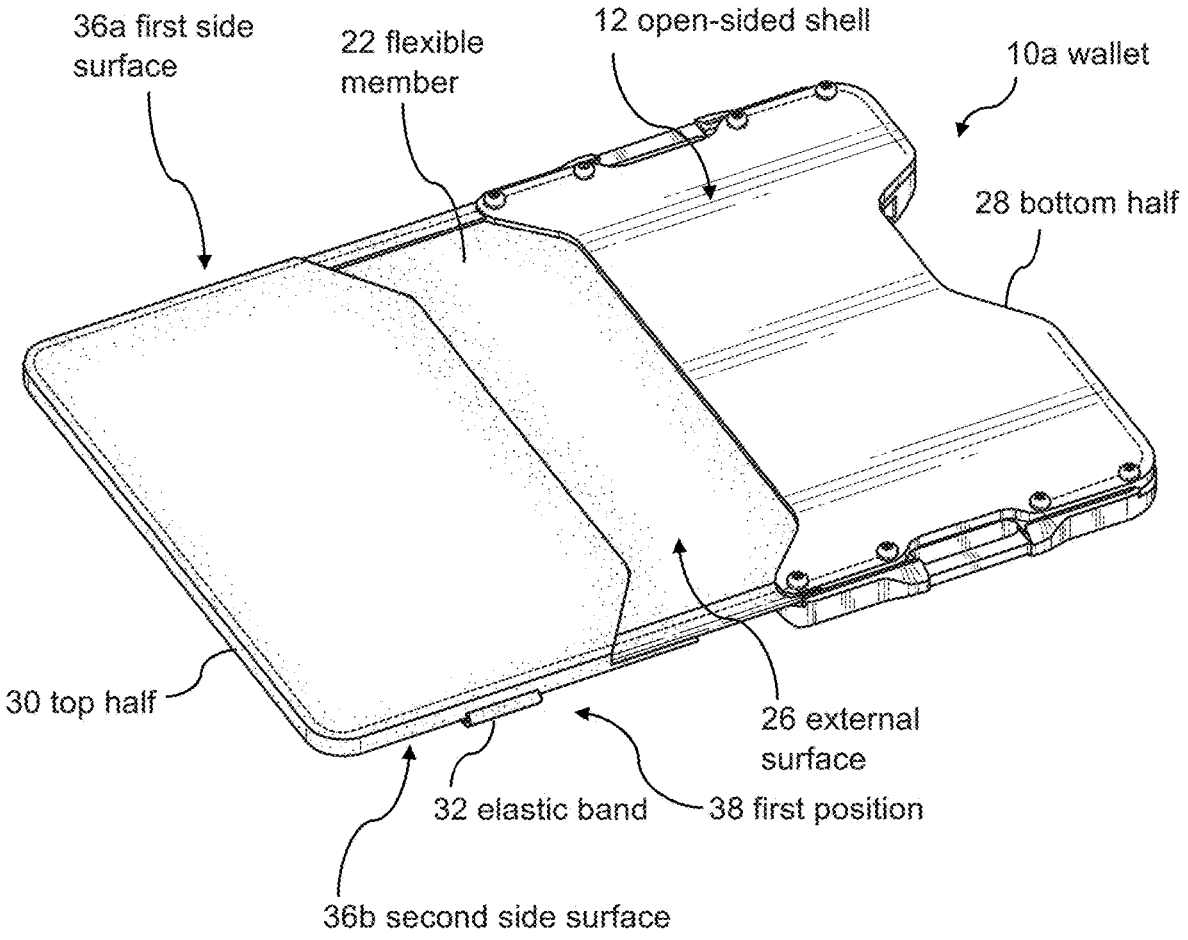

FIG. 5, similar to FIG. 3, shows the wallet 10*a* with the elastic band 32 in the first position 38. As previously mentioned, the elastic band 32 may comprise a first end 34*a* located opposite a second end 34*b*, and, when in the first position 38, the elastic band 32 may be configured to wrap around the internal surface 24 of the top half 30, such that the band 32 extends across the identification window 98. In many embodiments, the elastic band 32 is located near a center portion of the identification window 98, such that when the elastic band 32 is in the first position 38, it extends across substantially the center of the identification window 98 and aperture 100. The elastic band 32 may be off-center with respect to the identification window 98. FIG. 6 shows a back perspective view of the wallet 10*a* with the elastic band 32 in the first position 38. As illustrated, the elastic band 32 is visible coupled to the second side surface 36*b*, but does not extend across the external surface 26 of the flexible member 22.

Figure 8:
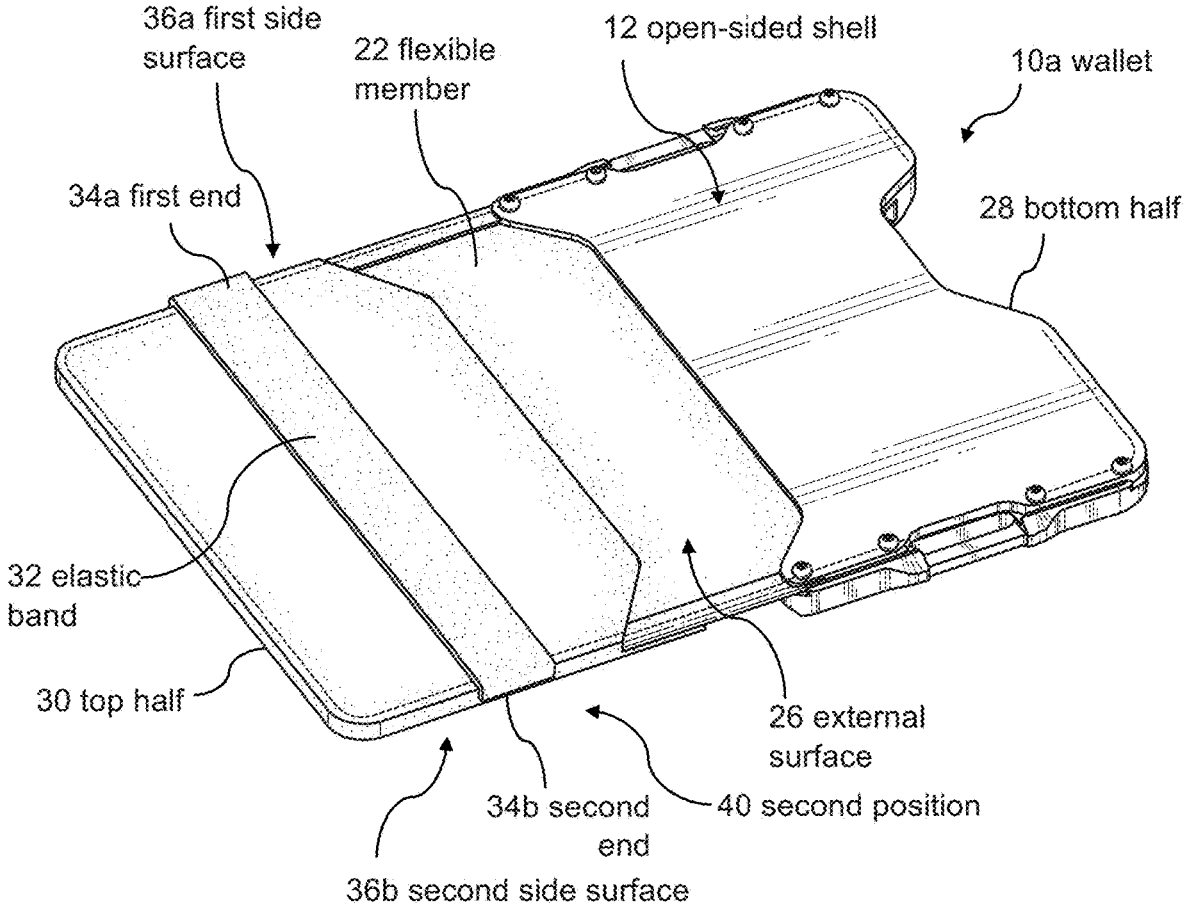

FIG. 7, similar to FIG. 4, shows the wallet 10*a* with the elastic band 32 in the second position 40. As previously stated, when the elastic band 32 is in the second position 40, it may be configured to wrap around an external surface 26 of the top half 30 of the flexible member 22. As such, in the second position 40, the elastic band 32 may not extend across an internal surface 24 of the top half 30, as indicated by FIG. 7. FIG. 8 shows a back perspective view of the wallet 10*a* with the elastic band 32 in the second position 40, and shows the band 32 extending across the external surface 26 of the top half 30. In many embodiments, the elastic band 32 extends from a first end 34*a* coupled to a first side surface 36*a* of the top half 30 to a second end 34*b* coupled to a second side surface 36*b* of the top half 30. The elastic band 32 may be configured to extend across substantially a center portion of the second external pocket 110.

It should be noted that FIGS. 3-8 all illustrate the wallet 10*a* in the open position 44, as shown in FIGS. 1A and 1C. In some embodiments, when the wallet 10*a* is in the open position 44, the flexible member 22 lies substantially flat such that the top half 30 of the internal surface 24 of the flexible member 22 and the personal card receiving surface 14 of the open-sided shell 12 both substantially face the same direction. The direction may be "up," "down," "left," or "right," depending on the orientation of the wallet 10*a*. For example, if the wallet 10*a* is lying flat on a table with the external surface 26 against the table, the direction would be considered "up." If the wallet 10*a* is lying flat on a table with the internal surface 24 against the table, the direction would be considered "down."

Figure 9:
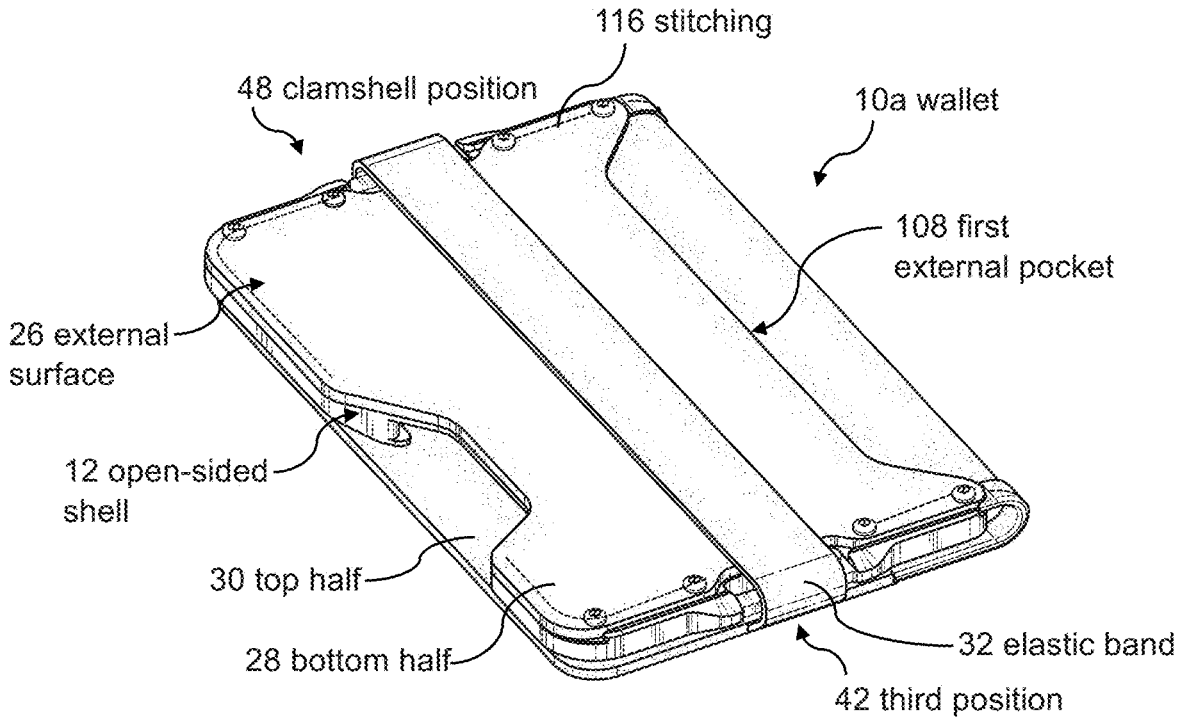
FIGS. 9 and 10 illustrate perspective views of a wallet in a clamshell position and a closed position, respectively, according to some embodiments.

FIG. 9 illustrates a perspective view of the wallet 10*a* in the clamshell position 48, with the elastic band 32 in the third position 42. In contrast to the first position 38 and the second position 40, where the elastic band 32 wraps around just the top half 30 of the flexible member 22, in the third position 42, the elastic band 32 may be configured to wrap around the bottom half 28 of the flexible member 22. As such, in the third position 42, the elastic band 32 may be configured to hold the wallet 10*a* shut (i.e., in the clamshell position 48). FIG. 9 also shows that, in many embodiments, when the elastic band 32 is in the third position 42, the elastic band 32 is configured to extend across the first external pocket 108. The elastic band 32 may be configured to extend across substantially a center portion of the first external pocket 108. As previously discussed, the first external pocket 108 may be coupled to the external surface 26 of the bottom half 28 of the flexible member 22, and located opposite the open-sided shell 12. In many embodiments, when the wallet 10*a* is in the clamshell position 48, the internal surface 24 of the top half 30 of the flexible member 22 is folded over the personal card receiving surface 14 of the open-sided shell 12 such that the internal surface 24 of the top half 30 of the flexible member 22 faces the personal card receiving surface 14. The internal surface 24 of the top half 30 may be configured to contact at least a portion of the open-sided shell 12.

As discussed with reference to FIGS. 3 and 4, the elastic band 32 may be used to hold additional card(s) and/or currency against the wallet 10*a*. For example, when the wallet 10*a* is in the clamshell position 48 as shown in FIG. 9, the elastic band 32 may be configured to hold card(s) and/or currency between the band 32 and the first external pocket 108. In addition, the clamshell position 48 may enable a user to partially open the wallet 10*a* in order to place and/or retrieve card(s) and/or currency between the top half 30 and the bottom half 28, without changing the position of the elastic band 32.

Figure 10:
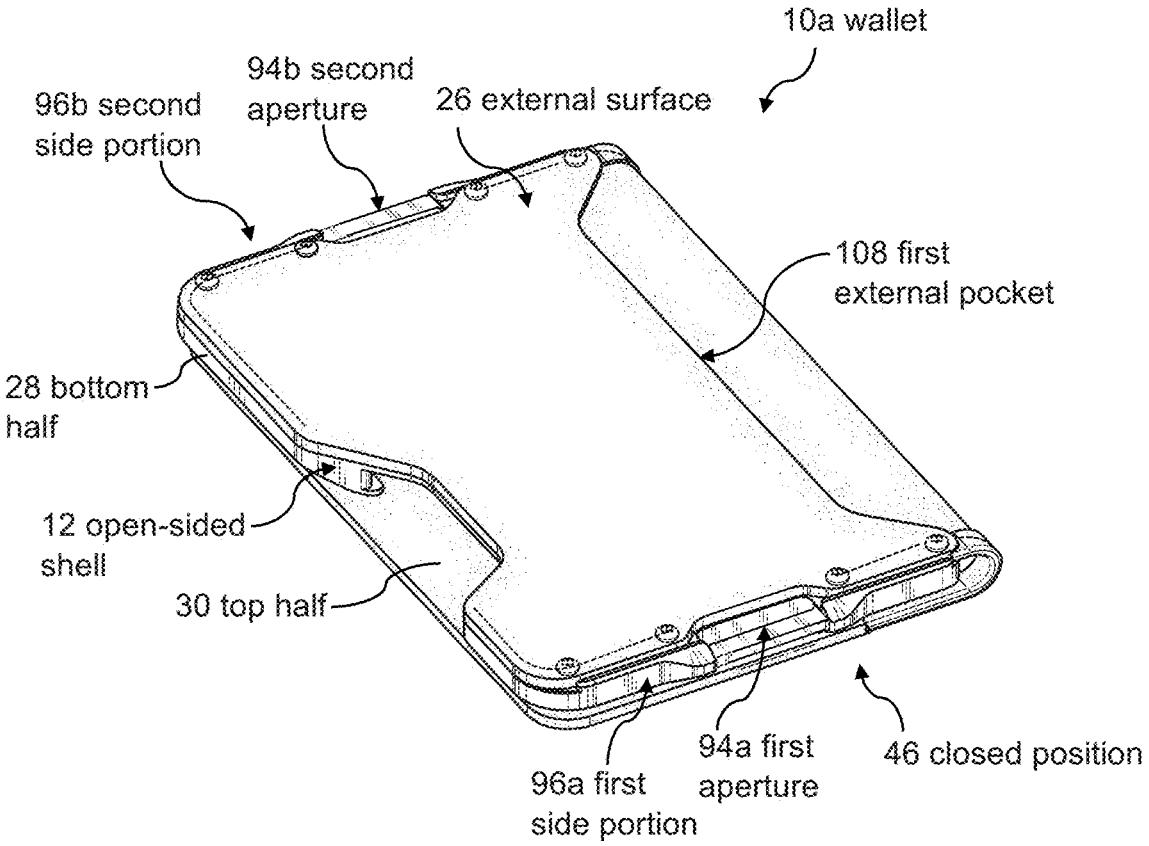

FIG. 10 shows a perspective view of the wallet 10*a* in the closed position 46. Though similar to the clamshell position 48, the closed position 46 does not include the elastic band 32 in the third position 42 wrapped around the bottom half 28. Instead, in many embodiments, when the wallet 10*a* is in the closed position 46, the elastic band 32 is configured to be in either the first position 38 or the second position 40, where the elastic band 32 is wrapped around only the top half 30. When the wallet 10*a* is in the closed position 46, the internal surface 24 of the top half 30 of the flexible member 22 may be folded over the personal card receiving surface 14 of the open-sided shell 12 such that the internal surface 24 of the top half 30 of the flexible member 22 faces the personal card receiving surface 14 of the open-sided shell 12. In some embodiments, the internal surface 24 of the top half 30 is configured to contact at least a portion of the open-sided shell 12.

FIG. 10 also shows that, in some embodiments, the wallet 10*a* includes a first aperture 94*a* and a second aperture 94*b* located opposite the first aperture 94*a*. The first aperture 94*a* may be located along a first side portion 96*a* of the open-sided shell 12 and the second aperture 94*b* may be located along a second side portion 96*b* of the open-sided shell 12, as illustrated in FIG. 10. As shown in FIG. 9, when the wallet 10*a* is in the clamshell position 48, the elastic band 32 may be configured to wrap around the first and second apertures 94*a*, 94*b*. The apertures 94*a*, 94*b* may help hold the elastic band 32 in place around the wallet 10*a* and prevent movement of the band 32 along the first and second side portions 96*a*, 96*b* of the open-sided shell 12. In some embodiments, the composition of each of the first and second apertures 94*a*, 94*b* includes each aperture itself as well as the surrounding structure of the open-sided shell 12. An outermost portion of the open-sided shell may include a central indented portion bordered by raised side walls that create a sort-of channel to help retain the elastic band 32 and prevent unwanted movement. The first and second apertures 94*a*, 94*b* may also be used to couple accessory devices (e.g., keyring/keychain, carabiner, and the like) to the wallet 10*a*.

It should also be noted that, in some embodiments, rather than coupling the elastic band 32 to the top half 30 of the flexible member 22, the elastic band 32 may be configured to couple to the bottom half 28 of the flexible member 22. For example, the elastic band 32 may be configured to couple along the first side portion 96*a* and second side portion 96*b*, and wrap around only the bottom half 28 (in modified first and second positions), or around both the bottom half 28 and top half 30 (in a modified third position). The elastic band 32 may be configured to couple within the first and second apertures 94*a*, 94*b*, or may be configured to couple to the first external pocket 108 adjacent the first and second apertures 94*a*, 94*b*. The elastic band 32 may be configured to couple between the open-sided shell 12 and the bottom half 28 of the flexible member 22 (e.g., on the back surface 16 of the open-sided shell 12).

In many embodiments, as shown in FIGS. 11-18, the open-sided shell 12 of the wallet 10*a* comprises a first side wall 50*a* and a second side wall 50*b* located opposite the first side wall 50*a*. The open-sided shell 12 may also include a bottom side wall 50*c*, which will be discussed in greater detail later in the disclosure. The first side wall 50*a*, second side wall 50*b*, and bottom side wall 50*c* may be configured to retain the at least one personal card 18 in place with respect to the personal card receiving surface 14. In some embodiments, the first side wall 50*a* includes comprises a first retention tab 52*a* configured to move away from the second side wall 50*b* to thereby receive the at least one personal card 18. Similarly, the second side wall 50*b* may comprise a second retention tab 52*b* configured to move away from the first side wall 50*a* to thereby receive the at least one personal card 18. Each of the first and second side walls 50*a*, 50*b* may define a top portion and a bottom portion located adjacent the bottom side wall 50*c*, wherein the retention tabs 52*a*, 52*b* may be located adjacent the respective top portions. The top and bottom portions of each side wall 50*a*, 50*b* will be discussed further later in the disclosure. The previously mentioned "rail system" may include the first side wall 50*a*, second side wall 50*b*, and bottom side wall 50*c*, as well as the first and second retention tabs 52*a*, 52*b*.

Figure 11:
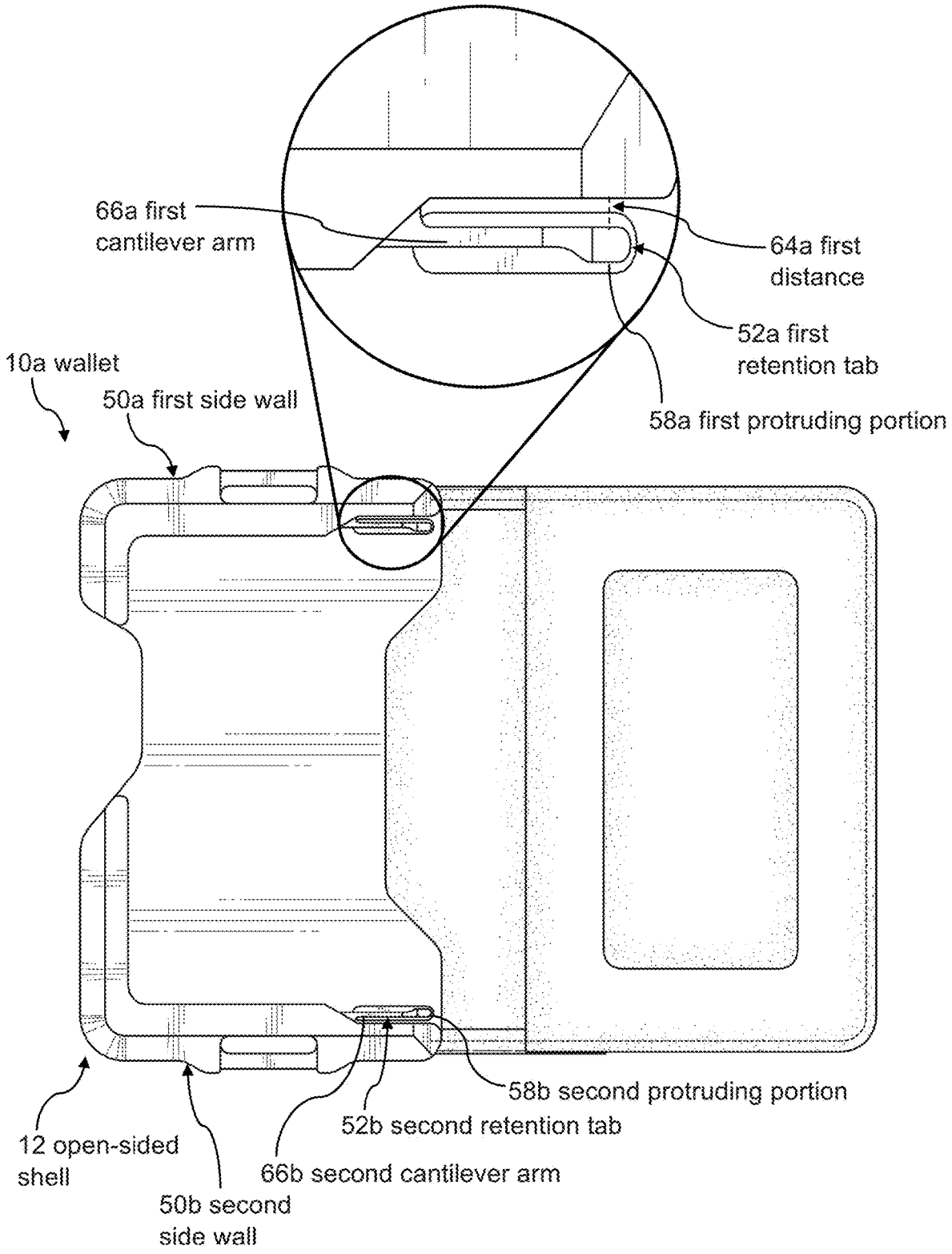
FIG. 11 illustrates a front interior view of a wallet, according to some embodiments.

FIG. 11 illustrates a front interior view of the wallet 10*a*, including an inset view of a first retention tab 52*a*. The inset view shows that, in many embodiments, the first retention tab 52*a* includes a first cantilever arm 66*a* as well as a first protruding portion 58*a*. The first protruding portion 58*a* may be configured to secure the at least one personal card 18 in place with respect to the personal card receiving surface 14. Similarly, in many embodiments, the second retention tab 52*b* comprises a second cantilever arm 66*b* and a second protruding portion 58*b* configured to secure the at least one personal card 18 in place with respect to the personal card receiving surface 14. As illustrated in the inset view of FIG. 11, the first cantilever arm 66*a* may be physically spaced a first distance 64*a* from a remaining portion of the first side wall 50*a*. Accordingly, the second cantilever arm 66*b* may also be physically spaced a first distance 64*a* from a remaining portion of the second side wall 50*b*. In many embodiments, the first and second retention tabs 52*a*, 52*b* are configured to move between a locked position 60, as shown in FIG. 13, and a receiving position 62, as shown in FIG. 12.

Figure 12:
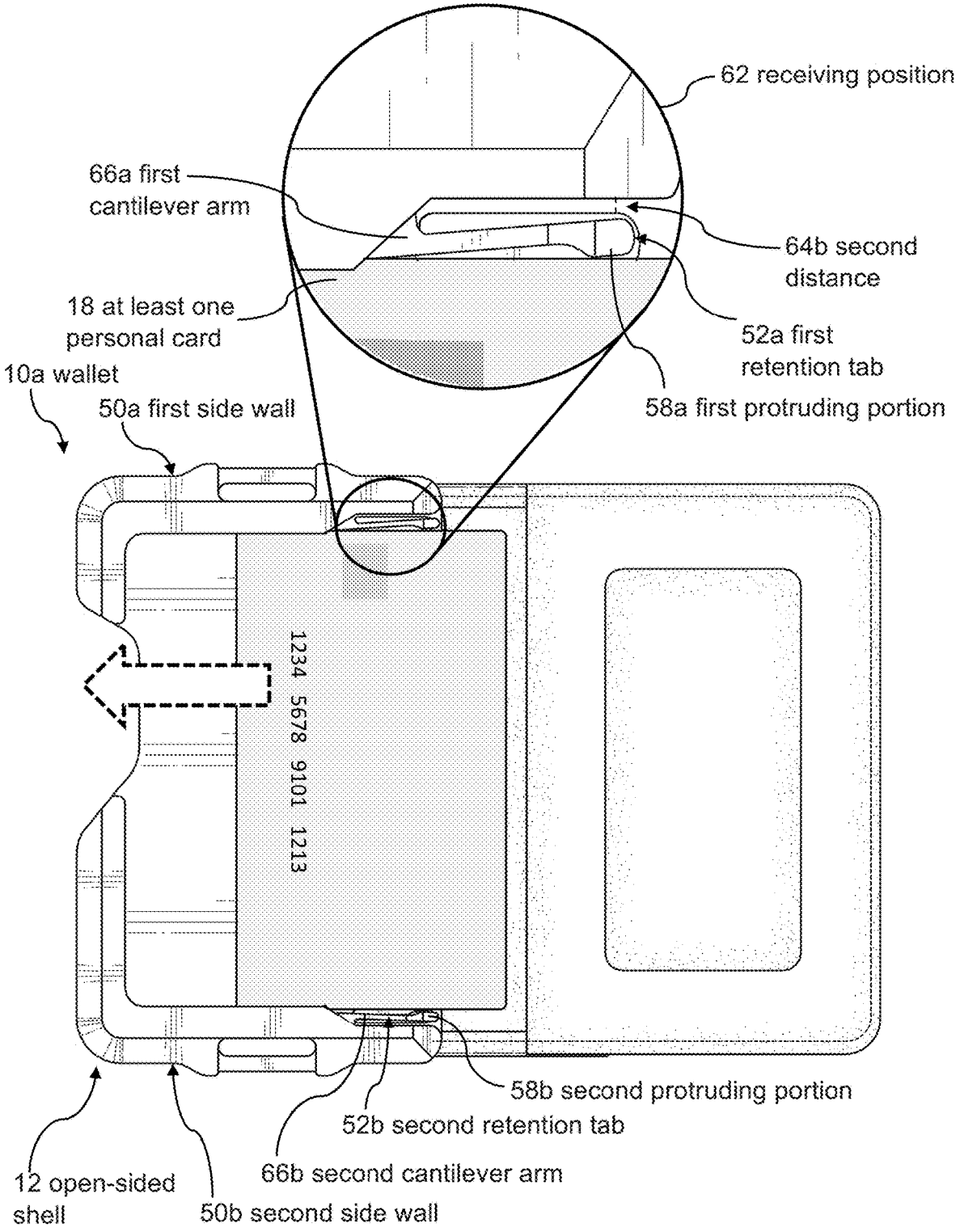
FIGS. 12, 13, 14, 15, 16, 17, and 18 illustrate front interior views of a wallet and at least one personal card, according to some embodiments.

FIG. 12 shows a view similar to FIG. 11, but includes the at least one personal card 18 being inserted into the open-sided shell 12, as indicated by the dashed block arrow. As such, FIG. 12 illustrates the first and second retention tabs 52*a*, 52*b* in the receiving position 62. The inset view of FIG. 12 illustrates that, in the receiving position 62, the first retention tab 52*a* moves toward the remaining portion of the first side wall 50*a*, reducing the size of the gap between the first retention tab 52*a* and the first side wall 50*a*. As shown, in the receiving position 62, the first retention tab 52*a* is spaced a second distance 64*b* from the first side wall 50*a*. Comparing FIG. 12 to FIG. 11 demonstrates that, in many embodiments, the second distance 64*b* is less than the first distance 64*a*, as the first retention tab 52*a* is closer to the first side wall 50*a* in the receiving position 62. In many embodiments, the same is true for the second retention tab 52*b*, as it moves toward the remaining portion of the second side wall 50*b* thereby reducing the size of the gap between the second retention tab 52*b* and the second side wall 50*b*. In the receiving position 62, the second retention tab 52*b* may be located substantially the same second distance 64*b* from the second side wall 50*b* as the second distance 64*b* between the first retention tab 52*a* and the first side wall 50*a*.

Figure 13:
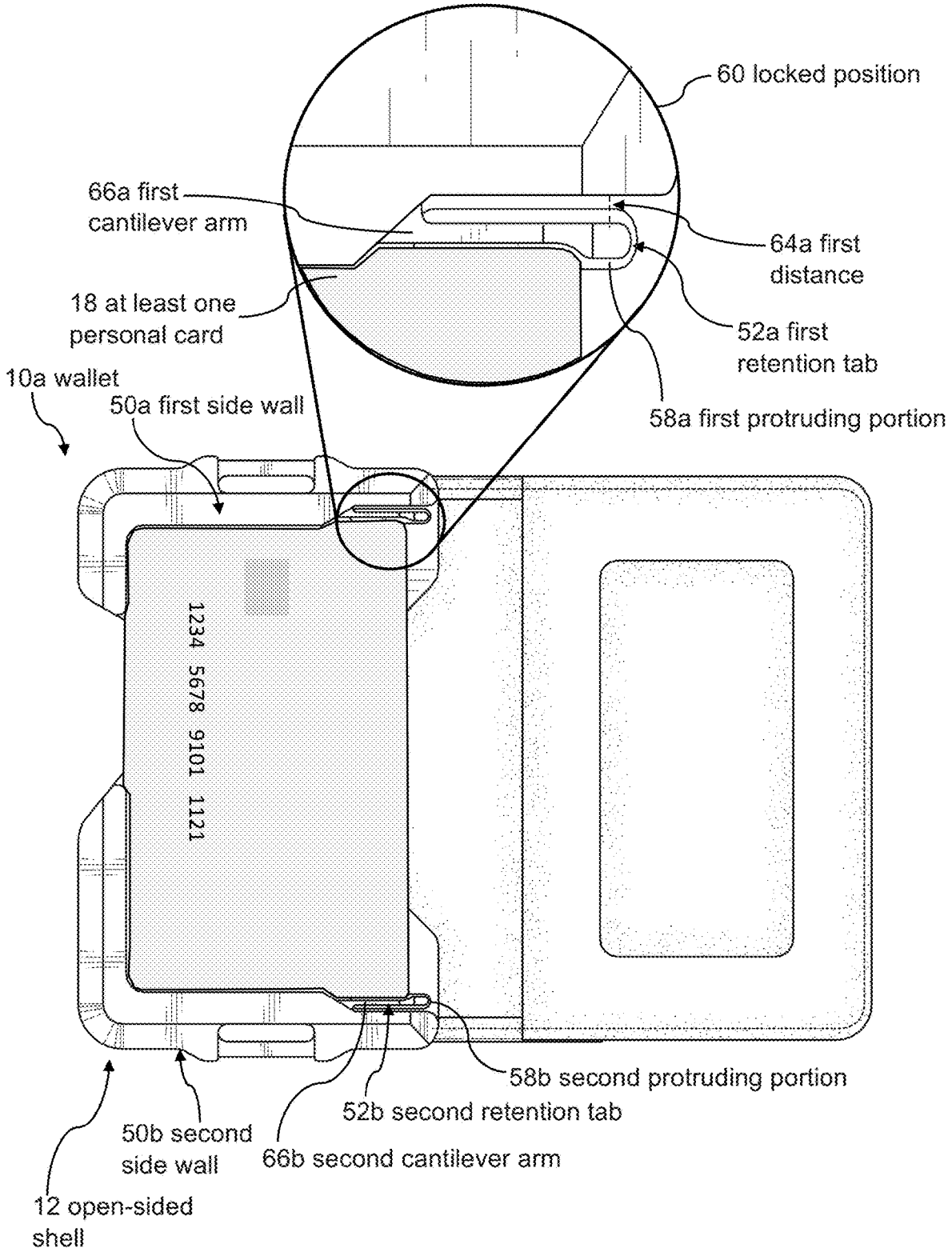

Speaking in terms of distance between the first retention tab 52*a* and the second retention tab 52*b*, in some embodiments, when the first retention tab 52*a* and the second retention tab 52*b* are in a locked position 60 (as shown in FIG. 13), the first retention tab 52*a* is located a first distance from the second retention tab 52*b*. When the first and second retention tabs 52*a*, 52*b* are in the receiving position 62 (as shown in FIG. 12), the first retention tab 52*a* may be located a second distance from the second retention tab 52*b*. In some embodiments, the second distance is greater than the first distance, as the retention tabs 52*a*, 52*b* move away from one another in order to receive the at least one personal card 18. Stated differently, when the open-sided shell 12 receives the at least one personal card 18, the first retention tab 52*a* may be configured to move away from the second side wall 50*b* and the first retention tab 52*b* may be configured to move away from the first side wall 50*a*.

FIG. 13 shows the wallet 10*a* coupled to the at least one personal card 18 in the locked position 60. As indicated by the inset view, in the locked position 60, the first retention tab 52*a* may be configured to move away from the remaining portion of the first side wall 50*a* such that the first retention tab 52*a* returns to the first distance 64*a* from the first side wall 50*a*, as shown in FIG. 11. Accordingly, the first and second retention tabs 52*a*, 52*b* may be configured to reside in the same position when there is no personal card coupled to the wallet 10*a*, as shown in FIG. 11, and when there is at least one personal card 18 securably coupled to the wallet 10*a*, as shown in FIG. 13. In some embodiments, the difference between the first distance 64*a* and second distance 64*b* is about a few millimeters. The first and second retention tabs 52*a*, 52*b* may be configured to flex only as much as needed to receive and/or release the at least one personal card 18. As shown in the inset view, when the at least one personal card 18 is coupled to the wallet 10*a* and the first retention tab 52*a* is in the locked position 60, a corner of the at least one personal card 18 may be configured to fit adjacent the retention tab 52*a* between the first protruding portion 58*a* and the first cantilever arm 66*a*. The corner of the at least one personal card 18 may be configured to fit just below the first protruding portion 58*a*. In many embodiments, the same is true for the second retention tab 52*b*.

Figure 14:
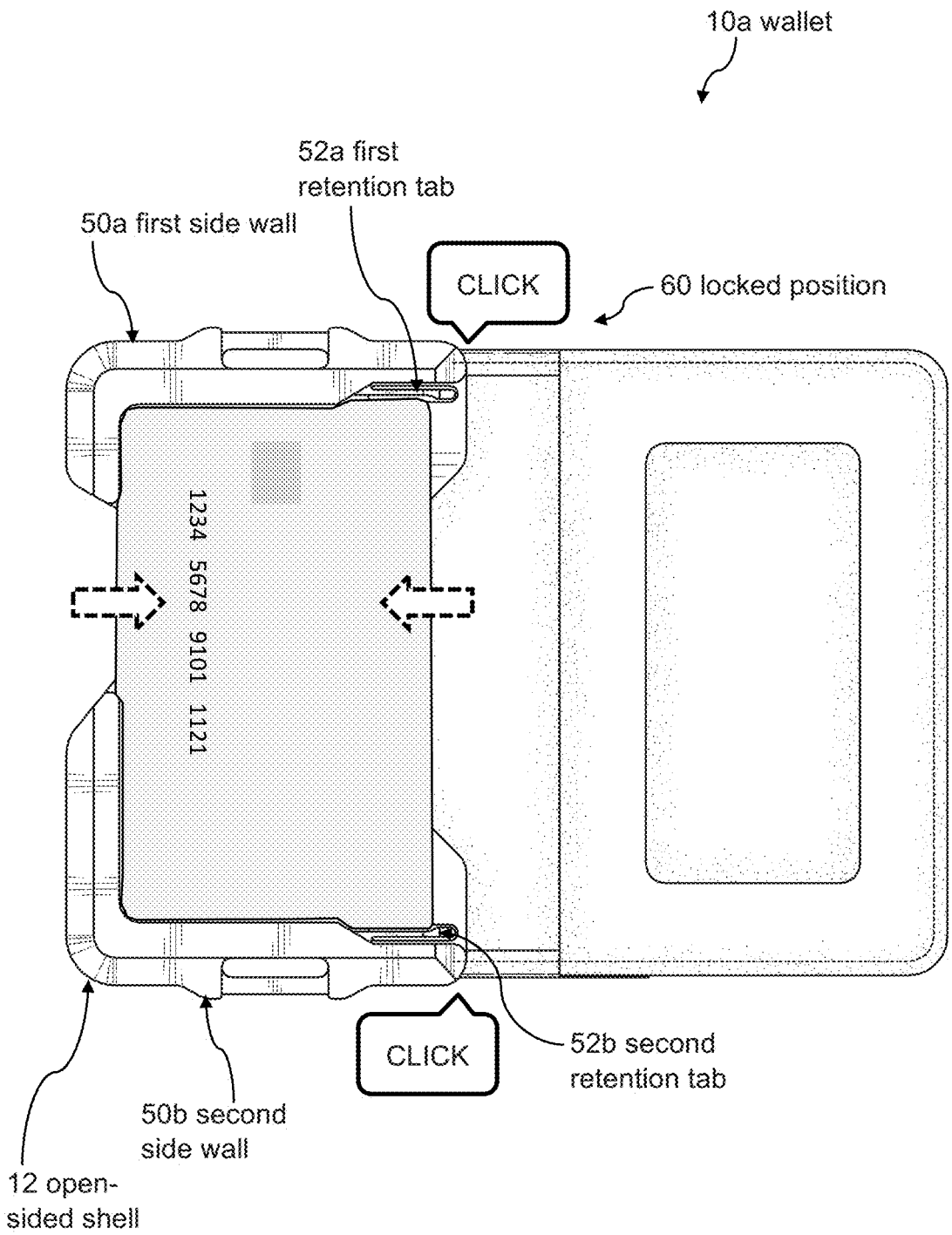

FIG. 14 also shows the wallet 10*a* coupled to the at least one personal card 18 in the locked position 60. In some embodiments, when the open-sided shell 12 securably couples the at least one personal card 18 within an internal portion 20 of the shell 12, the first retention tab 52*a* moves towards the second side wall 50*b* and the second retention tab 52*b* moves towards the first side wall 50*a*. Securably coupling the at least one personal card 18 within the open-sided shell 12 may result in an audible sound, as indicated by each of the "CLICK" word bubbles in FIG. 14. In some embodiments, the audible sound is caused by the first and second retention tabs 52*a*, 52*b* moving back toward one another to their original position, or the position shown in FIGS. 11 and 13. The audible noise may also be caused by the at least one personal card 18 contacting a bottom side wall 50*c* of the open-sided shell 12. The audible noise may be caused by a combination of sources, and the volume of the noise may vary depending on the number of personal cards coupled to the open-sided shell 12.

Figure 15:
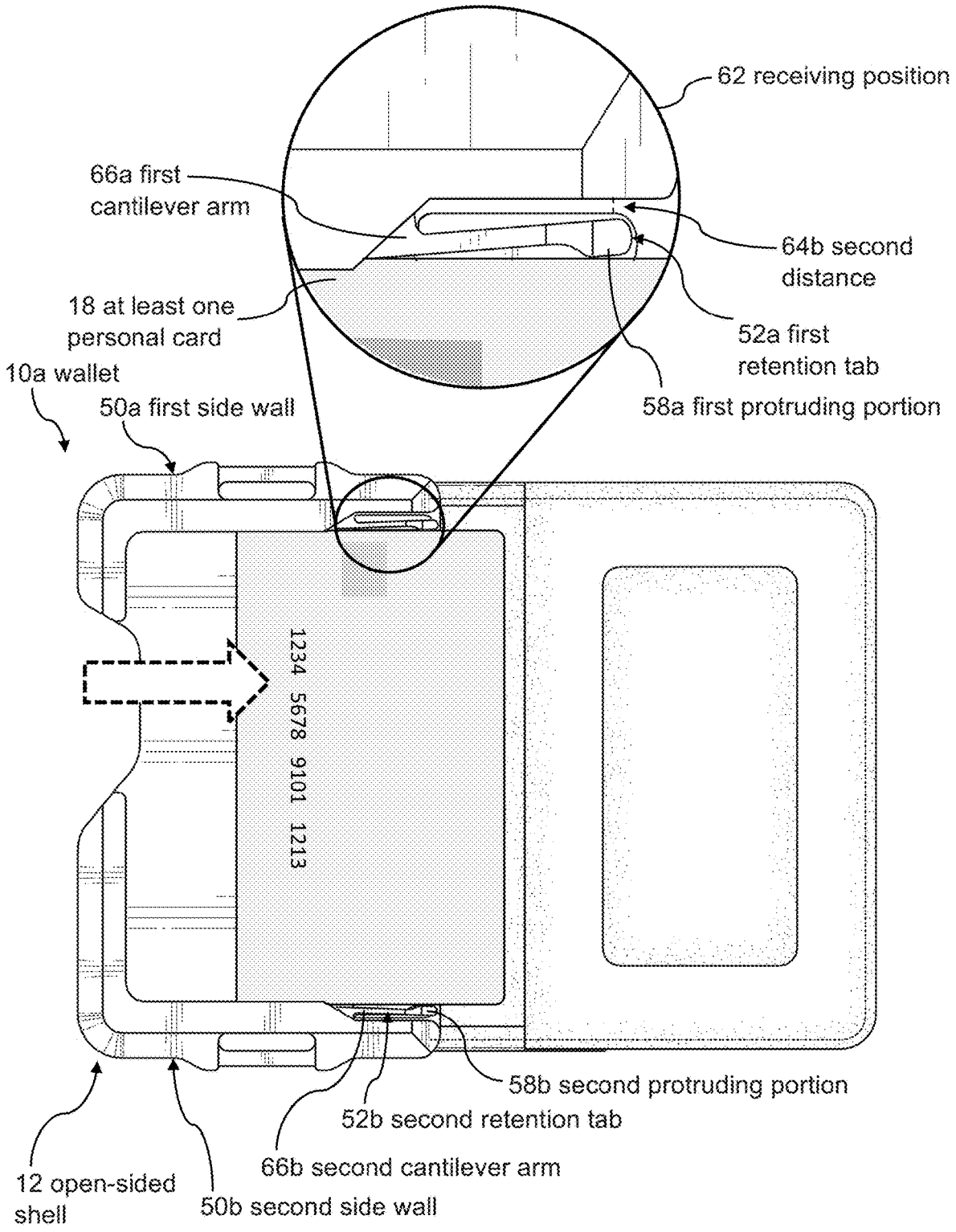

FIG. 15 is similar to FIG. 12, but rather than illustrating the at least one personal card 18 being inserted into the open-sided shell 12, FIG. 15 shows the at least one personal card 18 being removed from the open-sided shell 12, as indicated by the dashed block arrow. In many embodiments, the at least one personal card 18 is removed by pushing the card 18 from an open area in the bottom side wall 50*c*, which will be discussed in greater detail later in the disclosure. The inset view of FIG. 15 shows that the first retention tab 52*a* (and second retention tab 52*b*) assume the receiving position 62 during removal of the at least one personal card 18. Accordingly, during removal of the at least one personal card 18, the first retention tab 52*a* and second retention tab 52*b* move toward the first and second side walls 50*a*, 50*b*, respectively, thereby reducing the gap between each retention tab 52*a*, 52*b* and each side wall 50*a*, 50*b*. As with insertion of the at least one personal card 18, the gap between each retention tab 52*a*, 52*b* and each respective side wall 50*a*, 50*b* may comprise the second distance 64*b*. In some embodiments, the open-sided shell 12 creates an audible noise upon complete removal of the at least one personal card 18.

It should be noted that FIGS. 12-15 illustrate a method of inserting and removing at least one personal card 18 where, in many embodiments, the at least one personal card 18 is contacting the protruding portions 58*a*, 58*b* substantially the entire time until the at least one personal card 18 is securably coupled or completely removed. These Figures illustrate only one way to insert and/or remove the at least one personal card 18, which may be thought of as a "straight-on" insertion/removal. During the "straight-on" insertion/removal, the at least one personal card 18 may remain substantially parallel to the personal card receiving surface 14.

Figure 16:
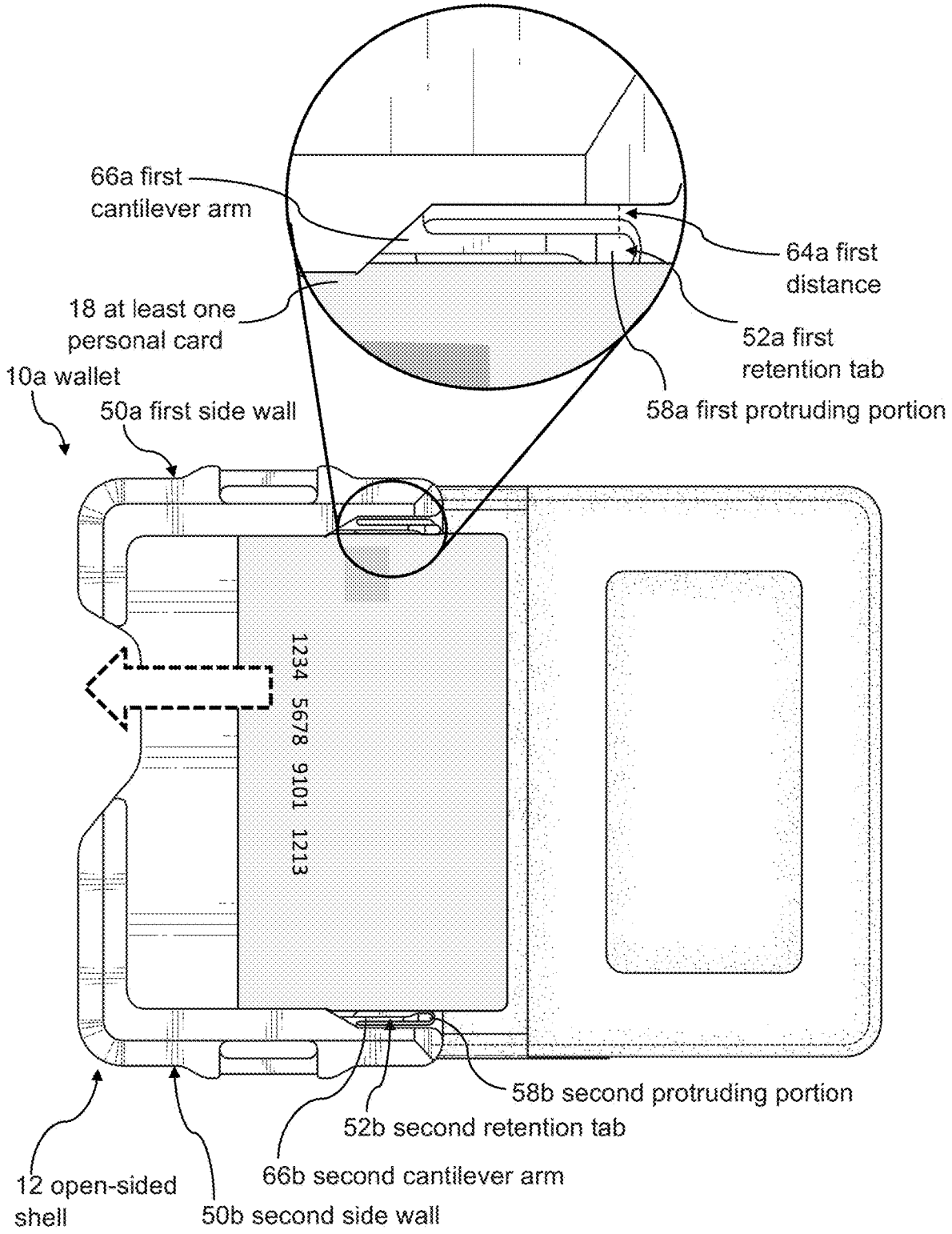
Figure 17:
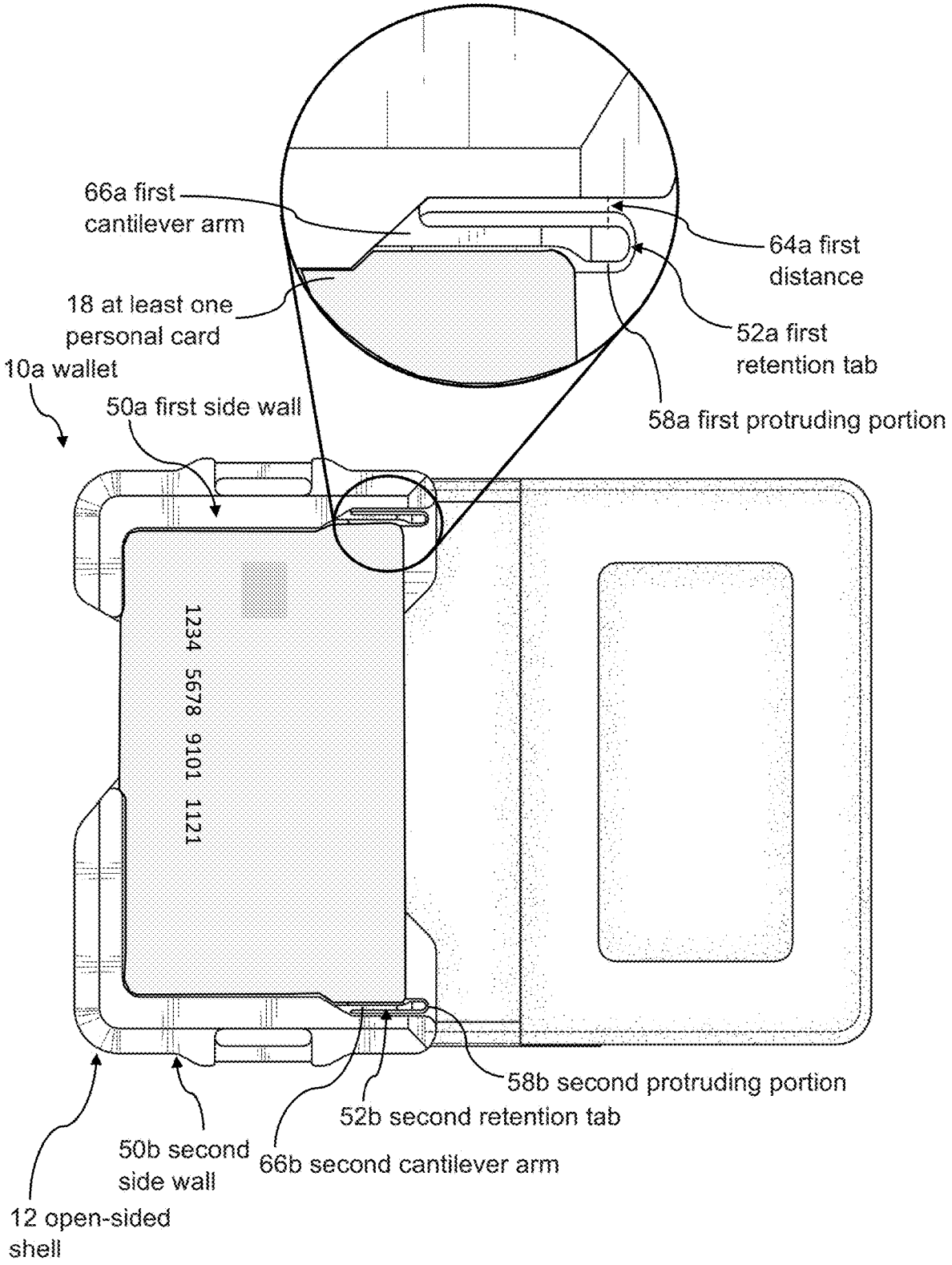
Figure 18:
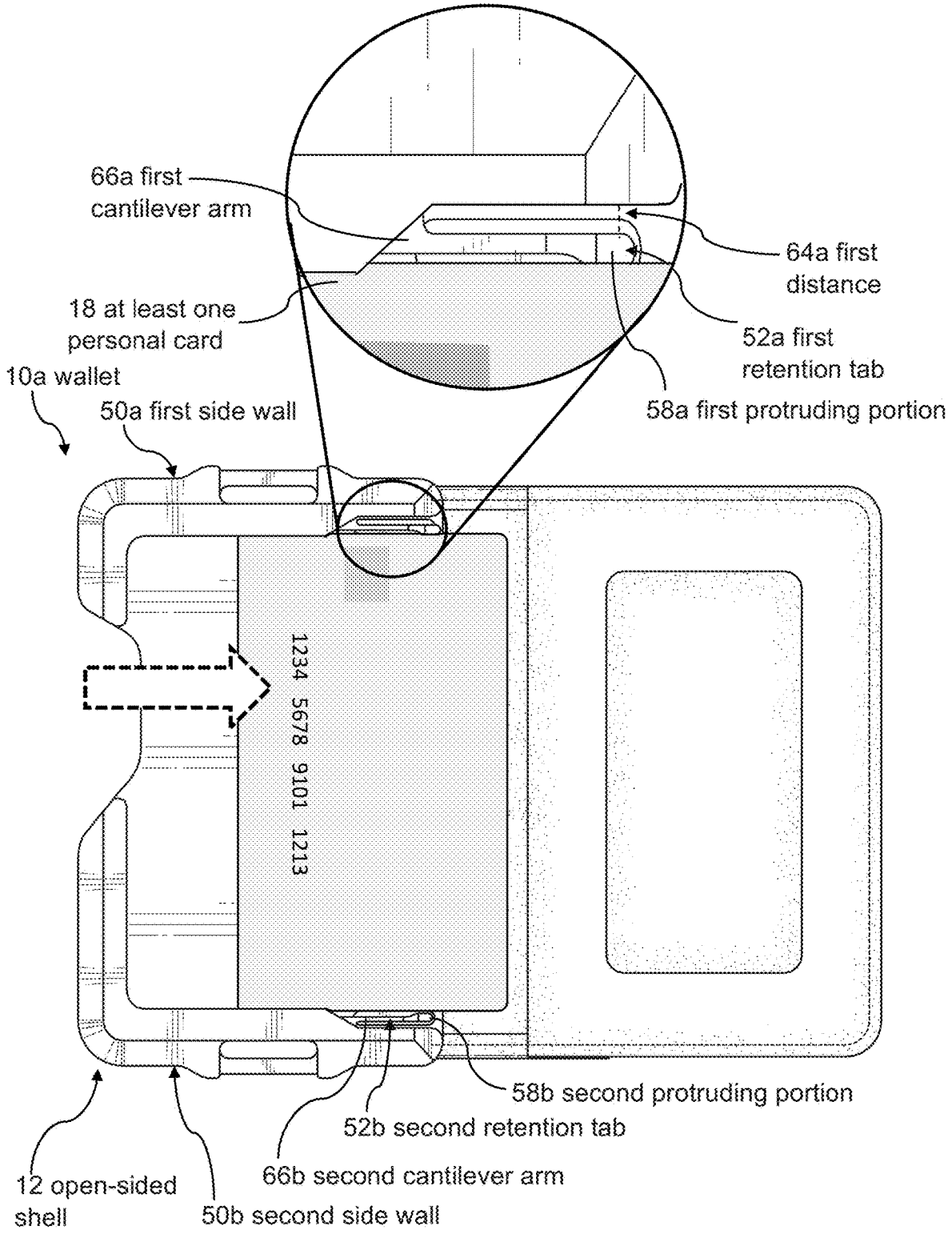

In contrast, FIGS. 16-18 illustrate a different method of inserting and removing at least one personal card 18. Beginning with FIG. 16, the at least one personal card 18 is shown being inserted into the open-sided shell 12. The inset view demonstrates that the first retention tab 52*a* may be configured to not move during insertion of the at least one personal card 18, as the card 18 enters the open-sided shell 12 at an angle over the retention tabs 52*a*, 52*b*, rather than next to the retention tabs 52*a*, 52*b*, as previously described. Depending on the number of personal cards 18 already coupled to the open-sided shell 12, it may be possible that the at least one personal card 18 does not contact either the first or second retention tab 52*a*, 52*b* during insertion and/or removal (shown in FIG. 18) using the "angled" method. In some embodiments, when the at least one personal card 18 is inserted into and/or removed from the open-sided shell 12 using the "angled" method, the at least one personal card 18 may form an angle of up to about 45 degrees with the personal card receiving surface 14. The at least one personal card 18 may form an angle of greater than 45 degrees with the personal card receiving surface 14.

The inset views of FIGS. 16, 17, and 18 further illustrate the static nature of the first retention tab 52*a*, by showing that during insertion of the at least one personal card 18 (FIG. 16), secured coupling of the at least one personal card 18 (FIG. 17), and removal of the at least one personal card 18 (FIG. 18), the first retention tab 52*a* remains at a location a first distance 64*a* from the remaining portion of the first side wall 50*a*. In many embodiments, the second retention tab 52*b* is also static throughout insertion, coupling, and removal of the at least one personal card 18. FIG. 17 also shows that, as illustrated in FIG. 13, the at least one personal card 18 may be configured to fit adjacent the first cantilever arm 66*a* with a corner of the card 18 located just below the first protruding portion 58*a*. In many embodiments, the fit is in the same on the opposite edge of the card 18 adjacent the second cantilever arm 66*b* and second protruding portion 58*b*.

Figure 19:
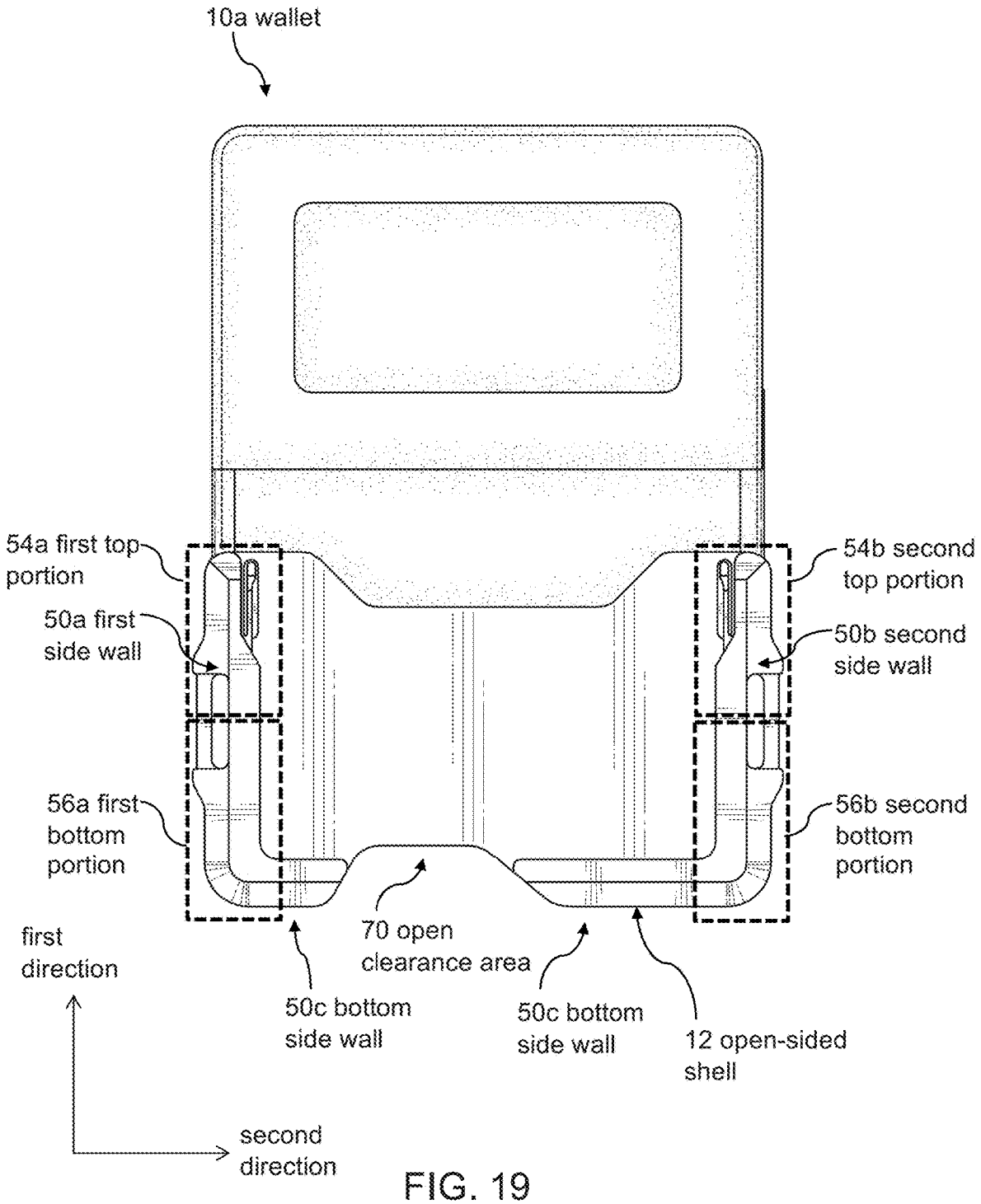
FIG. 19 illustrates a front interior view of a wallet including a first side wall and a second side wall, according to some embodiments.

Turning now to FIG. 19, a front interior view of the wallet 10*a* is shown. FIG. 19 illustrates the first side wall 50*a*, the second side wall 50*b*, and the bottom side wall 50*c* of the open-sided shell 12. In many embodiments, the first side wall 50*a* includes a first top portion 54*a* and a first bottom portion 56*a*. Similarly, the second side wall 50*b* may include a second top portion 54*b* and a second bottom portion 56*b*. In many embodiments, the first and second retention tabs 52*a*, 52*b* are located adjacent the first and second top portions 54*a*, 54*b*, respectively. The first and second bottom portions 56*a*, 56*b* may be configured to couple to the bottom side wall 50*c*. Though illustrated in FIG. 19 as dissecting the first and second apertures 94*a*, 94*b*, it should be noted that the top and bottom portions 54, 56 may be larger or smaller than represented in FIG. 19. For example, in some embodiments, the first and second top portions 54*a*, 54*b* include the portions of the first and second side walls 50*a*, 50*b* located above the apertures 94*a*, 94*b*, while the first and second bottom portions 56*a*, 56*b* include the portions of the first and second side walls 50*a*, 50*b* extending from the top of each aperture 94*a*, 94*b* to the bottom side wall 50*c*. The first and second top portions 54*a*, 54*b* may include the entire aperture 94*a*, 94*b*, while the first and second bottom portions 56*a*, 56*b* extend from below the apertures 94*a*, 94*b* to the bottom side wall 50*c*.

FIG. 19 also includes a directional indicator, comprising a first direction and a second direction perpendicular to the first direction. In many embodiments, the first side wall 50*a* and the second side wall 50*b* are elongate along the first direction, and the bottom side wall 50*c* is elongate along the second direction. Though not shown in FIG. 19, the elastic band 32 may be configured to extend across the top half 30 and/or bottom half 28 of the wallet 10*a* along the second direction, as illustrated in previous Figures.

Figure 20:
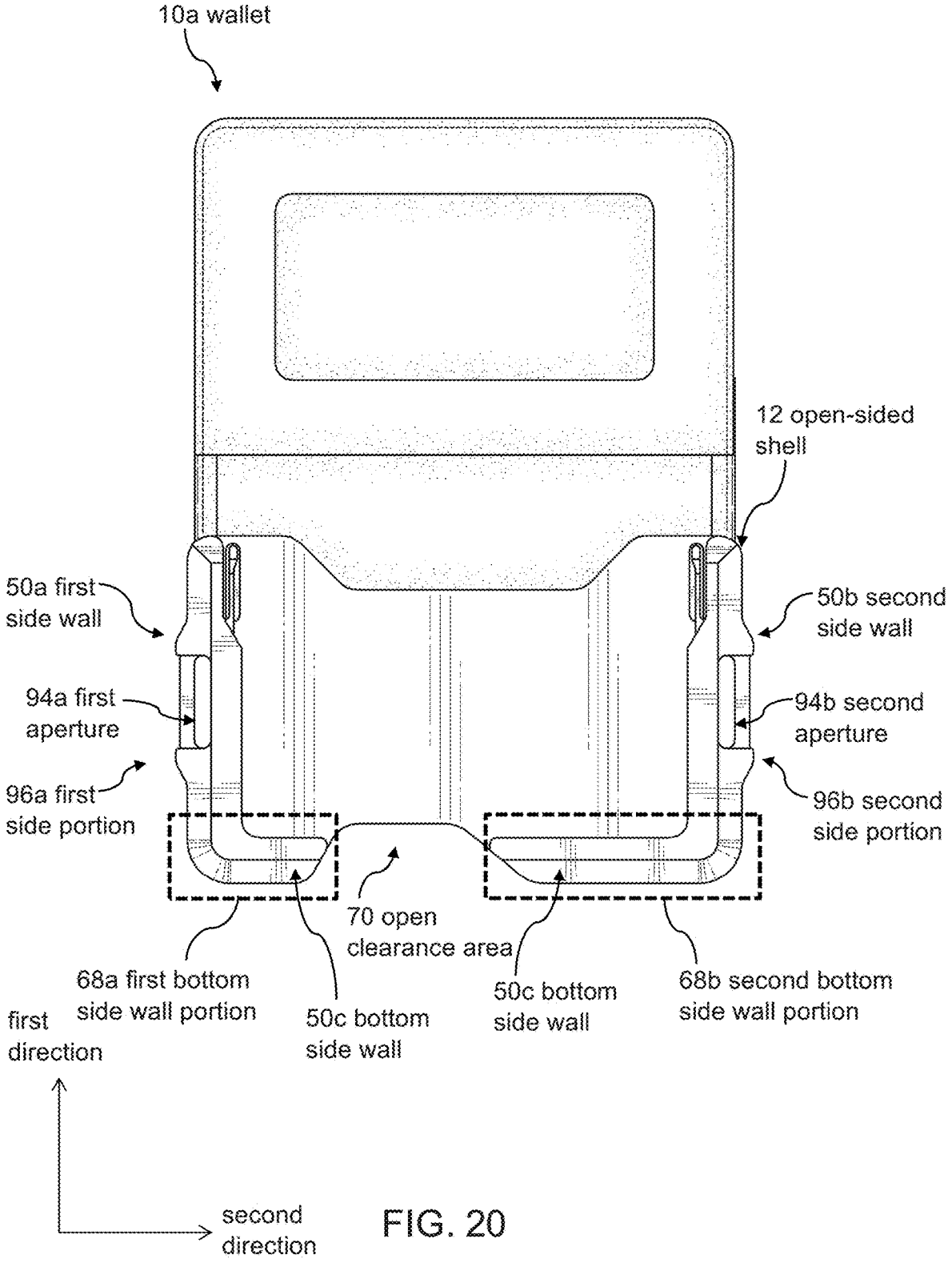
FIG. 20 illustrates a front interior view of a wallet including a bottom side wall, according to some embodiments.

Similar to FIG. 19, FIG. 20 includes more elements of the bottom side wall 50*c*. In many embodiments, the bottom side wall 50*c* comprises a first bottom side wall portion 68*a* and a second bottom side wall portion 68*b*, as well as an open clearance area 70 located between the two portions 68*a*, 68*b*. The open clearance area 70 may be configured to receive a user's finger so that the user may thereby push the at least one personal card 18 away from the bottom side wall 50*c*, and remove the card 18 from the wallet 10*a*. As shown in FIG. 20, in some embodiments, the second bottom side wall portion 68*b* is wider than the first bottom side wall portion 68*a*. The first bottom side wall portion 68*a* may be wider than the second bottom side wall portion 68*b*. In some embodiments, the first and second bottom side wall portions 68*a*, 68*b* are substantially the same width. The first and second bottom side wall portions 68*a*, 68*b* may be substantially the same height.

Figure 21:
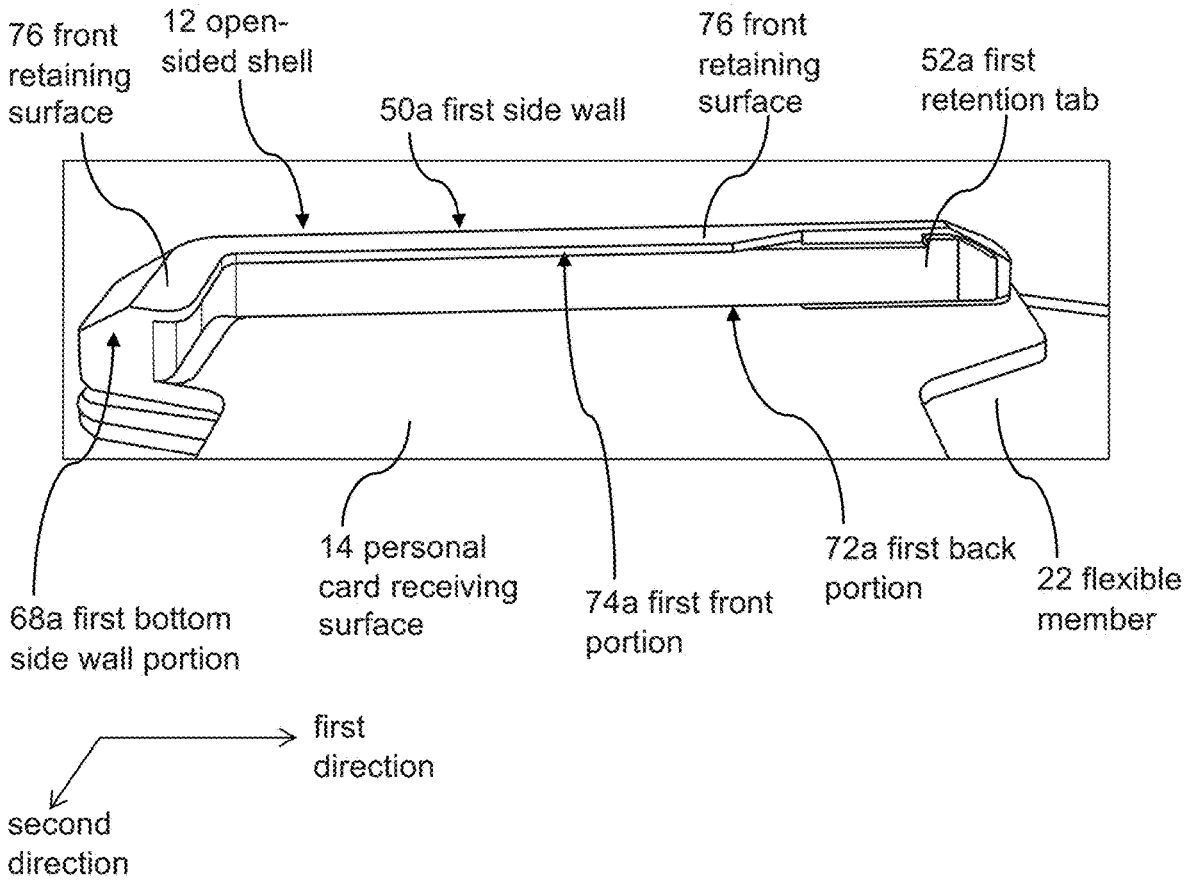
FIG. 21 illustrates a cross-sectional view of a first side wall of a wallet, according to some embodiments.

FIG. 21 shows a cross-sectional view of part of the open-sided shell 12, including the first side wall 50*a* and the first bottom side wall portion 68*a*. In many embodiments, the first side wall 50*a* defines a first back portion 72*a* located adjacent the personal card receiving surface 14 and a first front portion 74*a* located opposite the first back portion 72*a*, as illustrated in FIG. 21. The first front portion 74*a* and first back portion 72*a* may be considered to border a channel, or first interior portion, in the first side wall 50, wherein the at least one personal card 18 is received by the channel/first interior portion. Stated differently, when the at least one personal card 18 is coupled to the open-sided shell 12, an edge of the card 18 may be located between the first back portion 72*a* and the first front portion 74*a*, facing the first interior portion, and kept in place (e.g., prevented from falling out of the wallet 10*a*) by the first front portion 74*a*. In many embodiments, the open-sided shell 12 also includes a front retaining surface 76 that protrudes along the second direction from the first front portion 74*a* of the first side wall 50*a*. The front retaining surface 76 may also extend around at least a portion of a perimeter of the personal card receiving surface 14, as illustrated in FIGS. 21, 22, and 23.

In some embodiments, the open-sided shell 12 comprises a beveled surface. Looking back to FIG. 20, the beveled surface of the open-sided shell 12 may comprise the portion of the open-sided shell 12 including the first and second apertures 94*a*, 94*b*. The beveled surface may extend from the front retaining surface 76 to a side surface of the open-sided shell 12 located adjacent the flexible member 22. In many embodiments, the front retaining surface 76 comprises the top, flat face of the open-sided shell 12 between the beveled surface and the internal portion 20 of the open-sided shell 12 (shown in FIG. 24). The first front portion 74*a* (and second and third front portions 74*b*, 74*c*) may be considered an inner edge of the front retaining surface 76 located opposite an edge of the front retaining surface 76 adjacent the beveled surface of the open-sided shell 12. The use of "flat" when describing the front retaining surface 76 is intended to convey that, in many embodiments, the front retaining surface 76 is parallel to the personal card receiving surface 14. It should also be noted that the front retaining surface 76 may be the portion of the open-sided shell 12 that contacts the internal surface 24 of the top half 30 of the wallet 10*a* when the wallet 10*a* is in the clamshell position 48 and/or closed position 46, as discussed with reference to FIGS. 9 and 10.

Figure 22:
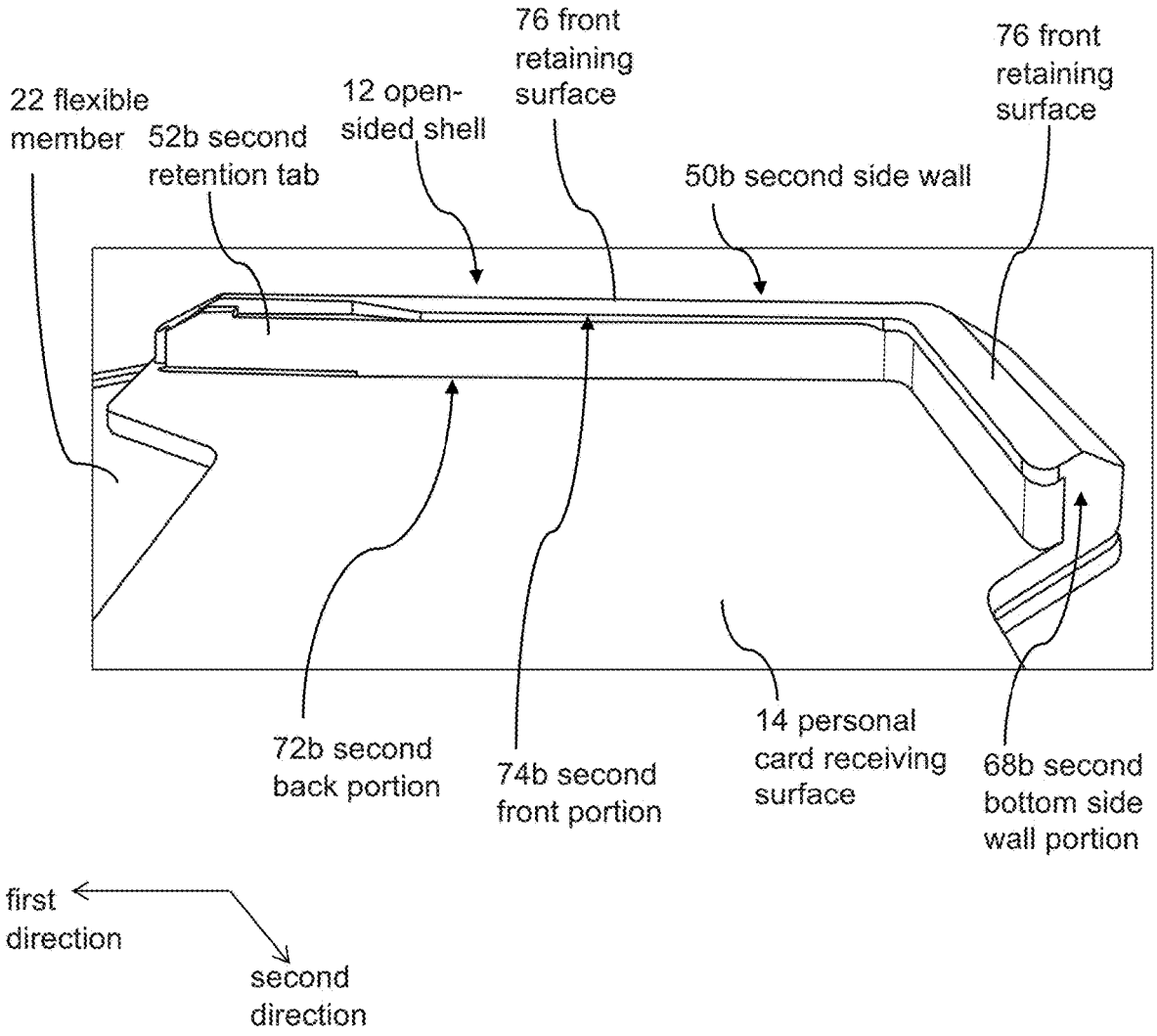
FIG. 22 illustrates a cross-sectional view of a second side wall of a wallet, according to some embodiments.

Similar to the first side wall 50*a*, FIG. 22 illustrates that, in many embodiments, the second side wall 50*b* defines a second back portion 72*b* located adjacent the personal card receiving surface 14 and a second front portion 74*b* located opposite the second back portion 72*b*. As discussed with reference to FIG. 21, the second front portion 74*b* and the second back portion 72*b* may be considered to border a channel, or second interior portion, in the second side wall 50*b* configured to receive the at least one personal card 18 such that an edge of the at least one personal card 18 faces the second interior portion. The front retaining surface 76 may extend along the second direction from the second front portion 74*b* of the second side wall 50*b*.

Figure 23:
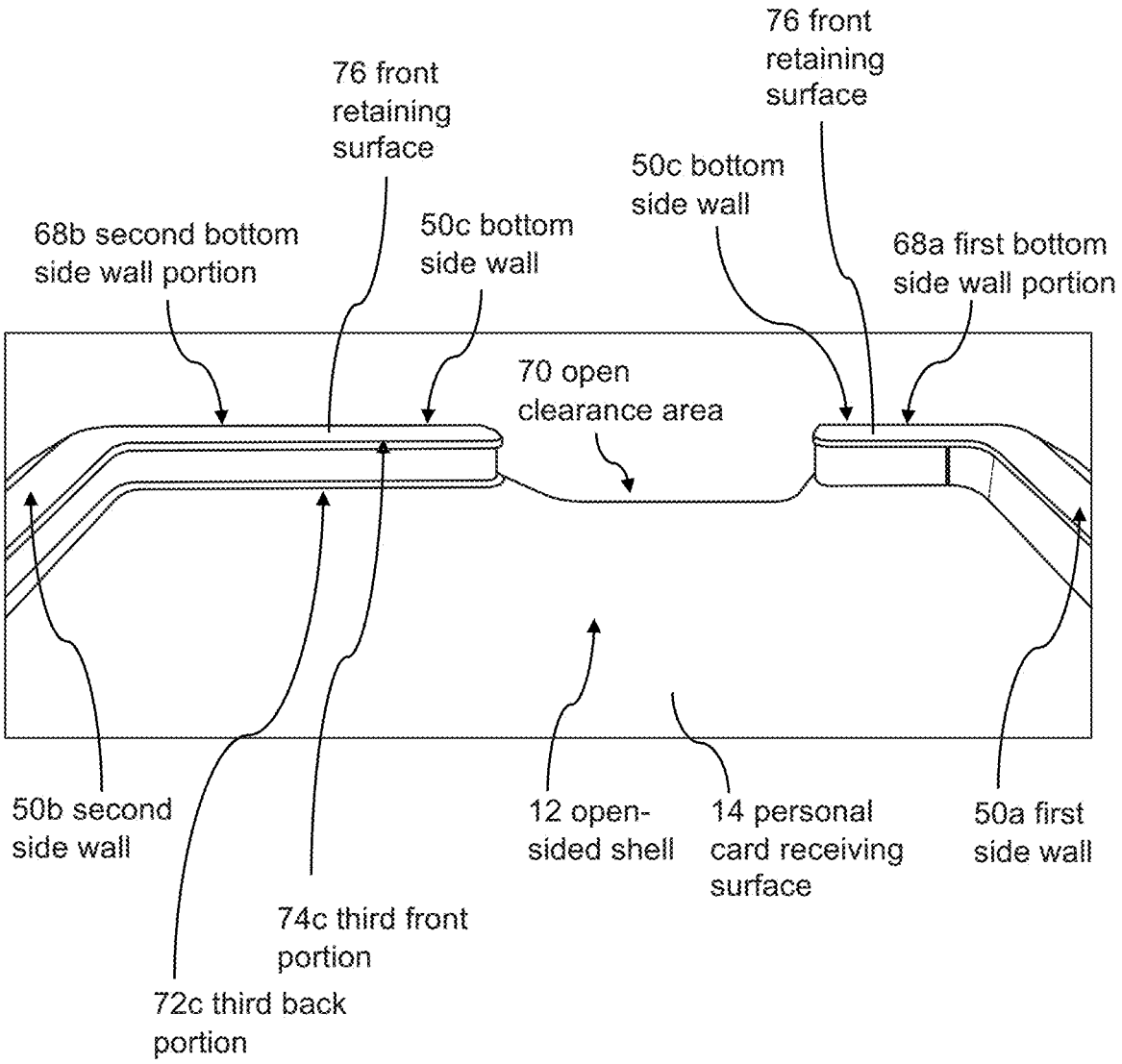
FIG. 23 illustrates a cross-sectional view of a bottom side wall of a wallet, according to some embodiments.

FIG. 23 is similar to FIGS. 21 and 22 and shows a cross-sectional view of the wallet 10*a* including the bottom side wall 50*c*. In many embodiments, the bottom side wall 50*c* defines a third back portion 72*c* located adjacent the personal card receiving surface and a third front portion 74*c* located opposite the third back portion 72*c*. It should be noted that the third front and back portions 74*c*, 72*c* may be located on both the second bottom side wall portion 68*b*, as shown in FIG. 23, as well as the first bottom side wall portion 68*a*. In some embodiments, the front retaining surface 76 protrudes along the first direction from the third front portion 74*c* of the bottom side wall 50*c*. Similar to the channel created by the space between the first back portion 72*a* and first front portion 74*a*, as well as between the second back portion 72*b* and the second front portion 74*b*, the space between the third back portion 72*c* and the third front portion 74*c* may create a channel, or bottom interior portion, configured to receive an edge of the at least one personal card 18 such that when the at least one personal card 18 couples to the open-sided shell 12, a bottom edge is configured to face the bottom interior portion. FIG. 23 also shows the open clearance area 70, and further illustrates how the open clearance area 70 provides access to the at least one personal card 18 coupled to the open-sided shell 12.

Figure 24:
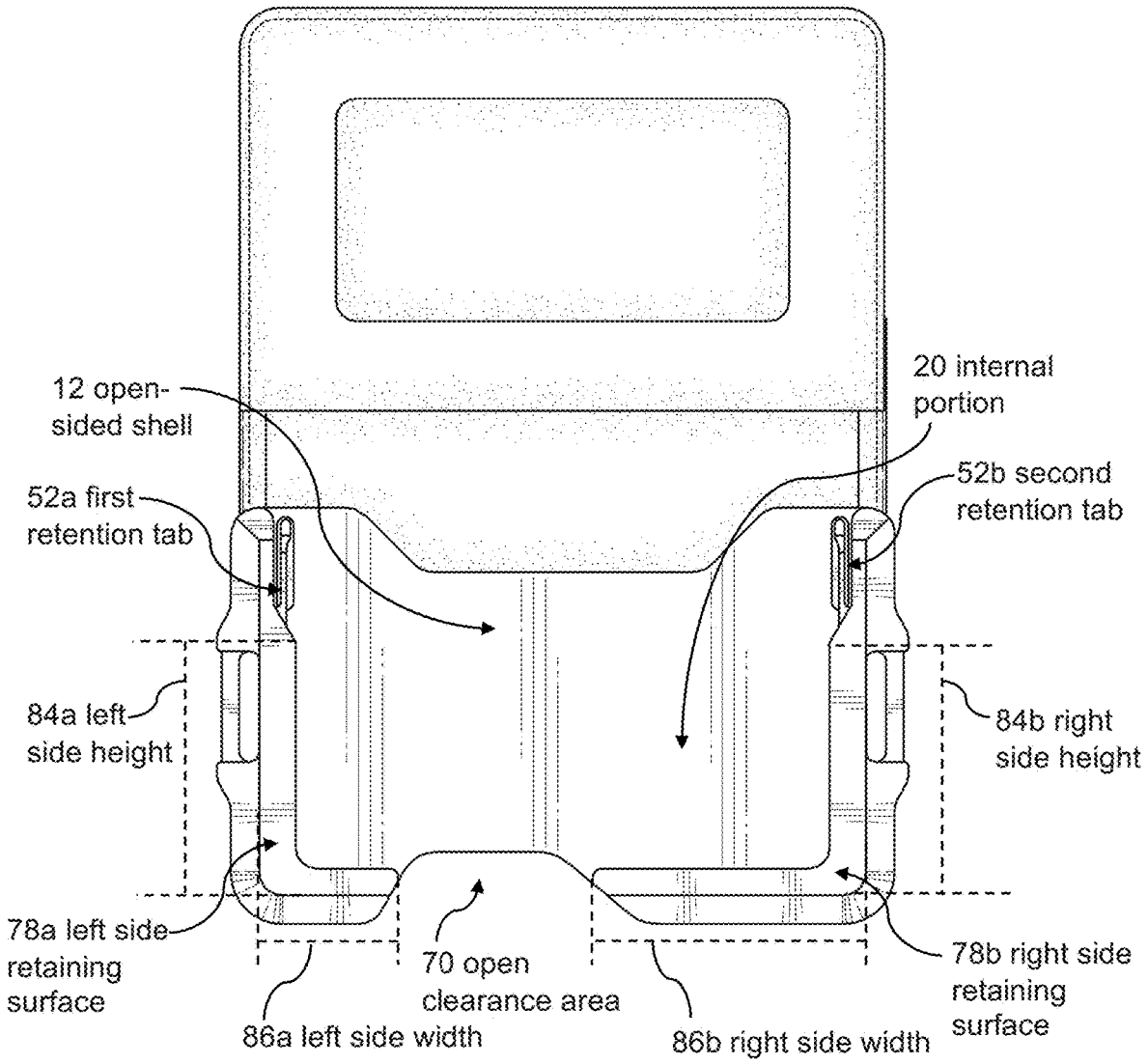
FIG. 24 illustrates a front interior view of a wallet, according to some embodiments.
Figure 25A:
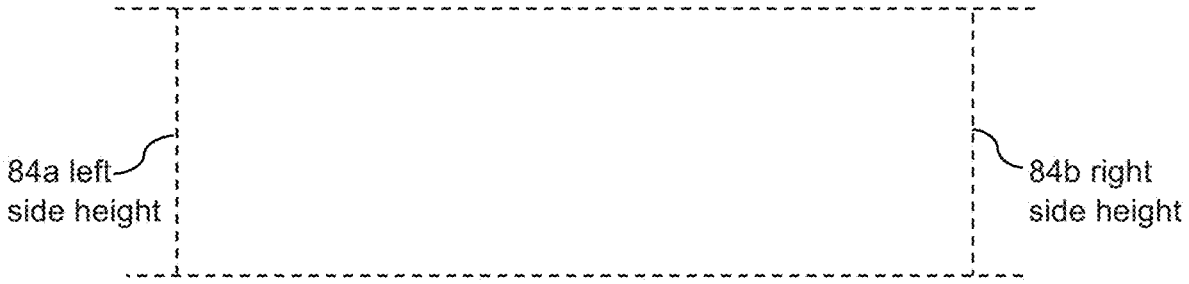
FIG. 25A illustrates a left side height and a right side height of a wallet, according to some embodiments.
Figure 25B:
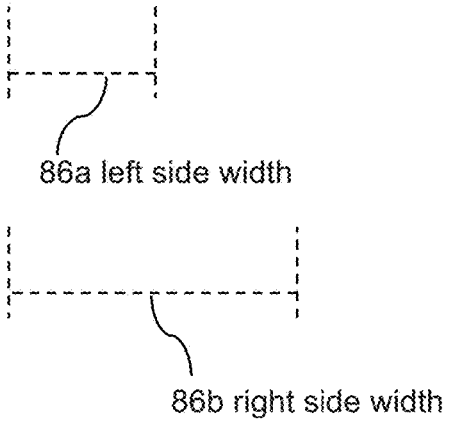
FIG. 25B illustrates a left side width and a right side width of a wallet, according to some embodiments.

In some embodiments, the front retaining surface 76 comprises a left side retaining surface 78*a* and a right side retaining surface 78*b*, as illustrated in FIG. 24. The left side retaining surface 78*a* may define a left side height 84*a* and a left side width 86*a*, and the right side retaining surface 78*b* may define a right side height 84*b* and a right side width 86*b*. In many embodiments, as shown in FIG. 25A, the left side height 84*a* and right side height 84*b* are substantially equal. FIG. 25B shows that, in some embodiments, the left side width 86*a* is less than the right side width 86*b*. The left side width 86*a* may be greater than the right side width 86*b*. In some embodiments, the left side width 86*a* and right side width 86*b* are substantially equal, and the open clearance area 70 is centered along the bottom side wall 50*c*.

Figure 26:
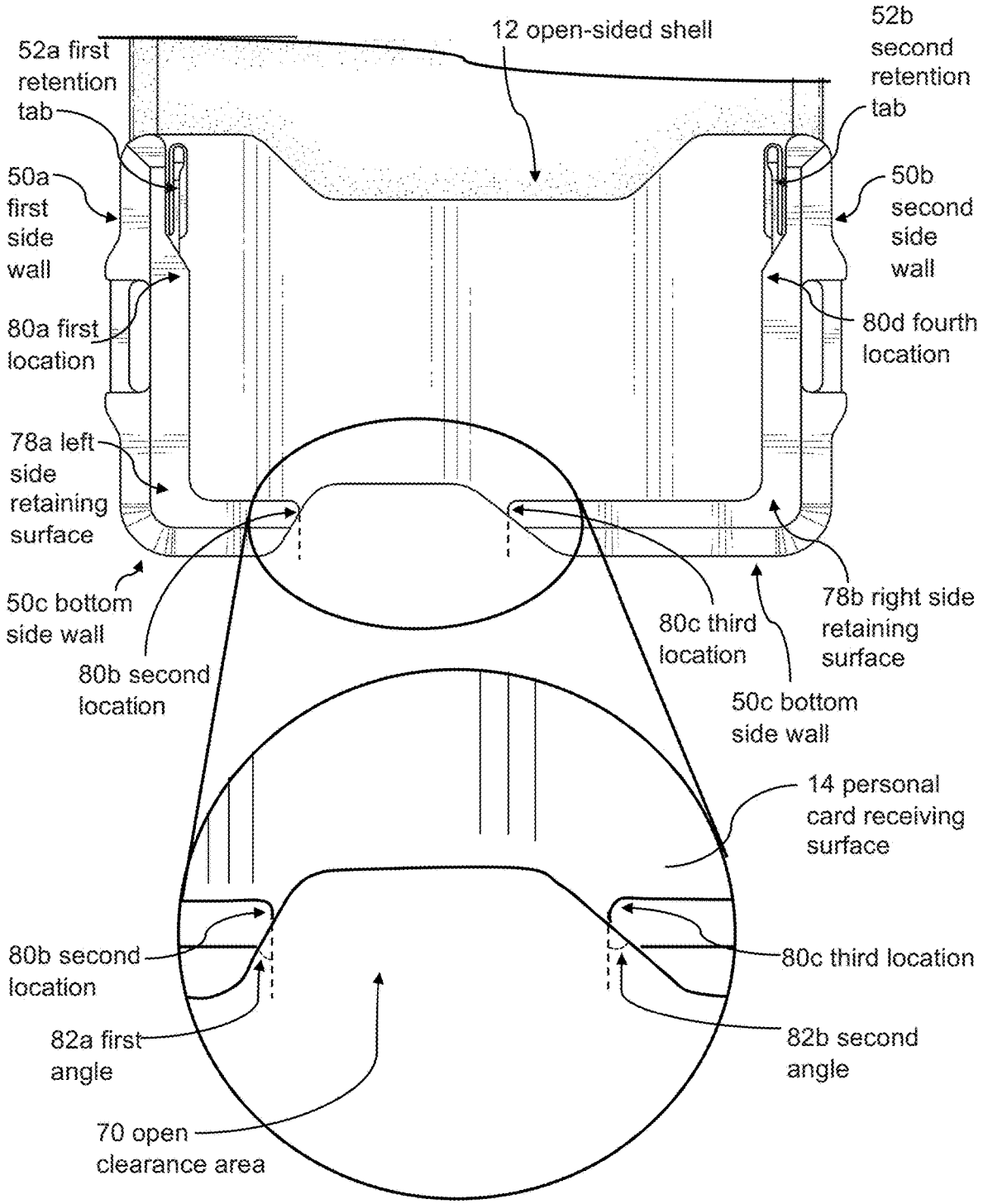
FIG. 26 illustrates a partial front view of a wallet, including an inset view of an open clearance area, according to some embodiments.

Referring now to FIG. 26, the open-sided shell 12 with an inset view of the open clearance area 70 is shown. In many embodiments, as illustrated in FIG. 26, the left side retaining surface 78*a* extends from a first location 80*a* located below the first retention tab 52*a* down along the first side wall 50*a* and along the bottom side wall 50*c* to a second location 80*b* adjacent the open clearance area 70. The right side retaining surface 78*b* may extend from a third location 80*c* adjacent the open clearance area 70 along the bottom side wall 50*c* and up along the second side wall 50*b* to a fourth location 80*d* located below the second retention tab 52*b*. The inset view of FIG. 26 shows the open clearance area 70 with the second location 80*b* on the left and the third location 80*c* on the right. As indicated by the inset view, in some embodiments, the second location 80*b* of the left side retaining surface 78*a* defines a first angle 82*a*, and the third location 80*c* of the right side retaining surface 78*b* defines a second angle 82*b*. The second angle 82*b* may be greater than the first angle 82*a*, as shown in FIG. 26. In some embodiments, the first angle 82*a* is greater than the second angle 82*b*. The first angle 82*a* and second angle 82*b* may be substantially equal, and the open clearance area 70 may define a symmetrical shape.

Figure 27:
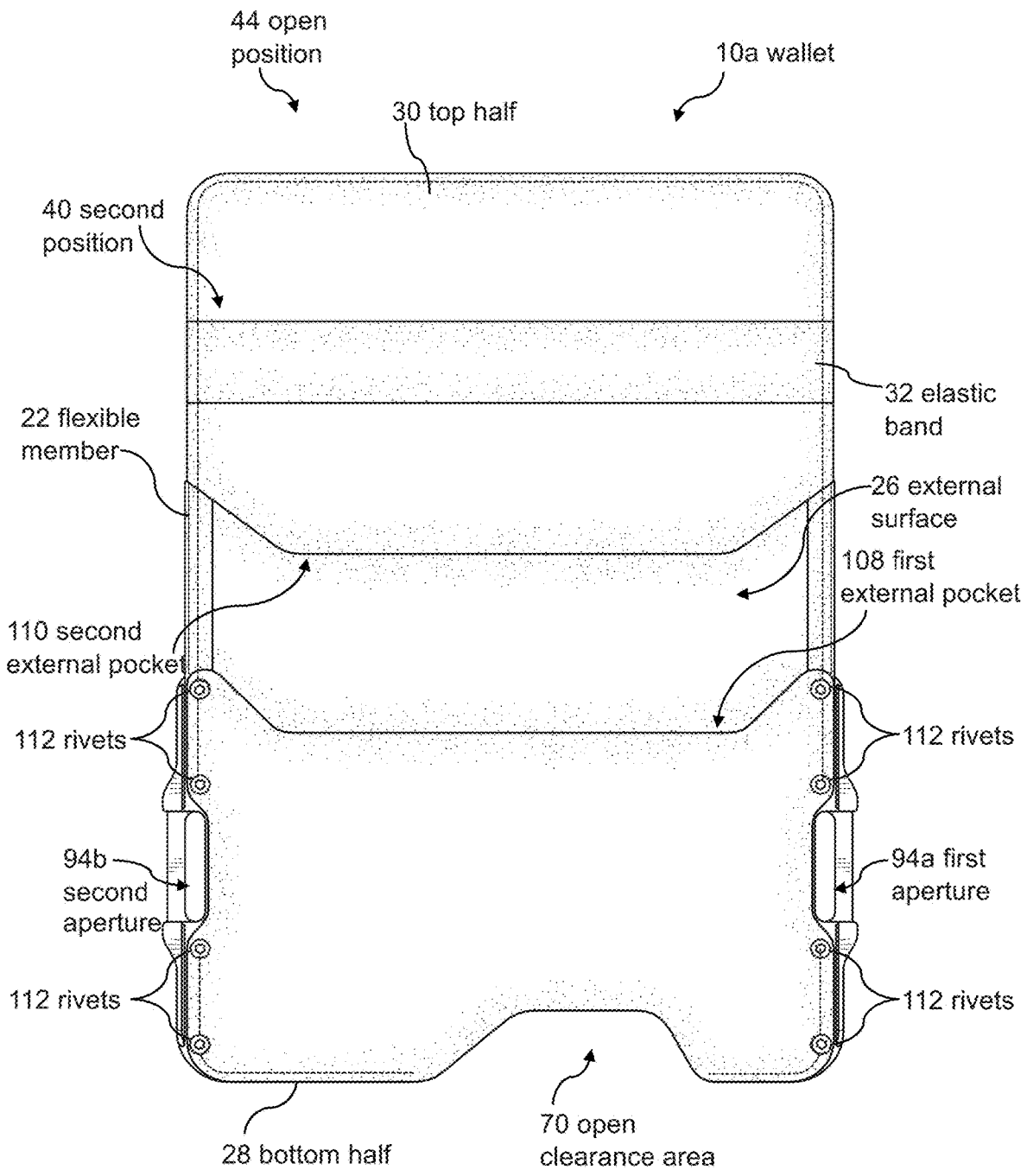
FIG. 27 illustrates a back exterior view of a wallet in an open position, according to some embodiments.

FIG. 27 shows a back view of the external surface 26 of the wallet 10*a* in the open position 44. As previously discussed, in many embodiments, the wallet 10*a* comprises a flexible member 22 having a top half 30 and a bottom half 28. FIG. 27 also includes the elastic band 32 coupled to the top half 30, and shows the band 32 in the second position 40 extending across the second external pocket 110. The first external pocket 108 is also included, as are the rivets 112 which, in many embodiments, couple the flexible member 22 and first external pocket 108 to a back surface of the open-sided shell 12. Though FIG. 27 shows the wallet 10*a* comprising eight total rivets 112, any number of rivets 112 may be used to couple the open-sided shell 12 to the flexible member 22. In addition, the rivets 112 are not limited to being located on opposite sides of the wallet 10*a* (e.g., the first and second side surfaces 96*a*, 96*b* of the bottom half 28), and may also be located along a bottom edge, as long as the rivets 112 do not interfere with the ability of the first external pocket 108 to hold at least one personal card 18. The rivets 112 may be evenly or unevenly distributed around the bottom half 28 of the flexible member 22. In some embodiments, the wallet 10*a* comprises another attachment mechanism (e.g., adhesive or the like) in addition to the rivets 112 in order to couple the flexible member 22 to the open-sided shell 12. The wallet 10*a* may comprise an alternative attachment mechanism(s) instead of the rivets 112.

FIG. 27 also illustrates that the first and second external pockets 108, 110 define complementary shapes. In some embodiments, the first external pocket 108 comprises a first piece of material coupled, along three edges, to the external surface 26 of the bottom half 28 of the flexible member 22. As previously mentioned, the coupling may comprise stitching 116, the use of rivets 112, or any other suitable method. In some embodiments, the coupling also comprises the use of rubber or a similar material to form a finished and/or fused edge along three edges of the first external pocket 108. It should be noted that the three coupled edges of the first external pocket 108 may include gaps or areas of non-coupling, for example, in the open clearance area 70. In some embodiments, the fourth edge of the first external pocket 108, or the non-coupled edge configured to receive the at least one personal card 18, defines a concave shape, as shown in FIG. 27. The non-coupled edge may define any shape including, but not limited to, a straight line, a convex shape, a concave shape, a scalloped shape, and the like. The non-coupled edge may be located adjacent a center portion of the flexible member 22.

In some embodiments, the second external pocket 110 comprises a second piece of material coupled, along three edges, to the external surface 26 of the top half 30 of the flexible member 22. As previously mentioned, the coupling may comprise stitching 116 or any other suitable method. In some embodiments, the coupling also comprises the use of rubber or a similar material to form a finished and/or fused edge along three edges of the second external pocket 110. Two side edges may include gaps where the elastic band 32 is coupled to the top half 30 of the flexible member 22. In some embodiments, the fourth edge of the second external pocket 110, or the non-coupled edge configured to receive the at least one personal card 18, defines a convex shape, as shown in FIG. 27. The non-coupled edge may define any shape including, but not limited to, a straight line, a convex shape, a concave shape, a scalloped shape, and the like. The non-coupled edge may be located adjacent a center portion of the flexible member 22.

Similar to the external pockets 108, 110, in some embodiments, the identification window 98 comprises a third piece of material coupled, along three edges, to the internal surface 24 of the top half 30 of the flexible member 22. As previously mentioned, the coupling may comprise stitching 116 or any other suitable method. In some embodiments, the coupling also comprises the use of rubber or a similar material to form a finished and/or fused edge along three edges of the identification window 98. It should be noted that, unlike the external pockets 108, 110, the third piece of material used to form the identification window 98 comprises more of a border than a solid piece, in order to create the aperture 100 in the window 98. In some embodiments, the fourth edge of the identification window 98, or the non-coupled edge configured to receive the at least one personal card 18, defines a straight edge, as shown in numerous previous Figures. The non-coupled edge may define any shape including, but not limited to, a straight line, a convex shape, a concave shape, a scalloped shape, and the like. The non-coupled edge may be located adjacent a center portion of the flexible member 22.

Figure 28:
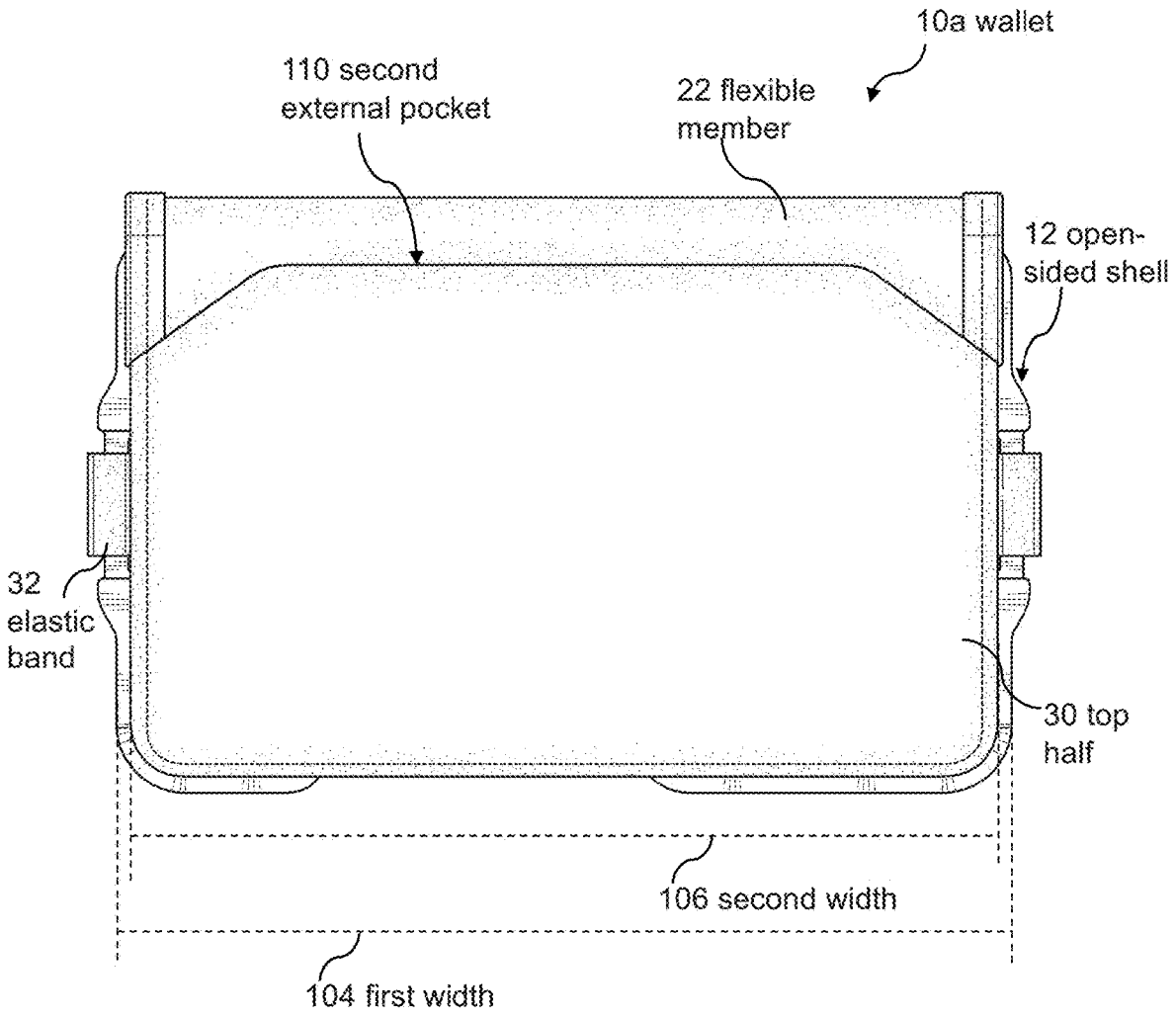
FIG. 28 illustrates a top half of a wallet, according to some embodiments.
Figure 29:
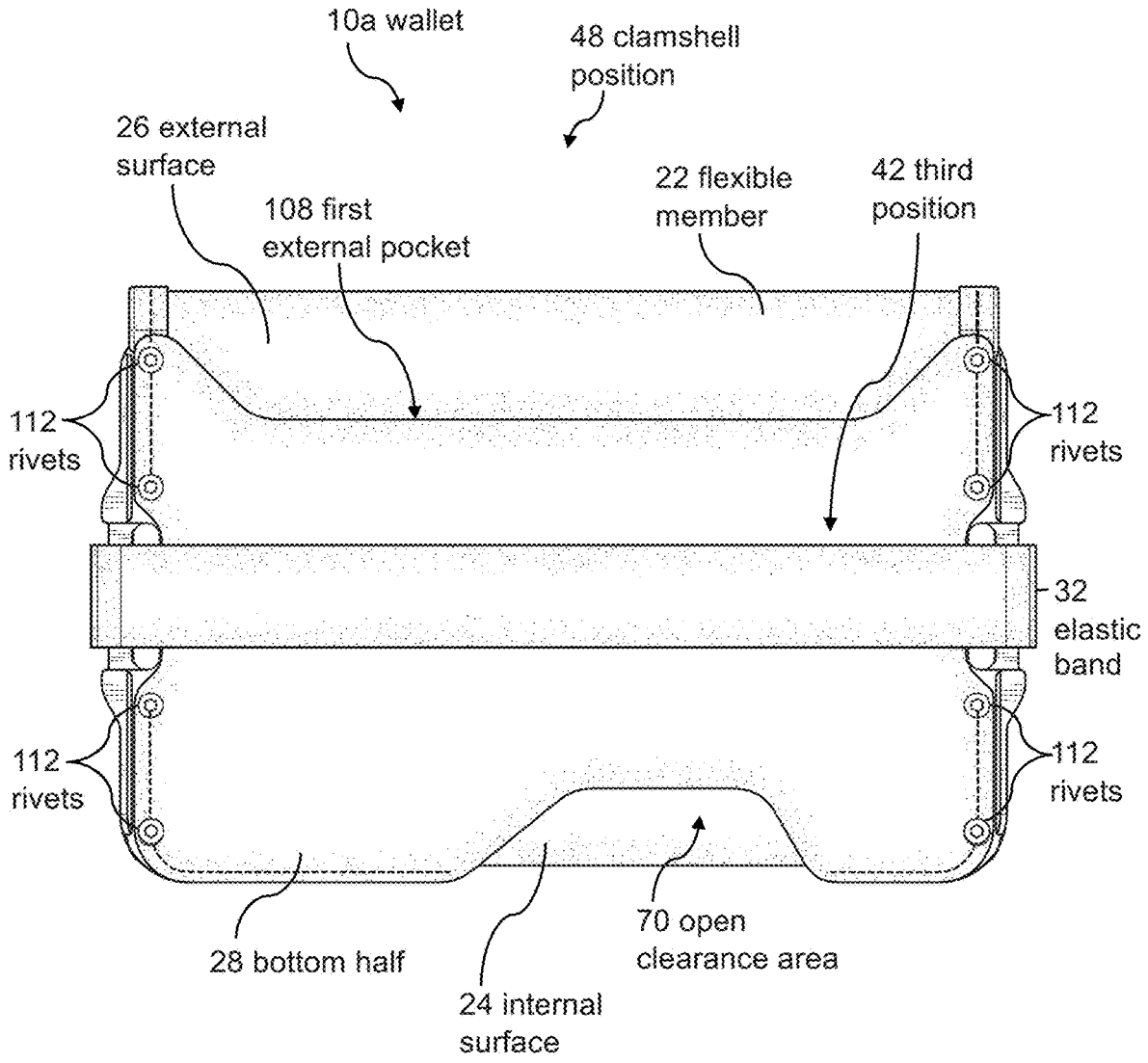
FIG. 29 illustrates a bottom half of a wallet, according to some embodiments.

Referring now to FIG. 28, the wallet 10*a* is shown in one of the closed position 46 and clamshell position 48, with a front view of the top half 30 of the flexible member 22. In many embodiments, the open-sided shell 12 defines a first width 104 and the flexible member 22 defines a second width 106. As indicated in FIG. 28, the first width 104 may be greater than the second width 106. In some embodiments, the first width 104 and the second width 106 are substantially the same. The first width 104 may be less than the second width 106. In many embodiments, the second width 106 is configured to be at least as wide as a standard credit card, such that the flexible member 22 is at least the same width, if not wider than, the at least one personal card 18. FIG. 29 illustrates a similar view as FIG. 28, but shows the bottom half 28 of the flexible member 22. In addition, FIG. 29 demonstrates that the wallet 10*a* is in the clamshell position 48, with the elastic band 32 in the third position 42. Similar to FIG. 27, FIG. 29 includes the rivets 112 coupling the open-sided shell 12 to the bottom half 28 of the flexible member 22. FIG. 29 also shows the open clearance area 70, and illustrates that, in many embodiments, the internal surface 24 of the top half 30 is visible through the open clearance area 70. The internal surface 24 may be visible both when no cards are coupled to the open-sided shell 12, as in FIG. 29, as well as when at least one personal card 18 is coupled to the open-sided shell 12. It should be noted that the first external pocket 108 may include an opening along the bottom edge of the pocket 108 corresponding to the open clearance area 70, such that at least one personal card 18 may be removed from the first external pocket 108 by pushing up on an exposed edge of the card 18 in the open clearance area 70.

Figure 30:
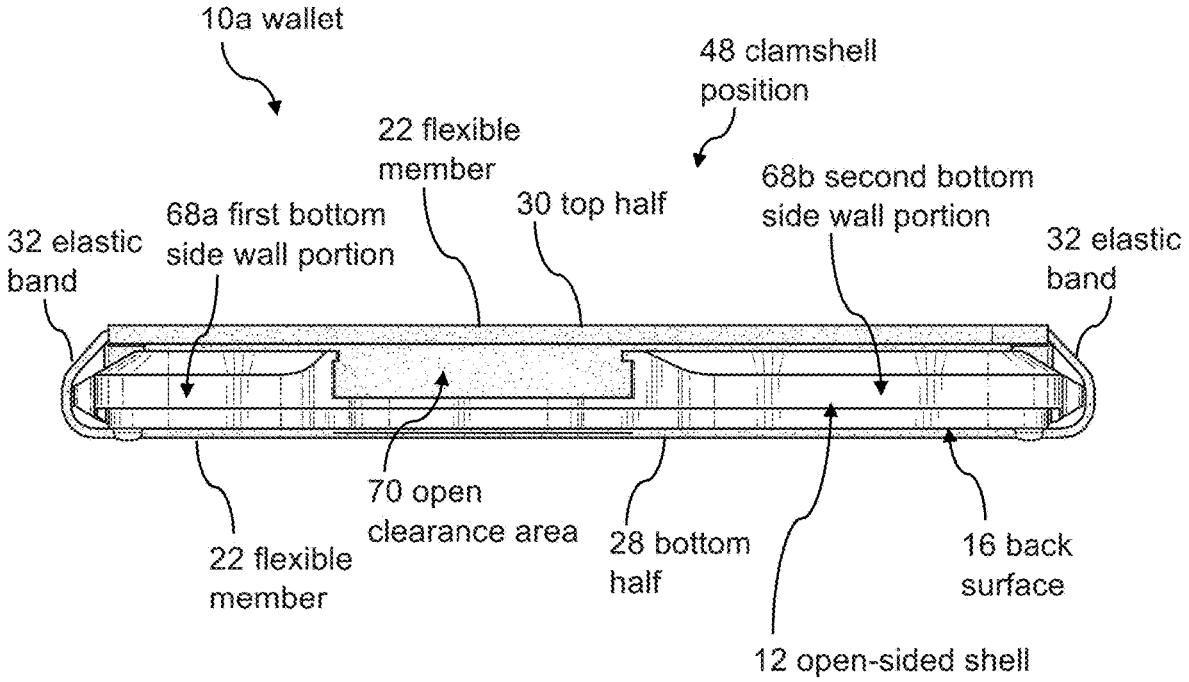
FIG. 30 illustrates a bottom view of a wallet in a clamshell position, according to some embodiments.

Turning now to FIG. 30, a bottom view of the wallet 10*a* in the clamshell position 48 is shown. The view includes the top half 30 of the flexible member 22, as well as the bottom half 28 of the flexible member 22. FIG. 30 also shows the back surface 16 of the open-sided shell 12, which is coupled to the bottom half 28 of the flexible member 22. The first and second bottom side wall portions 68*a*, 68*b* are shown with the open clearance area 70 located between the portions 68*a*, 68*b*. FIG. 30 also includes the elastic band 32 wrapped around each edge of the wallet 10*a*, thereby indicating that the wallet 10*a* is in the clamshell position 48.

Figure 31:
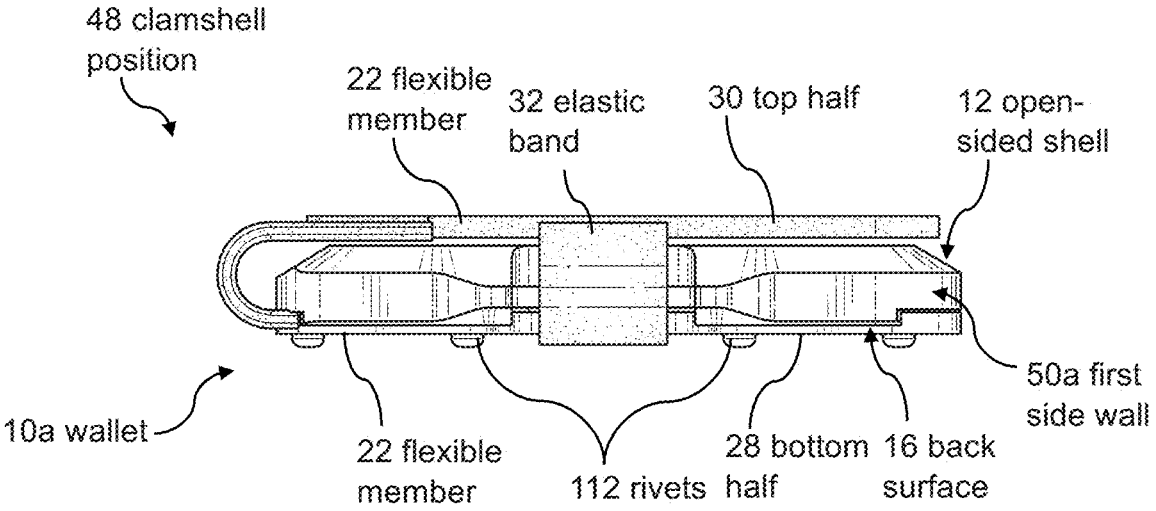
FIGS. 31 and 32 illustrate side views of a wallet in a clamshell position, according to some embodiments.
Figure 32:
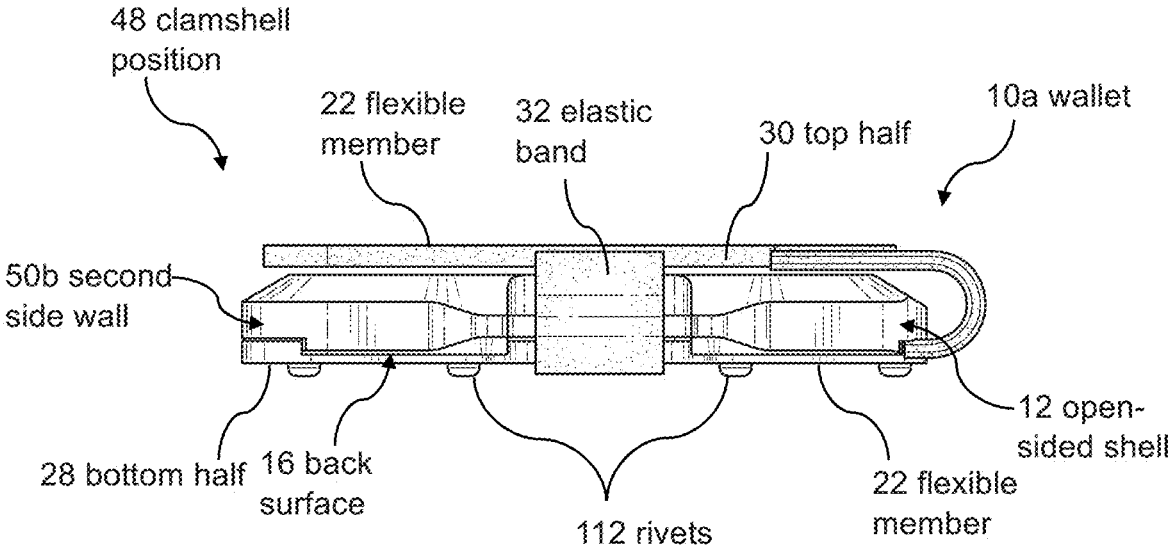

FIGS. 31 and 32 illustrate opposite side views of the wallet 10*a* again in the clamshell position 48, as shown in FIG. 30. FIG. 31 comprises a left side view of the wallet 10*a* and includes the first side wall 50*a* of the open-sided shell 12. In contrast, FIG. 32 comprises a right side view of the wallet 10*a* and includes the second side wall 50*b* of the open-sided shell 12. Both FIGS. 31 and 32 show the rivets 112 coupling the bottom half 28 of the flexible member 22 to the back surface 16 of the open-sided shell 12. The rivets 112 may have a shorter profile than shown in the Figures. For example, in some embodiments, the rivets 112 are flush with, or even embedded into, the bottom half 28 of the flexible member 22. As such, the rivets 112 may not always be visible in a side view of the wallet 10*a*. FIGS. 31 and 32 also both include the elastic band 32 wrapping around the wallet 10*a* from the top half 30 to the bottom half 28 of the flexible member 22, thereby indicating that the wallet 10*a* is in the clamshell position 48.

Figure 33:
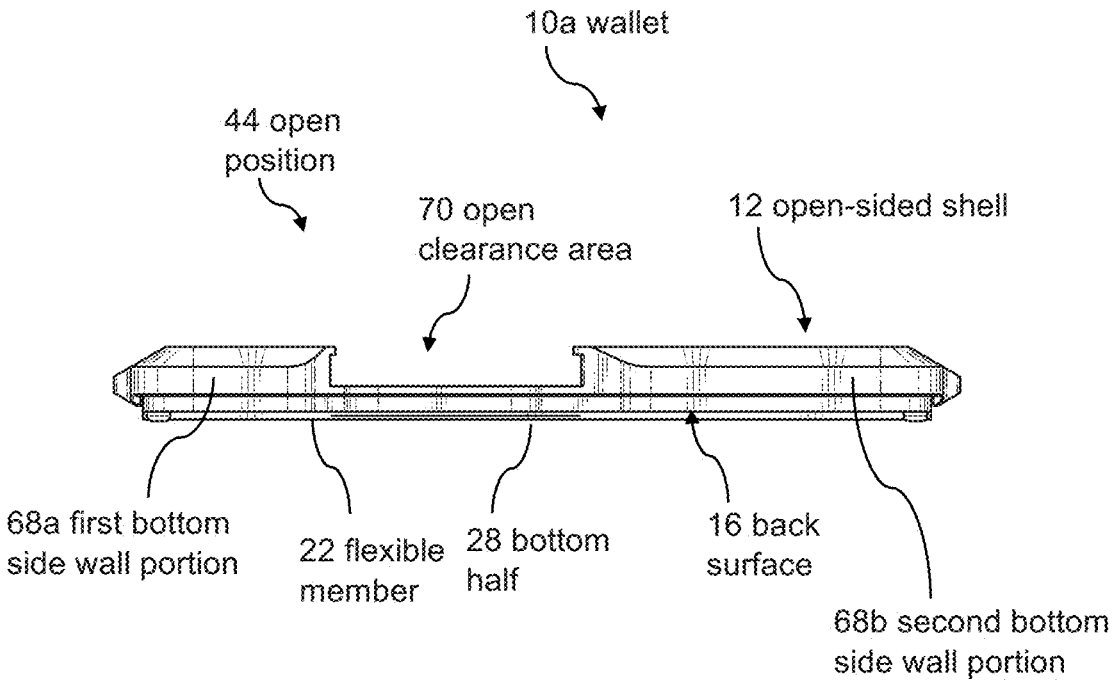
FIG. 33 illustrates a bottom view of a wallet in an open position, according to some embodiments.

FIG. 33 shows a bottom view of the wallet 10*a* in the open position 44. As such, FIG. 33 comprises mainly the open-sided shell 12 with the first and second bottom side wall portions 68*a*, 68*b*, as well as the bottom half 28 of the flexible member 22 coupled to the back surface 16 of the open-sided shell 12. FIG. 33 also shows the open clearance area 70 located between the first bottom side wall portion 68*a* and the second bottom side wall portion 68*b*.

Figure 34:
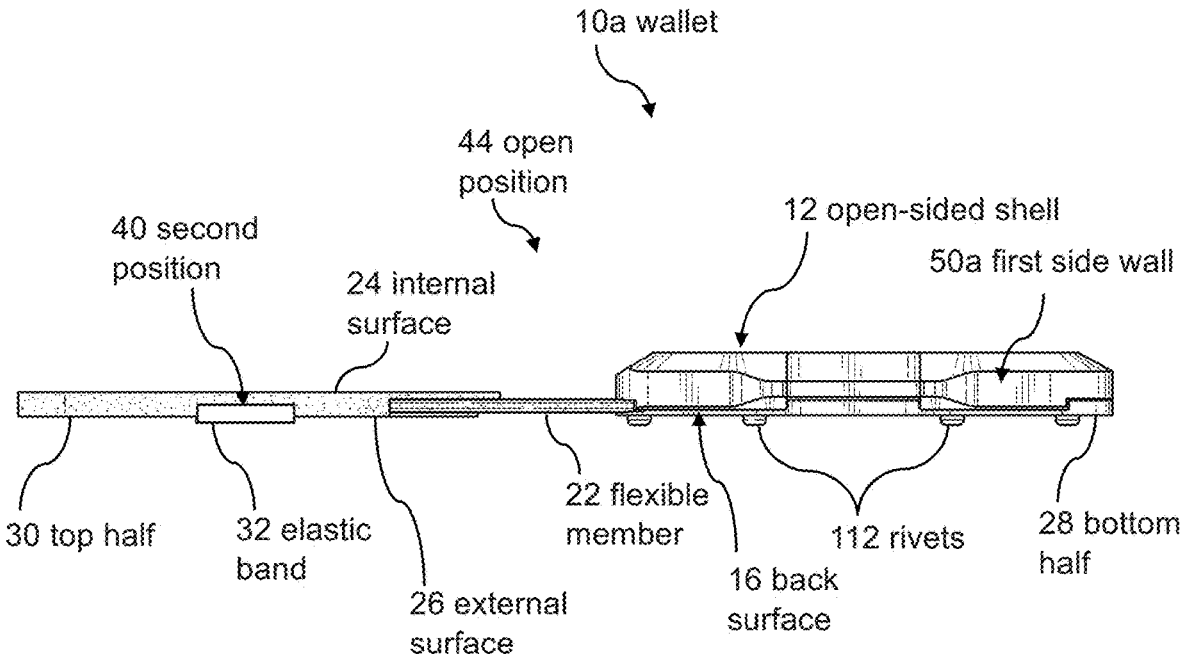
FIGS. 34 and 35 illustrate side views of a wallet in an open position, according to some embodiments.
Figure 35:
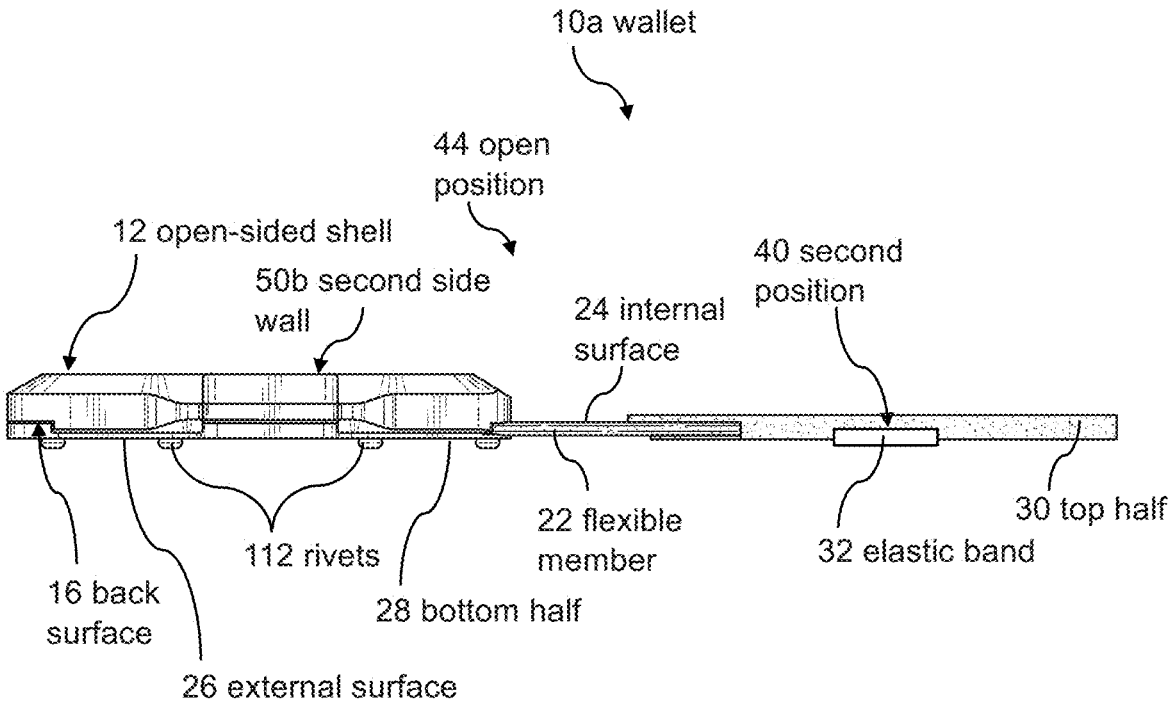

Similar to FIGS. 31 and 32, FIGS. 34 and 35 show opposite side views of the wallet 10*a*, but in the open position 44. FIG. 34 comprises a left side view including the first side wall 50*a* of the open-sided shell 12, and FIG. 35 comprises a right side view including the second side wall 50*b*. FIGS. 34 and 35 both show the wallet 10*a* facing up such that the internal surface 24 of the flexible member 22 is shown above the external surface 26. Both FIGS. 34 and 35 also illustrate the elastic band 32 in the second position 40, thereby wrapped around the external surface 26 of the flexible member 22. FIGS. 34 and 35 clearly illustrate the thickness of the top half 30 of the flexible member 22 compared to the thickness of the open-sided shell 12 coupled to the bottom half 28 of the flexible member 22.

Figure 36:
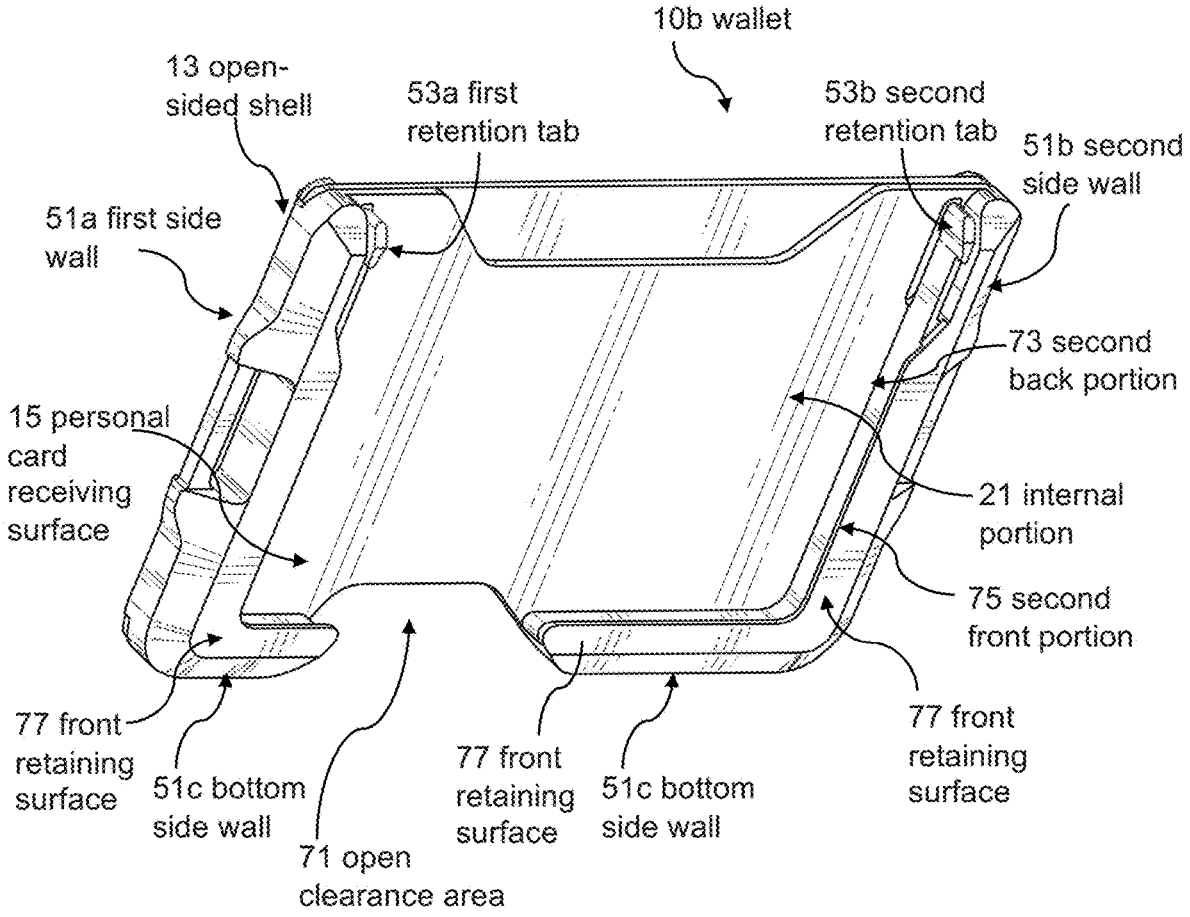
FIG. 36 illustrates a front perspective view of a wallet, according to some embodiments.
Figure 37:
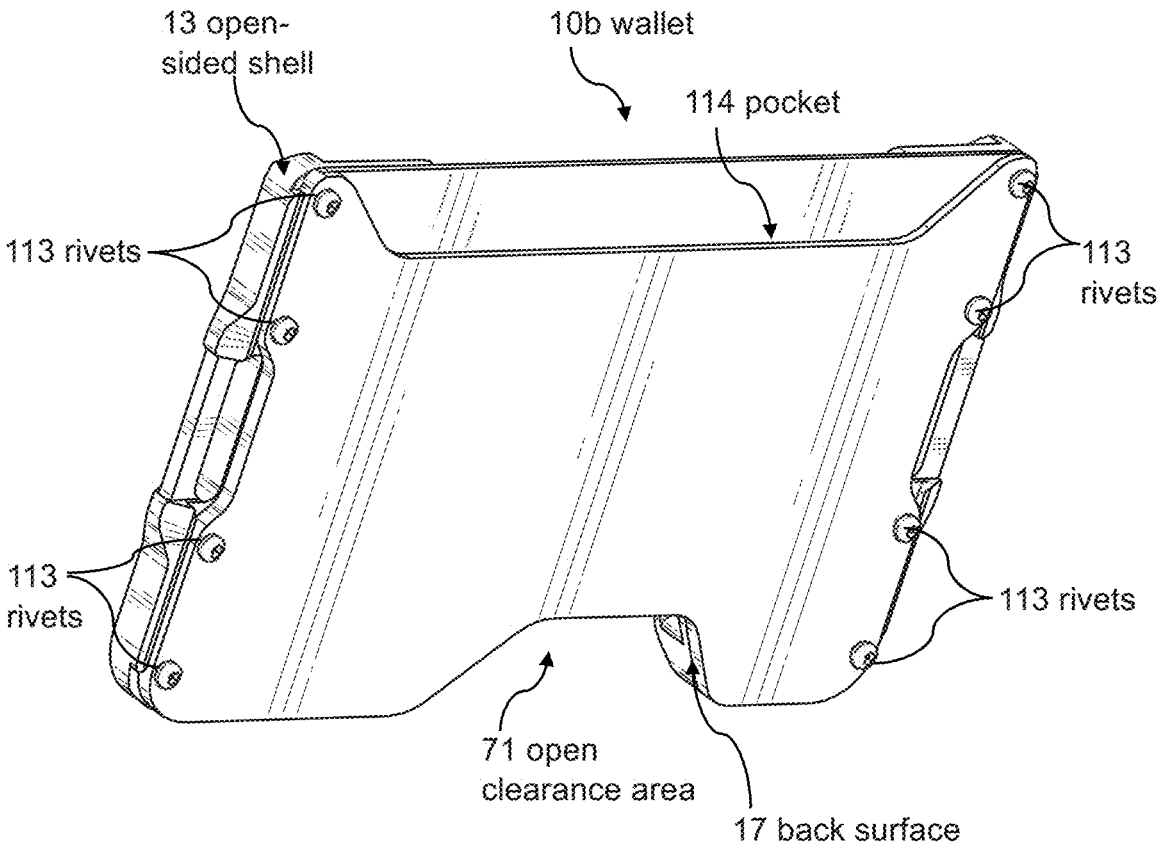
FIG. 37 illustrates a back perspective view of a wallet, according to some embodiments.

FIGS. 36-41 illustrate embodiments of a wallet 10*b*. The wallet 10*b* may be similar in some ways to the wallet 10*a*; for example, in some embodiments, the wallet 10*b* comprises an open-sided shell 13 that is substantially the same as the open-sided shell 12 of the wallet 10*a*. However, in many embodiments, the wallet 10*b* comprises a single pocket wallet design instead of the bifold design of the wallet 10*a*. As shown in FIG. 37, the wallet 10*b* may comprise a pocket 114 coupled to a back surface 17 of the open-sided shell 13, without the flexible member 22 and additional pockets 98, 110 of the wallet 10*a*.

FIG. 36 shows a front perspective view of the wallet 10*b*, including the open-sided shell 13. Similar to the open-sided shell 12 of the wallet 10*a*, the open-sided shell 13 may comprise a first side wall 51*a*, a second side wall 51*b*, and a bottom side wall 51*c*. The wallet 10*b* may also include a first retention tab 53*a* and a second retention tab 53*b*, which, in many embodiments, are substantially similar (in structure and function) to the first retention tab 52*a* and the second retention tab 52*b* of the wallet 10*a*. In some embodiments, the open-sided shell 13 comprises a front retaining surface 77 which, like the front retaining surface 76 of the wallet 10*a*, may be configured to extend down along the first side wall 51*a*, across the bottom side wall 51*c*, and up along the second side wall 51*b*. FIG. 36 also illustrates that, in some embodiments, the wallet 10*b* includes an open clearance area 71, which, similar to the other elements of the wallet 10*b*, may be substantially similar to the open clearance area 70 of the wallet 10*a*.

The angle of FIG. 36 includes an interior view of the second side wall 51*b* of the open-sided shell 13. It should be noted that though only illustrated and discussed in terms of the second side wall 51*b*, in many embodiments, both the first side wall 51*a* and the bottom side wall 51*c* comprise similar components as the second side wall 51*b*, which may all be similar to the first side wall 50*a*, second side wall 50*b*, and bottom side wall 50*c* of the wallet 10*a*. In many embodiments, the second side wall 51*b* defines a second back portion 73 and a second front portion 75 located opposite the second back portion 73, as illustrated in FIG. 36. The second front portion 75 and second back portion 73 may be considered to border a channel, or interior portion, in the second side wall 51*b*, wherein the at least one personal card 18 is received by the channel/interior portion. Stated differently, when the at least one personal card 18 is coupled to the open-sided shell 13, an edge of the card 18 may be located between the second back portion 73 and the second front portion 75, facing the interior portion, and kept in place (e.g., prevented from falling out of the wallet 10*b*) by the second front portion 75. In many embodiments, the open-sided shell 13 also includes a front retaining surface 77 that protrudes along the second direction from the second front portion 75 of the second side wall 51*b*.

As discussed with reference to the open-sided shell 12 of the wallet 10*a*, in some embodiments, the open-sided shell 13 comprises a beveled surface. In many embodiments, the front retaining surface 77 comprises the top, flat face of the open-sided shell 13 between the beveled surface and the internal portion 21 of the open-sided shell, as shown in FIG. 36. The second front portion 75 (and first and third front portions of the first and bottom side walls 51*a*, 51*c*) may be considered an inner edge of the front retaining surface 77 located opposite an edge of the front retaining surface 77 adjacent the beveled surface of the open-sided shell 13. The use of "flat" when describing the front retaining surface 77 is intended to convey that, in many embodiments, the front retaining surface 77 is parallel to the personal card receiving surface 15 of the open-sided shell 13.

FIG. 37 shows a back perspective view of the wallet 10*b*, including the pocket 114 coupled to the back surface 17 of the open-sided shell 13. Similar to the wallet 10*a*, in many embodiments, the open-sided shell 13 is coupled to the pocket 114 via rivets 113. Though FIG. 37 shows the wallet 10*b* comprising eight total rivets 113, any number of rivets 113 may be used to couple the open-sided shell 13 to the pocket 114. In addition, the rivets 113 are not limited to being located on opposite sides of the wallet 10*b*, and may also be located along a bottom edge, as long as the rivets 113 do not interfere with the ability of the pocket 114 to hold at least one personal card 18. The rivets 113 may be evenly or unevenly distributed around the pocket 114. In some embodiments, the wallet 10*b* comprises another attachment mechanism (e.g., adhesive or the like) in addition to the rivets 113 in order to couple the pocket 114 to the open-sided shell 13. The wallet 10*b* may comprise an alternative attachment mechanism(s) instead of the rivets 113.

Figure 38:
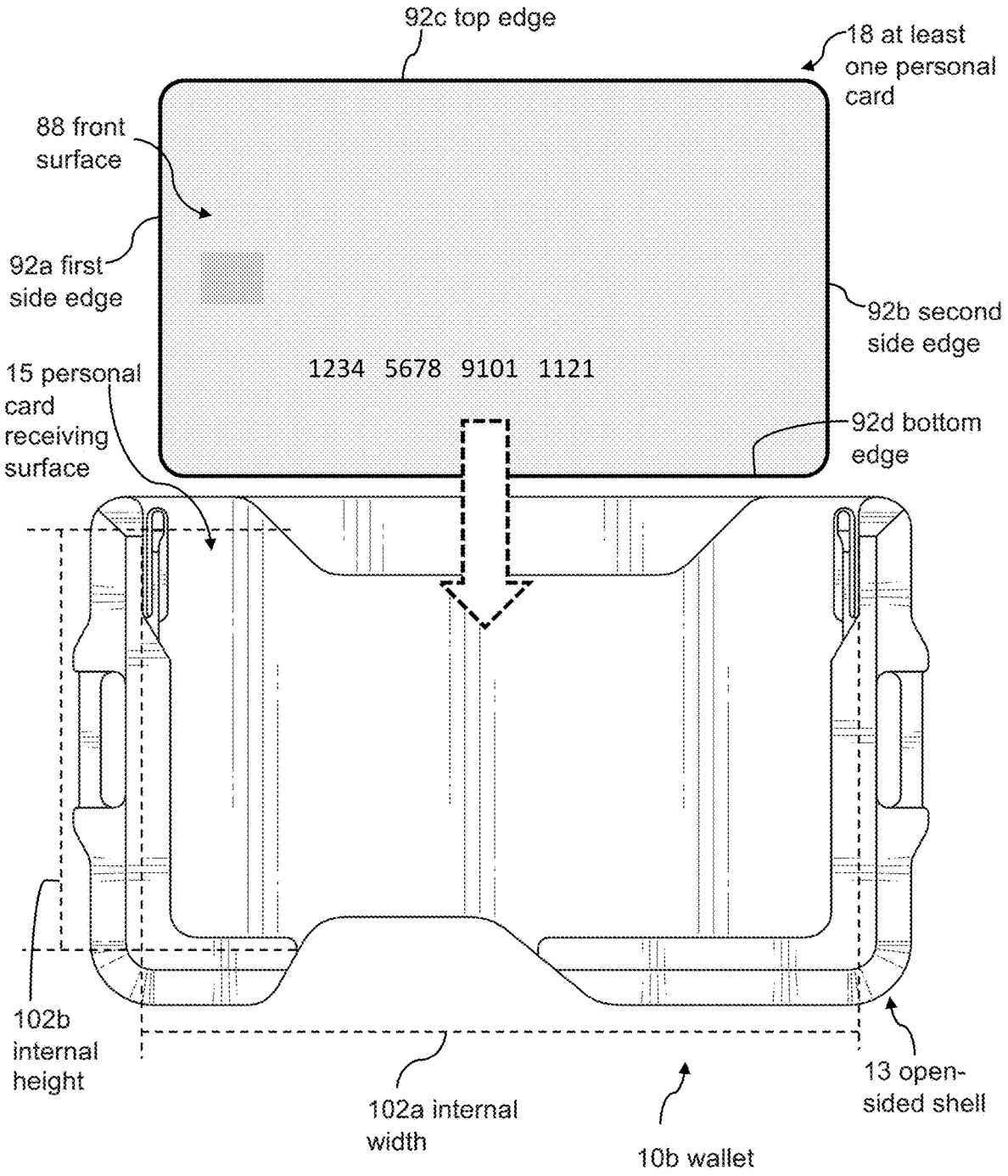
FIGS. 38, 39, and 40 illustrate front views of a wallet and at least one personal card, according to some embodiments.
Figure 39:
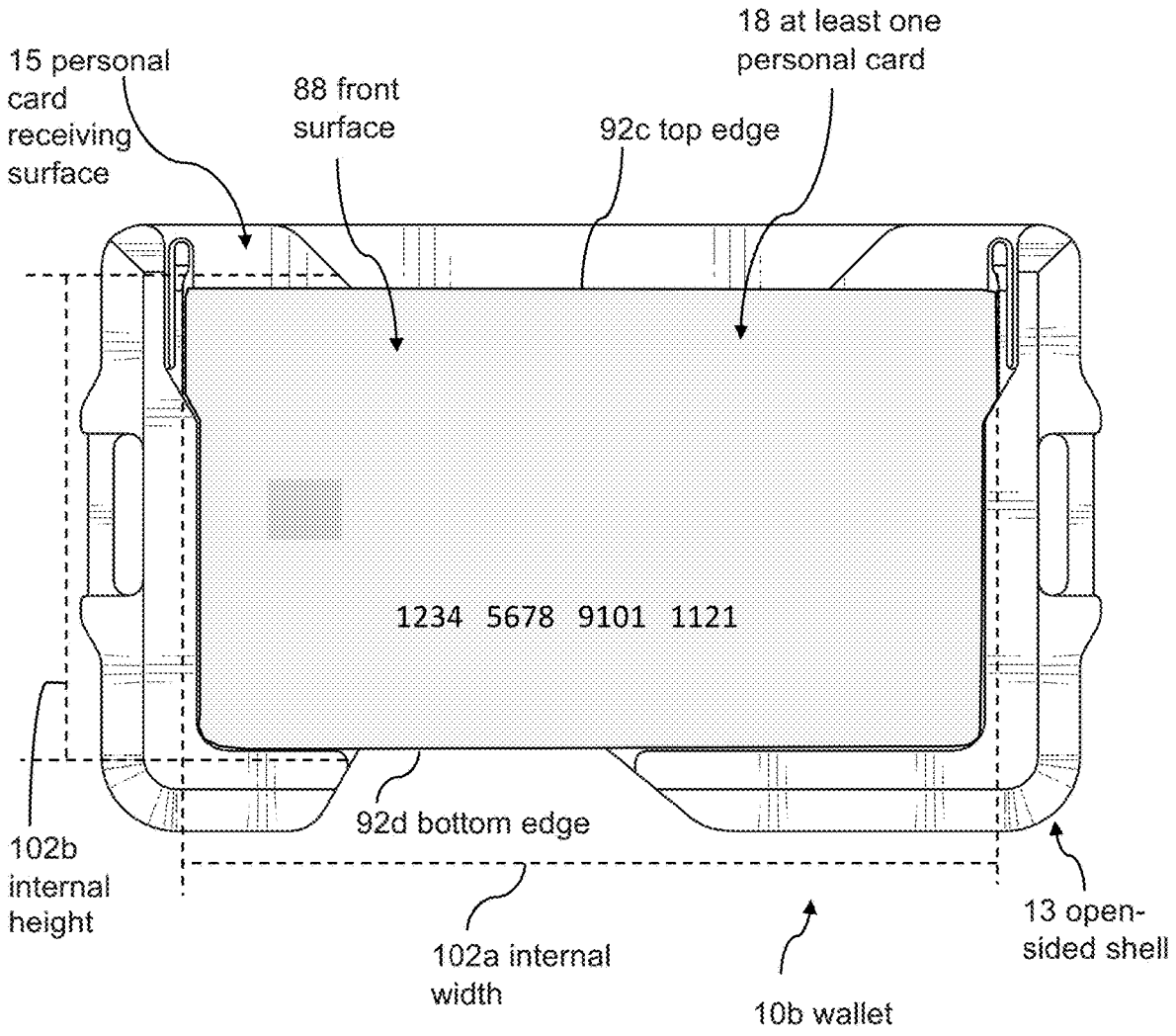

FIG. 38 shows a front view of the wallet 10*b* and at least one personal card 18 being inserted into the wallet 10*b*, as indicated by the dashed block arrow. In many embodiments, the at least one personal card 18 comprises a front surface 88, a back surface located opposite the front surface 88, a first side edge 92*a*, a second side edge 92*b* located opposite the first side edge 92*a*, a top edge 92*c*, and a bottom edge 92*d* located opposite the top edge 92*c*. When the at least one personal card 18 is securably coupled to the open-sided shell 13, as shown in FIG. 39, the back surface of the card 18 may be configured to face the personal card receiving surface 15. In many embodiments, the front retaining surface 77 of the open-sided shell 13 is configured to cover at least a portion of the front surface 88 along the first side edge 92*a*, the second side edge 92*b*, and the bottom edge 92*d*. FIG. 39 shows the at least one personal card 18 coupled to the open-sided shell 13 on top of the personal card receiving surface 15, and illustrates how the first side edge 92*a*, second side edge 92*b*, and bottom edge 92*d* are at least partially covered. In some embodiments, the front retaining surface 76 is configured to cover at least a portion of the front surface 88 of the at least one personal card 18 in a manner substantially the same as the front retaining surface 77.

FIGS. 38 and 39 also include an internal width 102*a* and internal height 102*b* of the open-sided shell 13. In many embodiments, the internal portion 21 of the open-sided shell 13 defines an internal width 102*a* measuring at least 3.375 inches and an internal height 102*b* measuring at least 2.125 inches. These measurements may correspond to the standard size of the at least one personal card 18 (e.g., standard credit card, gift card, identification card, and the like), which define a width of 3.375 inches and a height of 2.125 inches. In many embodiments, the internal width 102*a* is slight larger than 3.375 inches, such that the at least one personal card 18 has a small amount of "wiggle room" to move side-to-side while coupled to the open-sided shell 13. In some embodiments, the internal height 102*b* is slightly larger than 2.125 inches, such that the at least one personal card 18 rests below a top border of the open-sided shell 13. As shown in, and discussed with reference to, FIGS. 13 and 17, the at least one personal card 18 may be configured to fit just below the protruding portions of the first and second retention tabs 53*a*, 53*b*.

It should be noted that, in many embodiments, the internal width 102*a* and internal height 102*b* of the open-sided shell 13 also apply to the open-sided shell 12, such that the open-sided shell 12 and the open-sided shell 13 are substantially the same size. The internal width 102*a* may correspond to the width between the channels/interior portions of the first and second side walls 50, 51, as described with reference to FIGS. 21-23. The internal width 102*a* may also be defined as extending from the cantilever arm 66 of each retention tab 52, 53 down to the bottom side wall 50*c*, 51*c*.

Figure 40:
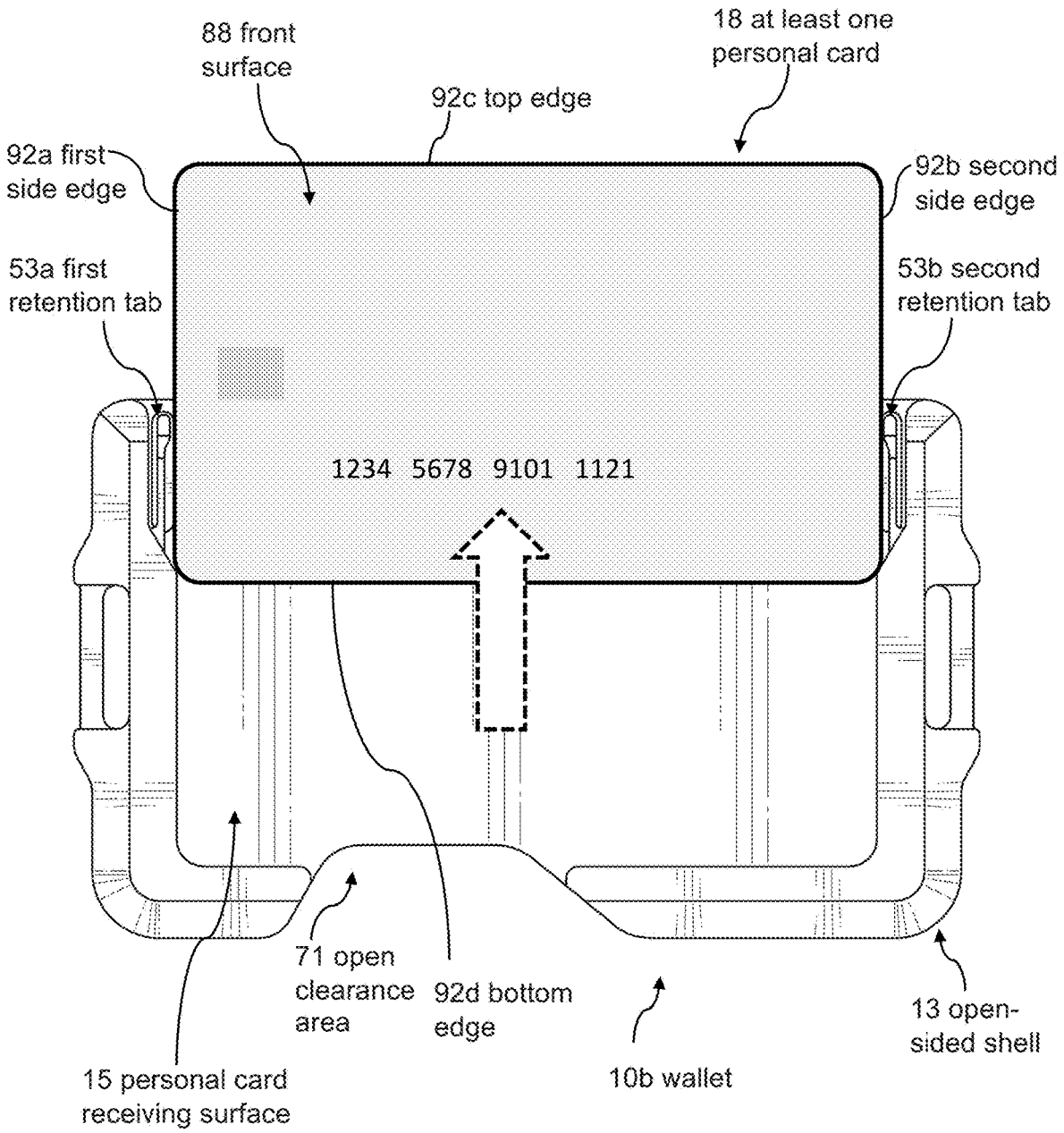

FIG. 40 is similar to FIG. 38, but shows the at least one personal card 18 being removed from the wallet 10*b*, as indicated by the dashed block arrow. Similar to removal of the at least one personal card 18 from the wallet 10*a*, the card 18 may be removed from the wallet 10*b* by a user accessing the card 18 via the open clearance area 71 and pushing on the bottom edge 92*d* of the card 18. Also similar to insertion/removal of the at least one personal card 18 from the wallet 10*a*, during insertion/removal of the at least one personal card 18 from the wallet 10*b*, the first and second retention tabs 53*a*, 53*b* may be configured to move away from one another in order to fit the at least one personal card 18 through the personal card receiving surface 15. In many embodiments, the process shown in, and described with reference to, FIGS. 12-15, is substantially the same as the process for inserting and/or removing the at least one personal card 18 from the open-sided shell 13 of the wallet 10*b*. The at least one personal card 18 may also be configured to be inserted into and/or removed from the open-sided shell 13 using substantially the same "angled" method shown in, and discussed with reference to, FIGS. 16-18.

Figure 41:
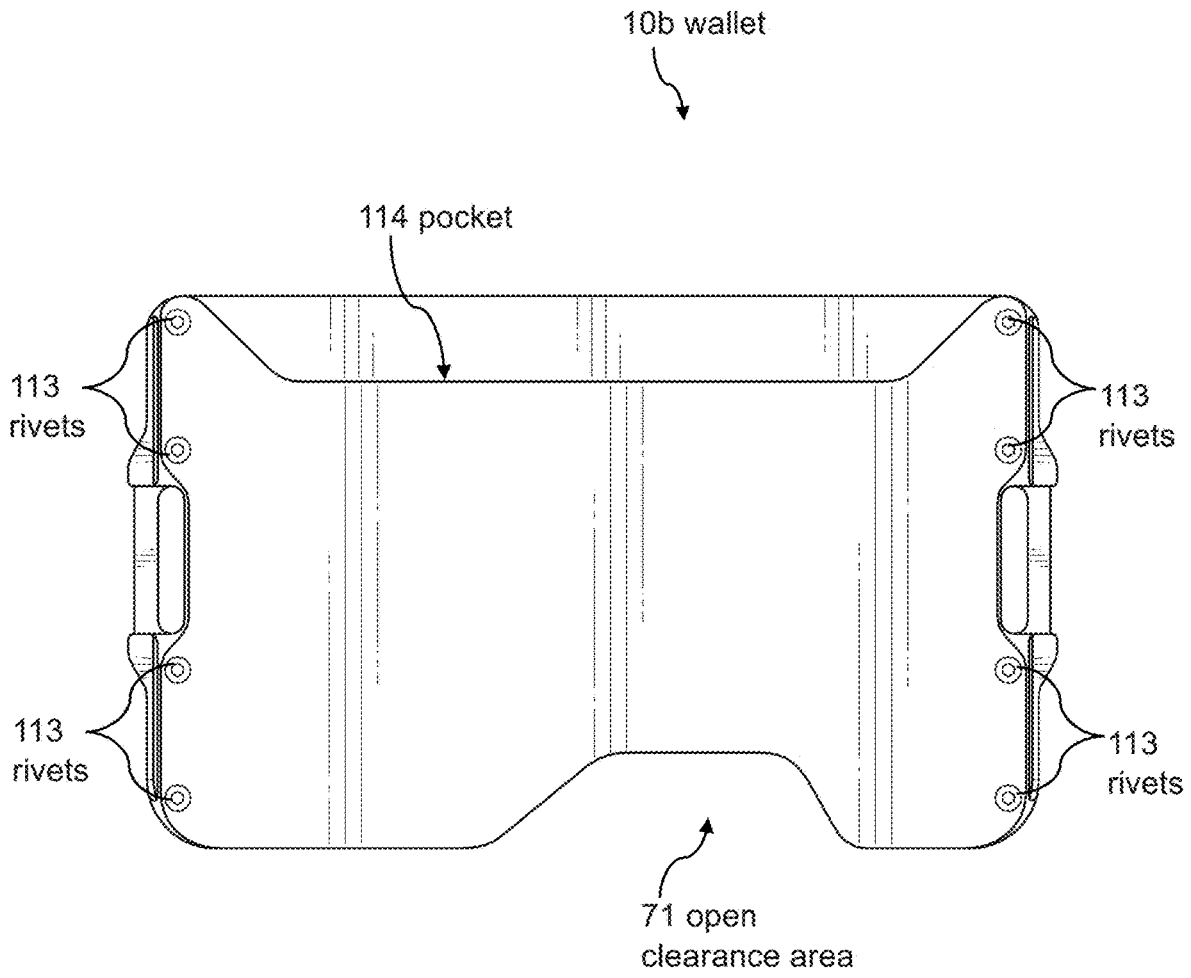
FIG. 41 illustrates a back view of a wallet, according to some embodiments.

FIG. 41 shows a back view of the wallet 10*b*, including the pocket 114 coupled to the open-sided shell 13 via the rivets 113. In some embodiments, like the open-sided shell 13, the pocket 114 includes an open clearance area 71 that exposes a bottom edge 92*d* of at least one personal card 18 coupled to the pocket 114. As such, a user may be able to remove the at least one personal card 18 by pushing on the exposed edge 92*d* in the open clearance area 71. It should also be noted that though not shown in the Figures depicting the wallet 10*b*, in many embodiments, the wallet 10*b* includes stitching similar to the stitching 116 shown on the wallet 10*a*. For example, the wallet 10*b* may include stitching on the pocket 114 between the rivets 113 and along at least a portion of a bottom edge of the pocket 114. Stitching may be used to couple the pocket 114 to an additional piece of material, wherein the additional piece of material is configured to face the back surface 17 of the open-sided shell 13. In this way, the additional piece of material may be considered a "backing piece" similar to the bottom half 28 of the flexible member 22 of the wallet 10*a*, where the bottom half 28 is coupled to the back surface 16 of the open-sided shell 12 and to the first external pocket 108.

In many embodiments, the flexible member 22, identification window 98, first external pocket 108, and second external pocket 110 of the wallet 10*a*, as well as the pocket 114 and "backing piece" of the wallet 10*b* are comprised of a flexible yet durable material, such as leather. The recited components may comprise a high-quality material, such as top grain genuine leather. In some embodiments, at least one of the flexible member 22, the identification window 98, the first external pocket 108, the second external pocket 110, and the pocket 114 comprise a tougher, yet still flexible, non-leather material, such as DTEX. In some embodiments, different elements of a wallet 10*a*, 10*b* comprise different materials. For example, one embodiment of the wallet 10*a* may comprise a leather flexible member 22 with DTEX external pockets 108, 110, and a DTEX identification window 98. In many embodiments, the elements other than the open-sided shell 12, 13 of a wallet 10*a*, 10*b* comprise substantially the same material. Any of the identification window 98, first external pocket 108, second external pocket 110, and pocket 114 may be configured to receive folded paper currency, in addition to or instead of at least one personal card 18.

The open-sided shell 12, 13 may comprise any metal material. In many embodiments, the open-sided shell 12, 13 comprises aluminum, and the personal card receiving surface 14, 15 comprises carbon fiber. The open-sided shell 12, 13 may comprise powder-coated aluminum. The open-sided shell 12, 13 and the personal card receiving surface 14, 15 may comprise the same material. The rivets 112, 113 may comprise any metal material, such as stainless steel. A person having ordinary skill in the art of wallet design and manufacturing may not see the use of CNC-machined metal as an obvious choice, and may instead look to plastic or other similar hard materials to create the open-sided shell 12, 13 and associated elements (personal card receiving surface 14, 15, rivets 112, 113, etc.). However, this disclosure includes metal material(s) for the open-sided shell 12, 13 in order to create a more durable and higher quality (in look and feel) product than what would be produced using plastic or a similar material.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

The term "about" is used to mean "approximately." For example, the disclosure includes, "In some embodiments, the difference between the first distance 64*a* and second distance 64*b* is about a few millimeters." In this context, "about a few millimeters" is used to mean "approximately" a few millimeters. A range of 1-10 millimeters falls into an acceptable range and interpretation of "about a few millimeters," as used in this disclosure.

The term "substantially" is used to mean "completely" or "nearly completely." For example, the disclosure includes, "When the wallet is in the open position, the flexible member may be configured to lay substantially flat . . . " In this context, "substantially flat" is used to mean that the flexible member may lay "completely" flat or "nearly completely" flat, and fall into the understanding of "substantially" as used in this disclosure. It is understood that the flexible member may or may not lay "completely" flat, depending on a number of factors, including position of the elastic band and number of cards coupled to the identification window and/or second external pocket. In many embodiments, when the wallet is in the open position, the flexible member may be considered to lay substantially flat.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A wallet, comprising:

an open-sided shell having a personal card receiving surface and a back surface facing opposite the personal card receiving surface, the open-sided shell configured to securably couple at least one personal card along the personal card receiving surface within an internal portion of the open-sided shell, wherein the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface;

a flexible member including an internal surface and an external surface facing opposite the internal surface, the flexible member defining a bottom half and a top half located opposite the bottom half, wherein the internal surface of the bottom half is coupled to the back surface of the open-sided shell, and wherein the internal surface of the top half is configured to retain and receive an identification card;

a first protruding portion coupled to the first side wall and configured to move away from the second side wall to thereby receive the at least one personal card, the first side wall defining a first top portion and a first bottom portion located adjacent the bottom side wall, the protruding portion located adjacent the first top portion;

a second protruding portion coupled to the second side wall and configured to move away from the first side wall to thereby receive the at least one personal card, the second side wall defining a second top portion and a second bottom portion located adjacent the bottom side wall, the second protruding portion located adjacent the second top portion; and a band configured to surround at least a portion of the flexible member, wherein the first side wall and the second side wall are elongate along a first direction, and the bottom side wall is elongate along a second direction perpendicular to the first direction, and wherein the band wraps around at least the portion of the flexible member along the second direction.

2. The wallet of claim 1, wherein the first protruding portion and the second protruding portion are configured to move between a locked position and a receiving position, wherein when the first protruding portion and the second protruding portion are in the locked position the first protruding portion and the second protruding portion are located a first distance from each other, wherein when the first protruding portion and second protruding portion are in the receiving position the first protruding portion and the second protruding portion are located a second distance from each other, and wherein the first distance is less than the second distance.

3. The wallet of claim 2, wherein when the open-sided shell receives the at least one personal card, the first protruding portion moves away from the second side wall and the second protruding portion moves away from the first side wall to thereby receive the at least one personal card, and wherein when the open-sided shell securably couples the at least one personal card within the internal portion, the first protruding portion moves towards the second side wall and the second protruding portion moves towards the first side wall to thereby securably lock the at least one personal card within the internal portion of the open-sided shell.

4. The wallet of claim 1, wherein the bottom side wall comprises a first bottom side wall portion, a second bottom side wall portion, and an open clearance area located between the first bottom side wall portion and the second bottom side wall portion, whereby the open clearance area is configured to receive a user's finger to thereby push the at least one personal card away from the bottom side wall.

5. The wallet of claim 1, wherein the first side wall and the second side wall are elongate along a first direction, and the bottom side wall is elongate along a second direction perpendicular to the first direction, wherein the first side wall defines a first back portion located adjacent to the personal card receiving surface, and a first front portion located opposite the first back portion, wherein the second side wall defines a second back portion located adjacent to the personal card receiving surface, and a second front portion located opposite the second back portion, wherein the bottom side wall defines a third back portion located adjacent to the personal card receiving surface, and a third front portion located opposite the third back portion, and wherein the open-sided shell comprises a front retaining surface protruding along the second direction from the first front portion of the first side wall, along the second direction from the second front portion of the second side wall, and along the first direction from the third front portion of the bottom side wall, and wherein the front retaining surface is spaced from the personal card receiving surface.

6. The wallet of claim 5, wherein the front retaining surface extends around at least a portion of a perimeter of the personal card receiving surface, wherein the front retaining surface comprises a left side retaining surface and a right side retaining surface.

7. The wallet of claim 6, wherein the at least one personal card comprises a front surface and a back surface located opposite the front surface, wherein when the at least one personal card is securably coupled to the open-sided shell with the back surface facing the personal card receiving surface, the front retaining surface is configured to cover at least a portion of the front surface.

8. A wallet comprising:

an open-sided shell having a personal card receiving surface and a back surface facing opposite the personal card receiving surface, the open-sided shell configured to securably couple at least one personal card along the personal card receiving surface within an internal portion of the open-sided shell, wherein the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface;

a flexible member including an internal surface and an external surface facing opposite the internal surface, the flexible member defining a bottom half and a top half located opposite the bottom half, wherein the internal surface of the bottom half is coupled to the back surface of the open-sided shell, and wherein the internal surface of the top half is configured to retain and receive an identification card;

a first protruding portion coupled to the first side wall and configured to move away from the second side wall to thereby receive the at least one personal card, the first side wall defining a first top portion and a first bottom portion located adjacent the bottom side wall, the protruding portion located adjacent the first top portion;

a second protruding portion coupled to the second side wall and configured to move away from the first side wall to thereby receive the at least one personal card, the second side wall defining a second top portion and a second bottom portion located adjacent the bottom side wall, the second protruding portion located adjacent the second top portion; and an identification window coupled to the top half of the flexible member and located along the internal surface of the flexible member, the identification window configured to receive and retain the identification card, wherein the identification window includes an aperture configured to allow a user to view and directly contact the internal surface of the flexible member located beneath the identification window.

9. The wallet of claim 8, further comprising:

a first external pocket coupled to the top half of the flexible member and located along the external surface of the flexible member opposite the identification window, the first external pocket configured to receive and retain the at least one personal card; and a second external pocket coupled to the bottom half of the flexible member and located along the external surface of the flexible member opposite the open-sided shell, the second external pocket configured to receive and retain the at least one personal card, the second external pocket comprising an open clearance area configured to receive a user's finger to thereby push the at least one personal card out of the second external pocket.

10. The wallet of claim 9, wherein the identification window and the first external pocket are coupled to the top half of the flexible member via stitching extending along a perimeter of the top half of the flexible member, and wherein the second external pocket is coupled to the flexible member via stitching and is coupled to the open-sided shell via a plurality of rivets, wherein the stitching and the plurality of rivets extend around a perimeter of the bottom half of the flexible member.

11. A wallet comprising:

an open-sided shell having a personal card receiving surface and a back surface facing opposite the personal card receiving surface, the open-sided shell configured to securably couple at least one personal card along the personal card receiving surface within an internal portion of the open-sided shell;

a flexible member including an internal surface and an external surface facing opposite the internal surface, the flexible member defining a bottom half and a top half located opposite the bottom half, wherein the internal surface of the bottom half is coupled to the back surface of the open-sided shell, and wherein the internal surface of the top half is configured to retain and receive an identification card;

a stretchable band configured to wrap around the open-sided shell and the bottom half of the flexible member, the stretchable band configured to securably couple at least one personal card against at least one of the personal card receiving surface and the external surface of the flexible member; and an identification window coupled to the top half of the flexible member and located along the internal surface of the flexible member, the identification window configured to receive the identification card, wherein the identification window includes an aperture configured to allow a user to view and directly contact the internal surface of the flexible member located beneath the identification window.

12. The wallet of claim 8, further comprising a band configured to surround at least a portion of the flexible member, wherein the first side wall and the second side wall are elongate along a first direction, and the bottom side wall is elongate along a second direction perpendicular to the first direction, and wherein the band wraps around at least the portion of the flexible member along the second direction.

13. The wallet of claim 8, wherein the bottom side wall comprises a first bottom side wall portion, a second bottom side wall portion, and an open clearance area located between the first bottom side wall portion and the second bottom side wall portion, whereby the open clearance area is configured to receive a user's finger to thereby push the at least one personal card away from the bottom side wall.

14. A wallet comprising:

an open-sided shell having a personal card receiving surface and a back surface facing opposite the personal card receiving surface, the open-sided shell configured to securably couple at least one personal card along the personal card receiving surface within an internal portion of the open-sided shell, wherein the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface;

a flexible member including an internal surface and an external surface facing opposite the internal surface, the flexible member defining a bottom half and a top half located opposite the bottom half, wherein the internal surface of the bottom half is coupled to the back surface of the open-sided shell, wherein the internal surface of the top half is configured to retain and receive an identification card, and wherein the open-sided shell defines a first width, and the flexible member defines a second width that is less than the first width;

a first protruding portion coupled to the first side wall and configured to move away from the second side wall to thereby receive the at least one personal card, the first side wall defining a first top portion and a first bottom portion located adjacent the bottom side wall, the protruding portion located adjacent the first top portion; and a second protruding portion coupled to the second side wall and configured to move away from the first side wall to thereby receive the at least one personal card, the second side wall defining a second top portion and a second bottom portion located adjacent the bottom side wall, the second protruding portion located adjacent the second top portion.

15. The wallet of claim 14, further comprising an identification window coupled to the top half of the flexible member and located along the internal surface of the flexible member, the identification window configured to receive the identification card, wherein the identification window includes an aperture configured to allow a user to view and directly contact the internal surface of the flexible member located beneath the identification window.

16. The wallet of claim 15, further comprising:

a first external pocket coupled to the top half of the flexible member and located along the external surface of the flexible member opposite the identification window, the first external pocket configured to receive and retain the at least one personal card; and a second external pocket coupled to the bottom half of the flexible member and located along the external surface of the flexible member opposite the open-sided shell, the second external pocket configured to receive and retain the at least one personal card.

17. The wallet of claim 14, wherein the bottom side wall comprises a first bottom side wall portion, a second bottom side wall portion, and an open clearance area located between the first bottom side wall portion and the second bottom side wall portion, whereby the open clearance area is configured to receive a user's finger to thereby push the at least one personal card away from the bottom side wall.

18. The wallet of claim 11, wherein the open-sided shell comprises a first side wall, a second side wall located opposite the first side wall, and a bottom side wall extending between the first side wall and the second side wall, whereby the first side wall, the second side wall, and the bottom side wall are configured to retain the at least one personal card in place with respect to the personal card receiving surface, and wherein the first side wall and the second side wall are elongate along a first direction, and the bottom side wall is elongate along a second direction perpendicular to the first direction, and wherein the stretchable band wraps around the open-sided shell and the bottom half of the flexible member along the second direction, the wallet further comprising a radio frequency identification (RFID) protection plate coupled to the open-sided shell, wherein the RFID protection plate is located between the personal card receiving surface and the stretchable band, the RFID protection plate configured to move along a third direction perpendicular to the first direction and the second direction to securably couple the at least one personal card between the RFID protection plate and the personal card receiving surface, wherein the stretchable band is configured to extend along the third direction to couple at least one of at least one personal card and at least one paper bill between the stretchable band and the bottom half of the external surface of the flexible member.

19. The wallet of claim 18, wherein the bottom side wall comprises a first bottom side wall portion, a second bottom side wall portion, and an open clearance area located between the first bottom side wall portion and the second bottom side wall portion, whereby the open clearance area is configured to receive a user's finger to thereby push the at least one personal card away from the bottom side wall.

20. The wallet of claim 11, further comprising:

a first external pocket coupled to the top half of the flexible member and located along the external surface of the flexible member opposite the identification window, the first external pocket configured to receive and retain the at least one personal card; and a second external pocket coupled to the bottom half of the flexible member and located along the external surface of the flexible member opposite the open-sided shell, the second external pocket configured to receive and retain the at least one personal card.

* * * * *